US012392162B2

(12) United States Patent
McCarthy et al.

(10) Patent No.: US 12,392,162 B2
(45) Date of Patent: Aug. 19, 2025

(54) FENCE SYSTEM

(71) Applicant: Vision Extrusions Ltd., Woodbridge (CA)

(72) Inventors: Peter McCarthy, Woodbridge (CA); Vic DeZen, Woodbridge (CA); Rolf J. Ohrstrom, Richmond Hill (CA)

(73) Assignee: Vision Extrusions Ltd., Woodbridge (CA)

( * ) Notice: Subject to any disclaimer, the term of this patent is extended or adjusted under 35 U.S.C. 154(b) by 1176 days.

(21) Appl. No.: 17/107,373

(22) Filed: Nov. 30, 2020

(65) Prior Publication Data

US 2021/0079684 A1 Mar. 18, 2021

Related U.S. Application Data

(60) Continuation of application No. 14/990,552, filed on Jan. 7, 2016, now Pat. No. 10,851,560, which is a (Continued)

(30) Foreign Application Priority Data

Jun. 18, 2009 (CA) ..... CA 2669440

(51) Int. Cl.
*E04H 17/14* (2006.01)
*E04H 17/16* (2006.01)

(52) U.S. Cl.
CPC ..... *E04H 17/1439* (2013.01); *E04H 17/1404* (2013.01); *E04H 17/1417* (2013.01); (Continued)

(58) Field of Classification Search
CPC ..... E04H 17/16; E04H 17/161; E04H 17/165; E04H 17/166; E04H 17/168; E04H 17/1404; E04H 17/1417; E04H 17/1421; E04H 17/143; E04H 17/1443; E04H 17/1439; E04H 2017/1469; E04F 2011/1823
(Continued)

(56) References Cited

U.S. PATENT DOCUMENTS 753,791 A 3/1904 Fulghum
1,114,486 A 10/1914 Kimball
(Continued)

FOREIGN PATENT DOCUMENTS

CA 1318164 C 5/1993
CA 2157325 A1 3/1997
(Continued)

OTHER PUBLICATIONS

Applicant, Amendment (Response to Non Final Office Action Dated Jul. 1, 2021), U.S. Appl. No. 16/190,554, filed Oct. 1, 2021, 6 pages.
(Continued)

*Primary Examiner* — Matthew R McMahon
(74) *Attorney, Agent, or Firm* — Reinhart Boerner Van Deuren s.c.

(57) ABSTRACT

A fence section includes an upper horizontal rail, a lower horizontal rail, and vertical members. At least one of the vertical members is connected to the upper horizontal rail by an upper connection system and to the lower horizontal rail by a lower connection system.

20 Claims, 31 Drawing Sheets

Related U.S. Application Data division of application No. 13/968,485, filed on Aug. 16, 2013, now abandoned, which is a division of application No. 12/581,998, filed on Oct. 20, 2009, now Pat. No. 8,511,648.

(60) Provisional application No. 61/109,764, filed on Oct. 30, 2008, provisional application No. 61/106,665, filed on Oct. 20, 2008.

(52) U.S. Cl.
CPC ..... *E04H 17/143* (2013.01); *E04H 17/1447* (2021.01); *E04H 17/16* (2013.01); *E04H 17/168* (2013.01)

(58) Field of Classification Search
USPC ..... 256/21, 22, 25–28, 30, 31, 66, 256/65.02–65.16, 67, 73
See application file for complete search history.

(56) References Cited

U.S. PATENT DOCUMENTS 2,218,953 A 10/1940 Gustafson
2,218,954 A 10/1940 Gustafson
2,608,386 A 8/1952 Hart
2,723,107 A 11/1955 Parker
3,083,951 A 4/1963 Huret
3,136,530 A 6/1964 Case
3,164,354 A 1/1965 Murdock
3,289,381 A 12/1966 Blum et al.
3,343,811 A 9/1967 Kusel et al.
3,385,567 A 5/1968 Case et al.
3,388,884 A 6/1968 Eggler et al.
3,398,981 A 8/1968 Vincens
3,403,641 A 10/1968 Baker
3,485,006 A 12/1969 De Rozario
3,490,797 A 1/1970 Platte
3,491,984 A 1/1970 Nyberg
3,498,589 A 3/1970 Murdock
3,506,243 A 4/1970 Seiler
3,555,762 A 1/1971 Costanzo, Jr.
3,606,718 A 9/1971 Curran
3,610,427 A 10/1971 Maziarka et al.
3,617,077 A 11/1971 Cavanaugh, Sr.
3,618,993 A 11/1971 Platte
3,752,553 A 8/1973 Bildahl et al.
3,756,567 A 9/1973 Murdock
3,759,007 A 9/1973 Thiele
3,822,053 A 7/1974 Daily
3,918,686 A 11/1975 Knott et al.
3,931,946 A 1/1976 Soltysik
3,955,799 A 5/1976 Lauzier
3,973,756 A 8/1976 Lauzier
4,007,919 A 2/1977 Totten
4,014,520 A 3/1977 Walters
4,027,855 A 6/1977 Lauzier
4,035,978 A 7/1977 Bajorek et al.
4,050,828 A 9/1977 Noro
4,148,454 A 4/1979 Carlson et al.
4,188,019 A 2/1980 Meredith
4,189,796 A 2/1980 Gutner
4,266,757 A 5/1981 Kirkwood
4,340,199 A 7/1982 Brock
4,389,133 A 6/1983 Oberst
4,390,164 A 6/1983 Cokelekoglu
4,390,165 A 6/1983 Murdock
4,477,058 A 10/1984 Lowery
4,480,854 A 11/1984 Doty
4,565,465 A 1/1986 Oberst
4,586,697 A 5/1986 Tornya
4,623,128 A 11/1986 Dutch et al.
4,674,593 A 6/1987 McCarty
4,725,044 A 2/1988 Cluff
4,797,020 A 1/1989 Winston
4,805,879 A 2/1989 Spera
4,809,955 A 3/1989 Veilleux
4,883,256 A 11/1989 Hebda
4,919,394 A 4/1990 Otte et al.
4,929,116 A 5/1990 Mahl
4,976,567 A 12/1990 Spier
4,995,591 A 2/1991 Humphrey et al.
5,011,325 A 4/1991 Antonioli
5,078,367 A 1/1992 Simpson et al.
5,150,885 A 9/1992 Leone
5,247,773 A 9/1993 Weir
5,284,359 A 2/1994 Baba
5,335,461 A 8/1994 Petersen et al.
5,454,548 A 10/1995 Moore
5,533,237 A 7/1996 Higgins
5,544,866 A 8/1996 Dye
5,628,495 A 5/1997 Gandara
5,660,378 A 8/1997 Schall
5,702,090 A 12/1997 Edgman
5,713,171 A 2/1998 Andres
5,725,201 A 3/1998 Parth
5,836,714 A 11/1998 Christensen
5,862,642 A 1/1999 Erwin
5,882,001 A 3/1999 Reinbold
5,938,184 A 8/1999 DeSouza
5,988,599 A 11/1999 Forbis
6,029,954 A 2/2000 Murdaca
6,042,296 A 3/2000 Wittig et al.
6,053,480 A 4/2000 De Guise
D427,322 S 6/2000 DeSouza
6,135,425 A 10/2000 Platt
6,173,944 B1 1/2001 McCarthy
6,202,987 B1 3/2001 Forbis
6,290,214 B1 9/2001 DeSouza
6,293,523 B1 9/2001 Fendler
6,305,670 B1 10/2001 Ward et al.
6,311,955 B1 11/2001 McGarry et al.
D455,839 S 4/2002 Pettit et al.
6,375,166 B1 4/2002 Schall et al.
6,398,193 B1 6/2002 DeSouza
6,446,398 B2 9/2002 Weir
6,460,829 B1 10/2002 Forbis et al.
6,467,756 B1 10/2002 Elsasser
6,478,287 B2 11/2002 DeSouza
6,508,457 B1 1/2003 Knudson et al.
6,523,807 B2 2/2003 Calverley
6,524,518 B1 2/2003 Pelfrey
6,595,497 B1 7/2003 Linford et al.
D479,612 S 9/2003 Larsen et al.
6,631,887 B1 10/2003 Walmsley
6,637,728 B2 10/2003 Pettit et al.
6,698,726 B2 3/2004 Platt
6,702,259 B2 3/2004 Pratt
6,719,277 B2 4/2004 Ohanesian
6,752,385 B2 6/2004 Zen et al.
6,752,386 B1 6/2004 Bundy
6,752,438 B2 6/2004 DeSouza
6,755,394 B2 6/2004 Forbis et al.
6,779,781 B2 8/2004 Bebendorf
6,823,638 B2 11/2004 Stanchfield
6,874,766 B2 4/2005 Curatolo
6,883,786 B2 4/2005 Bebendorf
6,932,328 B2 8/2005 Shreiner et al.
7,007,363 B2 3/2006 Forbis
D518,898 S 4/2006 Nitz et al.
7,021,607 B1 4/2006 Alexander
7,025,335 B2 4/2006 Zhu
7,032,891 B2 4/2006 Rowley et al.
7,048,259 B2 5/2006 Quaintance et al.
7,086,642 B1 8/2006 O'Brien
7,152,849 B2 12/2006 Graber
7,165,374 B2 1/2007 Ohanesian
7,168,689 B2 1/2007 Giralt
7,347,412 B1 3/2008 Zhu
7,360,754 B2 4/2008 Robbins
7,389,975 B2 6/2008 Rowley et al.
D579,574 S 10/2008 Cook et al.
7,434,789 B2 10/2008 Crumrine
7,438,284 B2 10/2008 McGinness et al.

(56) References Cited

U.S. PATENT DOCUMENTS

| | | | |
|---|---|---|---|
| 7,445,196 | B2 | 11/2008 | Cantley et al. |
| D583,484 | S | 12/2008 | Ferris |
| 7,478,797 | B2 | 1/2009 | Laws et al. |
| 7,500,654 | B2 | 3/2009 | Rosaen |
| 7,530,550 | B2 | 5/2009 | Fattori |
| 7,543,802 | B2 | 6/2009 | Petta et al. |
| 7,546,900 | B2 | 6/2009 | Humphries et al. |
| 7,635,114 | B2 | 12/2009 | Laws et al. |
| 7,641,180 | B2 | 1/2010 | Adderton |
| 7,641,963 | B2 | 1/2010 | Grafenauer |
| 7,654,401 | B2 | 2/2010 | Obergoenner |
| 7,744,065 | B2 | 6/2010 | Terrels et al. |
| 7,789,376 | B2 | 9/2010 | Diamond et al. |
| 7,802,351 | B2 | 9/2010 | McGinness et al. |
| 7,857,291 | B2 | 12/2010 | Dombroski |
| 8,046,965 | B2 | 11/2011 | Rieber et al. |
| 8,210,503 | B2 | 7/2012 | Garrison |
| D670,405 | S | 11/2012 | McKenzie |
| 8,403,303 | B2 | 3/2013 | Payne et al. |
| 8,511,648 | B2 | 8/2013 | McCarthy et al. |
| 8,584,425 | B2 | 11/2013 | Wagner et al. |
| 8,616,331 | B2 | 12/2013 | Humphries et al. |
| 8,899,555 | B2 | 12/2014 | Sherstad |
| D724,759 | S | 3/2015 | Tucker |
| 9,027,909 | B1 | 5/2015 | Peyton et al. |
| D739,557 | S | 9/2015 | Buente |
| 9,435,134 | B2 | 9/2016 | Walmsley |
| 9,695,612 | B2 | 7/2017 | Batts, III |
| 10,190,331 | B2 | 1/2019 | Delafield et al. |
| D858,798 | S | 9/2019 | McCarthy et al. |
| 10,400,402 | B1 | 9/2019 | Sanders et al. |
| 10,422,156 | B1 | 9/2019 | Morrow |
| D873,439 | S | 1/2020 | McCarthy et al. |
| D890,953 | S | 7/2020 | McCarthy et al. |
| 11,499,337 | B2 | 11/2022 | Ohrstrom |
| 2002/0000544 | A1 | 1/2002 | Pettit et al. |
| 2002/0000545 | A1 | 1/2002 | Pettit et al. |
| 2002/0023406 | A1 | 2/2002 | Pettit et al. |
| 2002/0056251 | A1 | 5/2002 | Venegas, Jr. |
| 2002/0109132 | A1 | 8/2002 | Tsao |
| 2003/0041545 | A1 | 3/2003 | Stanchfield |
| 2003/0196395 | A1 | 10/2003 | Forbis et al. |
| 2004/0009338 | A1 | 1/2004 | Jo et al. |
| 2004/0018666 | A1 | 1/2004 | Lee et al. |
| 2004/0026679 | A1 | 2/2004 | Terrels et al. |
| 2004/0051092 | A1 | 3/2004 | Curatolo |
| 2004/0051093 | A1 | 3/2004 | Manning |
| 2004/0188663 | A1 | 9/2004 | Stein |
| 2004/0188666 | A1 | 9/2004 | Pratt |
| 2005/0075423 | A1 | 4/2005 | Riebel et al. |
| 2005/0199866 | A1 | 9/2005 | Clifford Green |
| 2005/0242336 | A1 | 11/2005 | Giacchino |
| 2006/0001015 | A1 | 1/2006 | Forbis et al. |
| 2006/0113517 | A1 | 6/2006 | Colantonio et al. |
| 2006/0202186 | A1 | 9/2006 | Rowley et al. |
| 2006/0273295 | A1 | 12/2006 | Maly et al. |
| 2006/0273502 | A1 | 12/2006 | Sade et al. |
| 2007/0062146 | A1 | 3/2007 | Van Dijk et al. |
| 2007/0158630 | A1 | 7/2007 | Lo |
| 2007/0170410 | A1 | 7/2007 | Devine |
| 2007/0181865 | A1 | 8/2007 | Hein |
| 2007/0181866 | A1 | 8/2007 | Strong |
| 2008/0023684 | A1 | 1/2008 | Diamond et al. |
| 2008/0217598 | A1 | 9/2008 | Dombroski |
| 2008/0265232 | A1 | 10/2008 | Terrels et al. |
| 2008/0299351 | A1 | 12/2008 | Buchholtz et al. |
| 2009/0065755 | A1 | 3/2009 | Sherstad |
| 2009/0065756 | A1 | 3/2009 | McGinness et al. |
| 2009/0152523 | A1 | 6/2009 | Erwin |
| 2009/0226246 | A1 | 9/2009 | Piper et al. |
| 2010/0096608 | A1 | 4/2010 | McCarthy et al. |
| 2010/0126797 | A1 | 5/2010 | Humphries et al. |
| 2010/0155683 | A1 | 6/2010 | Payne et al. |
| 2010/0200825 | A1 | 8/2010 | Hill |
| 2010/0237308 | A1 | 9/2010 | Lo |
| 2011/0001104 | A1 | 1/2011 | Rowley et al. |
| 2011/0024060 | A1 | 2/2011 | Brownbill |
| 2011/0073824 | A1 | 3/2011 | Lappin et al. |
| 2011/0155982 | A1 | 6/2011 | Duffy et al. |
| 2011/0209436 | A1 | 9/2011 | Fabbri |
| 2011/0233496 | A1 | 9/2011 | Caruso |
| 2012/0090140 | A1 | 4/2012 | Montemayor et al. |
| 2013/0264532 | A1 | 10/2013 | Goodman |
| 2013/0328001 | A1 | 12/2013 | McCarthy et al. |
| 2016/0194897 | A1 | 7/2016 | McCarthy et al. |
| 2017/0058557 | A1 | 3/2017 | Wu |
| 2018/0320404 | A1 | 11/2018 | Hellenbrand |
| 2019/0145123 | A1 | 5/2019 | Lo |
| 2019/0145124 | A1 | 5/2019 | Ohrstrom et al. |
| 2019/0211579 | A1 | 7/2019 | Burt et al. |
| 2019/0284833 | A1 | 9/2019 | Yeh et al. |

FOREIGN PATENT DOCUMENTS

| | | | |
|---|---|---|---|
| CA | 2279215 | A1 | 2/2001 |
| CA | 2298963 | A1 | 8/2001 |
| CA | 2157155 | C | 11/2001 |
| CA | 2349963 | A1 | 12/2001 |
| CA | 2362250 | A1 | 5/2002 |
| CA | 2340600 | A1 | 9/2002 |
| CA | 2363976 | A1 | 5/2003 |
| CA | 2624235 | A1 | 9/2009 |
| CA | 2653263 | A1 | 9/2009 |
| CA | 2683274 | A1 | 4/2010 |
| CA | 3088392 | A1 | 1/2021 |
| DE | 1684649 | A1 | 12/1969 |
| DE | 7707911 | U1 | 7/1977 |
| EP | 0392923 | A1 | 10/1990 |
| EP | 0754600 | A1 | 1/1997 |
| EP | 2520743 | A1 | 11/2012 |
| FR | 802548-001 | | 2/1981 |
| FR | 2814529 | A1 | 3/2002 |
| GB | 2323611 | A | 9/1998 |
| GB | 2425317 | A | 10/2006 |
| IL | 17085 | | 11/1992 |
| JP | H09195476 | A | 7/1997 |
| KR | 300508727.0000 | | 10/2008 |
| WO | 2007119039 | A1 | 10/2007 |
| WO | 2008078116 | A1 | 7/2008 |

OTHER PUBLICATIONS

United States Patent and Trademark Office, Office Action Summary and Detailed Action, U.S. Appl. No. 16/190,554, filed Dec. 1, 2021, 15 pages.

Applicant, Amendment After Final (Response to Final Office Action Dated Dec. 1, 2021), U.S. Appl. No. 16/190,554, filed Feb. 1, 2022, 14 pages.

United States Patent and Trademark Office, Advisory Action, U.S. Appl. No. 16/190,554, filed Feb. 23, 2022, 3 pages.

Applicant, Request for Continued Examination—Enter Amendment As Filed on Feb. 1, 2022, U.S. Appl. No. 16/190,554, filed Mar. 1, 2022, 2 pages.

United States Patent and Trademark Office, Office Action Summary and Detailed Action, U.S. Appl. No. 16/190,554, filed Mar. 23, 2022, 14 pages.

Applicant, Amendment (Response to Non Final Office Action Dated Mar. 23, 2022), U.S. Appl. No. 16/190,554, filed Jun. 23, 2022, 11 pages.

United States Patent and Trademark Office, Notice of Allowance And Fee(s) Due, U.S. Appl. No. 16/190,554, filed Jul. 11, 2022, 7 pages.

Applicant, Interview Summaries, U.S. Appl. No. 14/990,552, filed Jul. 24, 2020.

United States Patent and Trademark Office, Notice of Allowance, Detailed Action, Examiner-Initiated Interview Summary, U.S. Appl. No. 14/990,552, filed Jul. 31, 2020.

Danbury and Danbury Concave Vinyl Fence—By Bufftech, http://www.discountfence.com/vinyl_fence/danbury.html, Aug. 20, 2009, 5 pages.

(56) References Cited

OTHER PUBLICATIONS

Fences Columbus Ohio, https://fencescolumbusohio.com/fences-powell-ohio/#prettyPhoto/5/, Jan. 2014, 1 page.
Manchester Concave Style of Vinyl Fence—Hoover Fence, http://vinyl.hooverfence.com/classic/manchester-concave. htm, 2002, 1 page.
PicketLock, https://www.homedepot.com/p/Glendale-4-ft-H-x-8-ft-W-White-Vinyl-Spaced-Picket-Unassembled-Fence-Panel-with-Dog-Ear-Pickets-152811/203464358, Oct. 17, 2012, 1 page.
Rothbury Style of Vinyl Fence—Hoover Fence, http://vinyl.hooverfence.com/traditional/rothbury.htm, 2000, 1 page.
United States Patent and Trademark Office, Office Action Summary and Detailed Action, U.S. Appl. No. 16/190,554, filed Jul. 1, 2021, 15 pages.
Canadian Intellectual Property Office, Examiner's Requisition and Examination Search Report, Application No. 2,669,440, Jul. 3, 2015.
Applicant, Response to Jul. 3, 2015 Examiner's Requisition, Canadian Patent Application No. 2,669,440, Dec. 23, 2015.
Canadian Intellectual Property Office, Examiner's Requisition and Examination Search Report, Application No. 2,669,440, Jun. 27, 2016.
Applicant, Response to Jun. 27, 2016 Examiner's Requisition, Canadian Patent Application No. 2,669,440, Dec. 21, 2016.
Applicant, Request For Reinstatement, Final Fee Payment & Voluntary Amendment, Canadian Patent Application No. 2,669,440, Sep. 28, 2018.
Canadian Intellectual Property Office, Examiner's Requisition and Examination Search Report, Application No. 2,683,274, Dec. 2, 2015.
Applicant, Response to Dec. 2, 2015 Examiner's Requisition, Canadian Application No. 2,683,274, Jun. 1, 2016.
Canadian Intellectual Property Office, Examiner's Requisition and Examination Search Report, Application No. 2,683,274, Jun. 27, 2016.
Applicant, Response to Jun. 27, 2016 Examiner's Requisition, Canadian Application No. 2,683,274, Dec. 22, 2016.
Applicant, Request for Reinstatement, Final Fee Payment & Voluntary Amendment, Canadian Application No. 2,683,274, Sep. 28, 2018.
Canadian Intellectual Property Office, Examiner's Requisition and Examination Search Report, Application No. 2,683,274, Nov. 9, 2018.
United States Patent and Trademark Office, Office Action Summary and Detailed Action, U.S. Appl. No. 12/581,998, filed Aug. 17, 2011.
Applicant, Amendment/Response to Aug. 17, 2011 Office Action, U.S. Appl. No. 12/581,998, filed Nov. 15, 2011.
United States Patent and Trademark Office, Office Action Summary and Detailed Action, U.S. Appl. No. 12/581,998, filed Jan. 20, 2012.
Applicant, Amendment/Response After Final Office Action dated Jan. 20, 2012, U.S. Appl. No. 12/581,998, filed Mar. 20, 2012.
United States Patent and Trademark Office, Office Action Summary and Detailed Action, U.S. Appl. No. 12/581,998, filed Jun. 4, 2012.
Applicant, Response to Non-Final Office Action dated Jun. 4, 2012, U.S. Appl. No. 12/581,998, filed Nov. 5, 2012.
United States Patent and Trademark Office, Office Action Summary and Detailed Action, U.S. Appl. No. 12/581,998, filed Dec. 26, 2012.
Applicant, Response to Final Office Action dated Dec. 26, 2012, U.S. Appl. No. 12/581,998, filed Mar. 26, 2013.
United States Patent and Trademark Office, Office Action Summary and Detailed Action, U.S. Appl. No. 13/968,485, filed Oct. 11, 2013.
Applicant, Response to Non-Final Office Action dated Oct. 11, 2013, U.S. Appl. No. 13/968,485, filed Apr. 3, 2014.
United States Patent and Trademark Office, Office Action Summary and Detailed Action, U.S. Appl. No. 13/968,485, filed Jun. 30, 2014.
Applicant, Second Amendment Accompanying a Request for Continued Examination (Response to Office Action dated Jun. 30, 2014), U.S. Appl. No. 13/968,485, filed Dec. 30, 2014.
United States Patent and Trademark Office, Office Action Summary and Detailed Action, U.S. Appl. No. 13/968,485, filed Jan. 16, 2015.
Applicant, Third Amendment Accompanying a Request for Continued Examination (Response to Final Office Action dated Jan. 16, 2015), U.S. Appl. No. 13/968,485, filed Jul. 16, 2015.
United States Patent and Trademark Office, Office Action Summary and Detailed Action, U.S. Appl. No. 13/968,485, filed Sep. 15, 2015.
United States Patent and Trademark Office, Office Action Summary and Detailed Action, U.S. Appl. No. 14/990,552, filed Aug. 9, 2016.
Applicant, First Amendment (Response to Aug. 9, 2016 Office Action), U.S. Appl. No. 14/990,552, filed Nov. 9, 2016.
United States Patent and Trademark Office, Office Action Summary and Detailed Action, U.S. Appl. No. 14/990,552, filed Dec. 5, 2016.
Applicant, Second Amendment (Response to Dec. 5, 2016 Office Action), U.S. Appl. No. 14/990,552, filed Apr. 5, 2017.
United States Patent and Trademark Office, Office Action Summary and Detailed Action, U.S. Appl. No. 14/990,552, filed May 3, 2017.
Applicant, Third Amendment (Response to May 3, 2017 Office Action), U.S. Appl. No. 14/990,552, filed Nov. 3, 2017.
United States Patent and Trademark Office, Office Action Summary and Detailed Action, U.S. Appl. No. 14/990,552, filed Dec. 27, 2017.
Applicant, Fourth Amendment (Response to Dec. 27, 2017 Office Action), U.S. Appl. No. 14/990,552, filed Apr. 25, 2018.
United States Patent and Trademark Office, Office Action Summary and Detailed Action, U.S. Appl. No. 14/990,552, filed May 24, 2018.
Applicant, Fifth Amendment (Response to May 24, 2018 Office Action), U.S. Appl. No. 14/990,552, filed Aug. 22, 2018.
United States Patent and Trademark Office, Office Action Summary and Detailed Correspondence, U.S. Appl. No. 14/990,552, filed Oct. 5, 2018.
Applicant, Sixth Amendment (Response to Oct. 5, 2018 Office Action), U.S. Appl. No. 14/990,552, filed Jan. 4, 2019.
United States Patent and Trademark Office, Applicant-Initiated Interview Summary, U.S. Appl. No. 14/990,552, filed Feb. 5, 2019.
United States Patent and Trademark Office, Office Action Summary and Detailed Correspondence, U.S. Appl. No. 14/990,552, filed Feb. 11, 2019.
Applicant, Seventh Amendment with a Declaration of Rolf Ohrstrom Pursuant to 37 C.F.R. 1.132 (Response to Feb. 11, 2019 Office Action), U.S. Appl. No. 14/990,552, filed Jul. 10, 2019.
United States Patent and Trademark Office, Applicant-Initiated Interview Summary, U.S. Appl. No. 14/990,552, filed Aug. 14, 2019.
United States Patent and Trademark Office, Office Action Summary and Detailed Correspondence, U.S. Appl. No. 14/990,552, filed Aug. 15, 2019.
Applicant, Eighth Amendment (Response to Aug. 15, 2019 Office Action), U.S. Appl. No. 14/990,552, filed Nov. 14, 2019.
United States Patent and Trademark Office, Office Action Summary and Detailed Correspondence, U.S. Appl. No. 14/990,552, filed Dec. 13, 2019.
Applicant, Ninth Amendment with a Declaration of Rolf Ohrstrom Pursuant to 37 C.F.R. 1.132 (Response to Dec. 13, 2019 Office Action), U.S. Appl. No. 14/990,552, filed Mar. 13, 2020.
United States Patent and Trademark Office, Office Action Summary and Detailed Action, U.S. Appl. No. 14/990,552, filed Mar. 27, 2020.
United States Patent and Trademark Office, Applicant-Initiated Interview Summary, U.S. Appl. No. 14/990,552, filed Apr. 28, 2020.
Applicant, Tenth Amendment (Response to Mar. 27, 2020 Office Action), U.S. Appl. No. 14/990,552, filed May 27, 2020.
United States Patent and Trademark Office, Advisory Action Before the Filing of an Appeal Brief, U.S. Appl. No. 14/990,552, filed Jun. 10, 2020.

143
110
110
170
144
116
172
170
134
114
170
124
158
116
115
169
115

112
115
115
166
158
124
116

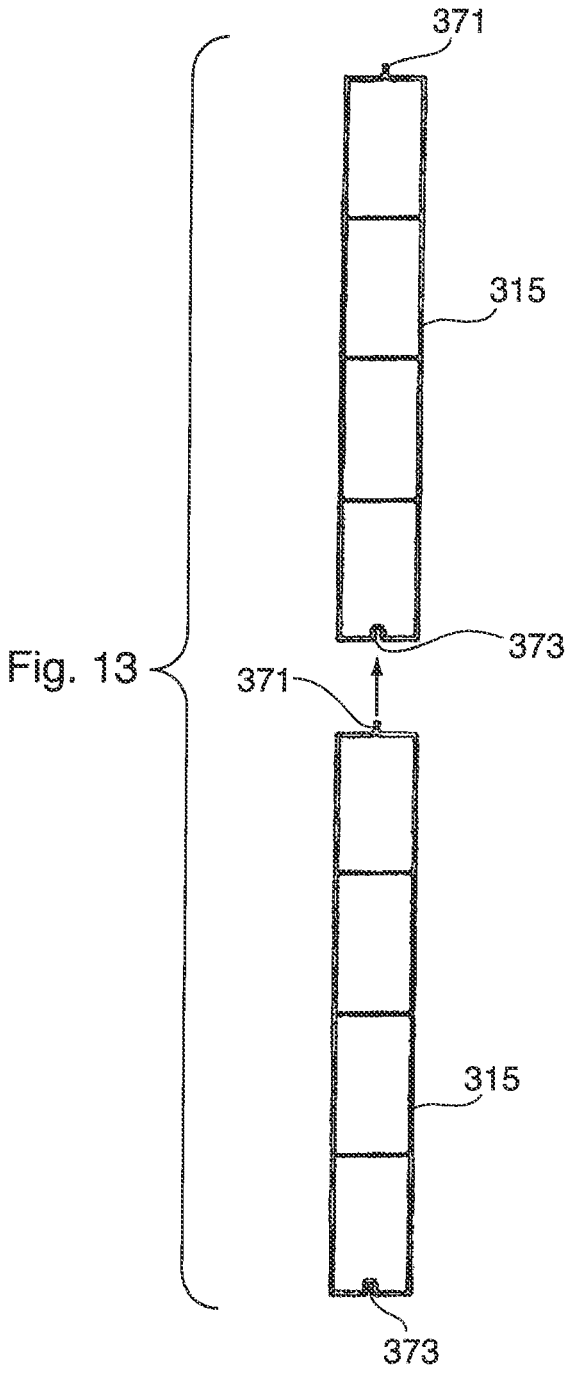
Fig. 13
Fig. 14
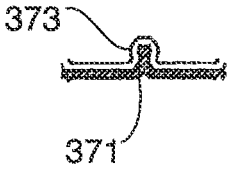

1250
1260
1231
1232
1252
1230
1210
1232
1221
1220
1258
1254
1262
1264
1232
1212
1230
1232
1259b
1259a
1220
1221
1219

1250
1218
7
1260
1210
1220
1222
1218
1212
1219
1222
1220
1219
7

Fig. 30B
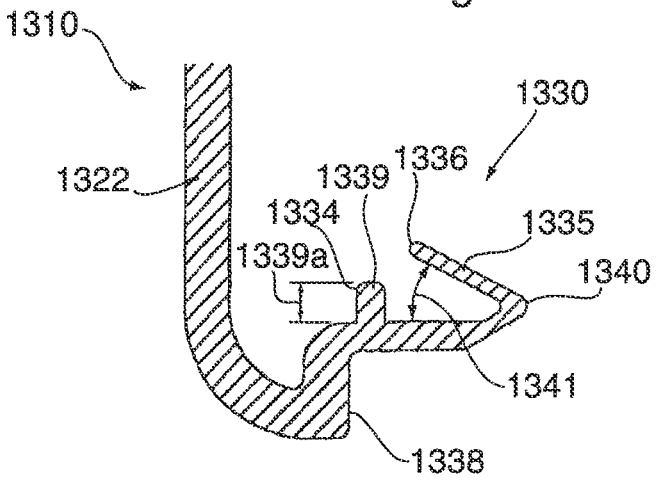
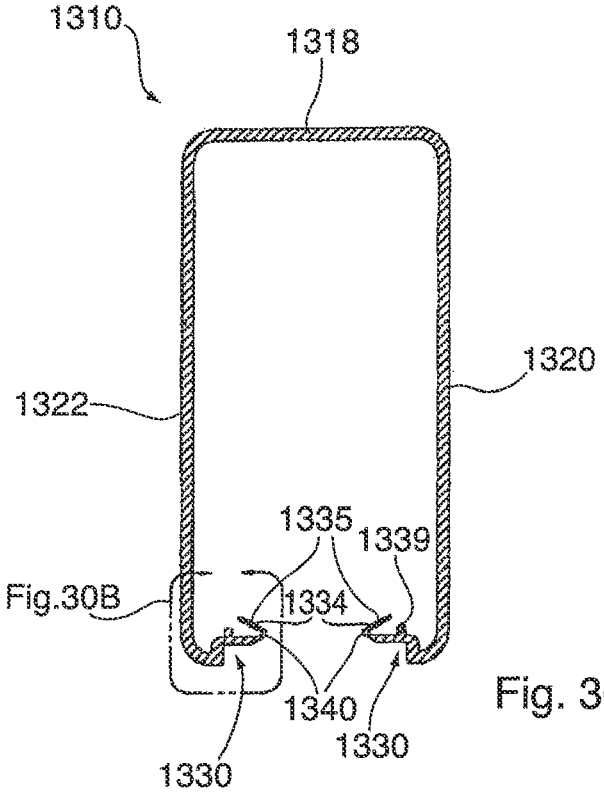
Fig. 30A

FENCE SYSTEM

RELATED APPLICATIONS

This application is a continuation of U.S. patent application Ser. No. 14/990,552 filed on Jan. 7, 2016, which is a divisional of U.S. patent application Ser. No. 13/968,485 filed on Aug. 16, 2013, which is a divisional of U.S. patent application Ser. No. 12/581,998 filed on Oct. 20, 2009, which claims priority from U.S. Provisional App. Ser. No. 61/106,665 filed on Oct. 20, 2008, U.S. Provisional App. Ser. No. 61/109,764 filed on Oct. 30, 2008, and Canadian Patent App. Ser. No. 2,669,440 filed on Jun. 18, 2009, each of which is hereby incorporated by reference as if fully set forth herein.

FIELD

The Applicant's teaching disclosed herein relates to fence systems, for example privacy fences and picket fences, and to one or more methods and apparatuses associated with elements of fence systems and the connection structure and assembly thereof.

BACKGROUND

The following paragraphs are not an admission that anything discussed therein is citable as prior art or part of the general knowledge of people skilled in the art.

U.S. Pat. No. 5,702,090 (Edgman) discloses a plastic fence assembly, particularly adapted for use as residential privacy fencing and the like, comprising plural post members which are formed of hollow extruded plastic and have opposed side walls and end walls intersected by one or more elongated channels. Elongated spacer elements may be inserted in the channels and retained therein by interlocking projections on the spacer elements and recesses formed in the sidewalls of the post channels. The spacer elements support side edges of vertically extending picket members, brackets for horizontally extending center rail members and to position at least one or both of elongated top and bottom rail members of the fence assembly. The top and bottom rail members have elongated slots formed therein for receiving opposite ends of generally planar boardlike picket members. The top and bottom rail members and the spacer members may be cut to length as may the post and picket members to provide fencing of a desirable height and distance between posts.

U.S. Pat. No. 5,988,599 (Forbis) discloses a modular fence system. The system includes fence planks designed for insertion into open channels of upper and lower fence rails. The fence rails are supported in a horizontal orientation between intermittent fence posts, with the fence planks extending vertically between the rails. The planks include resilient protrusions at their upper ends. The protrusions of the planks are designed to fit into internal passages formed in the open channels of the upper fence rail, into engagement with ledges defining the passages, to inhibit inadvertent removal of the planks from the upper rail.

U.S. Pat. No. 6,478,287 (DeSouza) discloses a fence panel constructed from extruded hollow polyvinyl plastic boards. The boards are arranged with vertical end boards and filler boards between the end boards. Three horizontal rails each have a board on each side of the vertical boards with a horizontal filler board between the top rail boards to seal off the upper ends of the vertical boards. All of the boards are secured together with a plastic adhesive without the use of any mechanical fasteners.

U.S. patent application publication 2008/0217598 (Dombroski) discloses a fence assembly that is made up of a plurality of fence sections. Each section is made up of panels with top, bottom and side edges and front and rear surfaces. Slots are spaced from and milled into the panels along one of the sets of edges. A pair of trim extends over and covers the set edges and each trim has projections that snap or slide into the front and rear slots. Alternatively the edges of the panel may be beaded and slid over the slotted side of the trim. The fence sections are coupled pivotably to fence posts such that the panels may pivot, under force of wind, about either their top or bottom end. The panels are restored to generally vertical position by the force of gravity. A counterweight within the fence post linked to the panels can be used to restore panels to their vertical position. In an alternate embodiment, the brackets coupling the panels to the fence posts may slide along the fence posts and the panels bow in response to high winds. The fence panels may include resilient strips along their vertical edges.

U.S. patent application 2008/0023684 (Diamond et al.) discloses a non-metallic fence system that has a singular snap lock mechanism for permitting the easy construction of the fence. It also includes a securing device for fixing a fabric to a fence having a rigid body including at least two prongs therefrom and an open face strut profile capable of receiving the prong therein, wherein the prongs are locked within the open face and the fixture can be removed by twisting 90 degrees.

SUMMARY

The following summary is intended to introduce the reader to the disclosure provided herein but not to define any invention. In general, this disclosure describes one or more methods or apparatuses related to injection drive units in injection molding machines.

According to one aspect, a fence system includes a first extruded lineal extending lengthwise along a first longitudinal axis. The first lineal has a sidewall with at least a first slot in the sidewall and the first slot extends generally perpendicular to the longitudinal axis. The fence system also includes a second extruded lineal extending lengthwise along a second longitudinal axis. The second extruded lineal includes at least a corresponding first attachment leg extending outward from the second extruded lineal and parallel to the second longitudinal axis. The first attachment leg is integrally extruded with the second extruded lineal and is received in the first slot to secure together the first and second extruded lineals.

According to some aspects, a fence section comprises: a) a generally horizontal first rail having an upper face with a first panel recess extending lengthwise along the first rail and extending laterally between opposed first recess sidewalls, the first rail including a first tongue extending laterally from one towards the other of the first recess sidewalls and lengthwise along the first rail; b) a generally horizontal second rail spaced vertically above the first rail and having a lower face with a second panel recess extending lengthwise along the second rail and extending laterally between opposed second slot sidewalls, the second rail including a second tongue extending laterally from one towards the other of the second recess sidewalls and lengthwise along the second rail; and c) a plurality of vertical members extending generally vertically between the first rail and the second rail, each vertical member having a panel height extending between upper and lower ends of the panel and a panel thickness extending laterally between opposed front and back panel faces, the lower end of each vertical member being received in the first panel recess and the upper end of each vertical member being received in the second panel recess. Each vertical member has a constant cross-sectional panel profile along the panel height, and each vertical member includes a lower slot and an upper slot extending horizontally across a width of the vertical member and lengthwise of the rail, the lower slot receiving the first tongue therein and the upper slot receiving the second tongue therein.

In some examples, the vertical members can be in the form of fence panels, pickets, boards, or slats. The vertical members and/or the rails can, in some examples, be formed of plastic and can be injection molded.

In some examples, each vertical member comprises an extruded lineal, made of, for example, but not limited to, a plastic material. The upper and lower slots can comprise cuts (for example, saw cuts) or a similar material-removal feature in the lineals. The slots can be parallel to, and spaced equally apart from, the upper and lower edges of panels.

In some examples, the rails can comprise extruded lineals. The rails can have a constant cross-sectional profile along their length. The rails can be made of a plastic material. Each of the rails, including, for example, the first and second rails and an optional third rail can have a common rail profile. In other words, a length of extruded lineal having the common rail profile can be used as any one of the first, second, or third rails.

According to some aspects, a fence section, comprises: a) a generally horizontal lower rail having an upper face with a lower panel recess extending lengthwise along the first rail and extending laterally between opposed first and second lower recess sidewalls, the lower rail including a lower rail first tongue extending laterally from the first lower recess sidewall towards the second lower recess sidewall and lengthwise along the lower rail, and a lower rail second tongue extending laterally from the second lower recess sidewall towards the first lower recess sidewall and lengthwise along the lower rail; b) a generally horizontal upper rail spaced vertically above the lower rail and having a lower face with an upper panel recess extending lengthwise along the upper rail and extending laterally between opposed first and second upper recess sidewalls, the upper rail including an upper rail first tongue extending laterally from the first upper recess sidewall towards the second upper recess sidewall and lengthwise along the upper rail, and a upper rail second tongue extending laterally from the second upper slot sidewall towards the first upper slot sidewall and lengthwise along the upper rail; and c) a plurality of fence panels extending generally vertically between the lower rail and the upper rail, each fence panel having a panel height extending between upper and lower ends of the panel and a panel thickness extending laterally between opposed front and back panel faces, the lower end of each fence panel being received in the lower panel recess and the upper end of each fence panel being received in the upper panel recess. Each fence panel has a constant cross-sectional panel profile along the panel height, and each fence panel includes a first and a second lower groove and a first and a second upper groove extending horizontally across a width of the fence panel and lengthwise of the rail, the first lower groove receiving the lower rail first tongue therein, the second lower groove receiving the lower rail second tongue therein, the first upper groove receiving the upper rail first tongue therein, the second upper groove receiving the upper rail second tongue therein.

In some examples, the front and/or back faces of fence panel can comprise one or more vertical channels extending along the height of the panel. The channel(s) can give the illusion that each panel comprises a plurality of slats. Each channel can comprise a channel face, and opposed lateral faces. The channel can have the same depth as each of the grooves, and each tongue can abut the channel face(s).

In some examples, each fence panel is provided with cooperating male and female engagement elements, such that each fence panel may be connected to one or more other fence panels. The male and female engagement elements can be configured such that when a male engagement element is inserted into a female engagement element, the joint provides the appearance of a channel. For example, each female engagement element can comprise opposed walls, between which the male engagement element is inserted. The opposed walls can be provided at a distance from the front and back faces of the panel, respectively, that is equal to the depth of the channel(s), and the width of each opposed walls can be equal to the width of the channel face.

In some examples, the first and second lower tongues and the first and second upper tongues are joined to the first and second upper and lower slot sidewalls, respectively, at a vertical position generally at the outer ends of the first and second upper and lower sidewalls. In other examples, the first and second lower tongues and the first and second upper tongues are joined to the first and second upper and lower slot sidewalls, respectively, at a vertical position spaced from the outer ends of the first and second upper and lower sidewalls.

According to some aspects, a connection structure for a fence comprises a first extruded lineal extending lengthwise along a first longitudinal axis and having a sidewall with at least a first slot in the sidewall. The first slot extends generally perpendicular to the longitudinal axis. The connection structure also comprises a second extruded lineal extending lengthwise along a second longitudinal axis, the second extruded lineal including at least a corresponding first attachment leg extending outward from the second extruded lineal and parallel to the second longitudinal axis. The first attachment leg can be integrally extruded with the second extruded lineal and is received in the first slot to secure together the first and second extruded lineals.

In some examples, the first extruded lineal comprises a second slot parallel to, and spaced apart from, the first slot, and the second extruded lineal comprises a corresponding second attachment leg parallel to the first attachment leg and received in the second slot.

In some examples, each slot comprises an opening through one sidewall. Each opening may have opposed slot edge faces and opposed slot end faces. Each slot edge face and each slot end face may extend laterally from an outer surface of the sidewall to an inner surface of the sidewall.

In some examples, the slot edge faces are parallel to each other.

In some examples, the slot edge faces are oblique relative to the first longitudinal axis.

In some examples, each attachment leg comprises a distal portion spaced apart from the second extruded lineal and a barb extending from the distal portion. Each barb may comprise an abutment surface that bears against the inner surface of the sidewall adjacent the respective slot into which the attachment leg is received for retaining the attachment leg within the slot when the attachment leg is fully inserted into the respective slot.

In some examples, the second extruded lineal comprises a base surface. Each attachment leg may extend from the base surface. The base surface may oppose the abutment service and be spaced apart from the abutment surface by a distance greater than a thickness of the first extruded lineal sidewall.

In some examples, the slot end faces are spaced apart by a first width and the attachment leg received within each slot has a second width. The second width may be generally equal to the first width so that translation of the first extruded lineal relative to the second extruded lineal along the second longitudinal axis is inhibited when the attachment leg is received within the slot.

In some examples, each barb comprises at least one resilient retaining member. The at least one resilient member may be moveable between insertion and retention positions. When the at least one resilient retaining member is in the insertion position the barb can pass between the slot edge faces, and when the at least one resilient retaining member is in the retention position the barb is inhibited from passing between the slot edge faces.

In some examples, the at least one resilient retaining member comprises the abutment face.

According to some aspects, a fence section comprises an upper horizontal rail and a lower horizontal rail extending along respective upper and lower rail axes. The lower rail is spaced vertically below the upper horizontal rail. Each of the rails can comprise a respective extruded lineal including integrally formed attachment legs. The fence section can further comprise a plurality of vertical members each extending between the upper and lower horizontal rails. Each of the vertical members comprises at least one upper slot and at least one lower slot. At least portions of the attachment legs of the upper and lower rails are received within respective ones of the slots to secure each vertical member to the upper and lower horizontal rails.

In some examples, each of the vertical members extends along a respective vertical axis. The upper and lower slots may be generally elongated in a lateral direction generally perpendicular to the vertical axis, and the slots may be generally narrow in the vertical direction. The upper and lower slots can each have a slot length extending generally perpendicular to the vertical axis, and a slot thickness extending in the vertical direction. The slot thickness can be less than the slot length. In some examples, the slot thickness can be only a fraction of the slot length, for example only about one-fifth, or about one-tenth, or about one-fifteenth, or less than about one-twentieth of the slot length.

In some examples, the upper and lower slots can form an opening through a sidewall of each vertical member. Each opening may comprise opposed slot edge faces and opposed slot end faces. Each slot edge face and each slot end face may extend laterally from an outer surface of the sidewall to an inner surface of the sidewall.

In some examples, the slot edge faces are parallel to each other.

In some examples, the slot edge faces are oblique relative to the outer surface of the sidewall.

In some examples, the slot end faces are parallel to each other and are spaced apart by a slot length and the slot edge faces are spaced apart by a slot height.

In some examples, each attachment leg comprises opposing attachment leg end faces spaced apart by an attachment leg length. The attachment leg length may be less than the slot length of the corresponding slot.

In some examples, each attachment leg includes a barb. Each barb may comprise an abutment surface that bears against the inner surface of the sidewall adjacent the respective corresponding slot, into which the attachment leg is received when the attachment leg is fully inserted into its slot.

In some examples, the upper and lower rails each comprise a base surface. Each attachment leg may extend from one base surface. Each base surface may oppose the abutment surfaces of the attachment legs extending therefrom, and may be spaced apart from the abutment surfaces by a distance greater than a thickness of the sidewall.

In some examples, each barb has a generally wedge-shaped cross-section comprising a leading edge spaced apart from its abutment surface so that the each barb facilitates insertion of the attachment leg into its slot and resists removal of the attachment leg from its slot.

In some examples, each attachment leg is resiliently moveable between a first position for inserting the attachment leg and barb through the respective slot and a second position for retaining the attachment leg within the respective slot. In the second position the abutment surface may engage the inner surface of the sidewall, and the attachment leg may be biased toward the second position.

In some examples, each barb comprises at least one resilient retaining member. The at least one resilient member may be moveable between insertion and retention positions. When the at least one resilient retaining member is in the insertion position, the barb has a barb height that is less than the slot height. When the at least one resilient retaining member is in the retention position, the barb has a barb height that is greater than the slot height.

In some examples, each resilient retaining member is biased toward the retention position.

In some examples, the resilient retaining member comprises the abutment surface. When the attachment leg is fully inserted in its slot and the resilient retaining member is in the retention position, the abutment surface may engage the inner surface of the sidewall.

In some examples, each attachment leg further comprises a protrusion. The protrusion may extend away from the attachment leg and may be intermediate the resilient retaining member and the base surface.

In some examples, each the protrusion has a protrusion height that can be less than the slot height.

In some examples, each protrusion is registered with one slot edge face when the attachment leg is fully received in its slot to inhibit vertical displacement between the vertical members and upper and lower rails.

In some examples, both horizontal rails have a common extruded profile comprising a downward opening, generally C-shaped channel. The channel may have a horizontal upper wall and first and second vertical, laterally spaced apart, integrally formed rail sidewalls. The profile may define an internal cavity between the rail sidewalls and adjacent the upper wall.

In some examples, the upper wall of each horizontal rail comprises a plurality of apertures spaced apart along the length of the rail. The apertures in the upper horizontal rail may be aligned with corresponding apertures in the lower horizontal rail and each vertical member may pass through respective aligned ones of the apertures in the upper and lower horizontal rails.

In some examples, each vertical member extends beyond the upper wall of the upper horizontal rail and extends beyond a bottom edge of the sidewalls of the lower horizontal rail.

In some examples, the attachment legs include laterally opposed first and second attachment legs extending inwardly towards each other from the first and second sidewalls respectively.

In some examples, each vertical member comprises a set of opposing upper slots and a set of opposing lower slots formed in opposing sidewalls of the vertical member for receiving the first and second opposed attachment legs of the upper and lower rails respectively.

In some examples, both horizontal rails have a common extruded profile comprising spaced apart top and bottom walls connected by integrally formed first and second rail sidewalls forming a generally rectangular channel.

In some examples, the attachment legs extend from an outer surface of the first rail sidewall of both horizontal rails.

In some examples the fence section comprises attachment legs extending from an outer surface of the second rail sidewall of both horizontal rails.

In some examples, the plurality of vertical members comprises first and second sets of vertical members. The attachment legs may extend from the first rail sidewall of the upper and lower horizontal rail and may be received within the corresponding upper and lower slots of the vertical members in the first set of vertical members, thereby securing each vertical member in the first set of vertical members adjacent the first sidewall of both horizontal side rails.

In some examples, the attachment legs extend from the second sidewall of the upper and lower horizontal rails and are received within the corresponding upper and lower slots of the vertical members in the second set of vertical members, thereby securing each vertical member in the second set of vertical members adjacent the second sidewall of both horizontal side rails.

In some examples, vertical members from the first and second sets are arranged in an alternating sequence along the length of the upper and lower horizontal side rails.

In some examples, the attachment leg length is generally equal to the slot length so that translation of each vertical member relative to the upper and lower horizontal rails along the upper and lower rail axes is inhibited when the attachment leg is received its slot.

In some examples, the attachment of the vertical members to the upper and lower horizontal rails comprises only the connection between the attachment legs and slots and is free from other fastening means.

In some examples, the connection between the attachment legs and slots comprises a snap-fit connection.

According to some aspects, a method of assembling a fence section comprises the steps of: a) providing a first horizontal rail having at least one integrally formed attachment leg extending therefrom, b) providing a second horizontal rail, the second horizontal rail being spaced apart from the first horizontal rail and having at least one integrally formed attachment leg extending therefrom, c) providing a plurality of vertical members, each vertical member having at least one upper slot formed in a sidewall for receiving one attachment leg from the first horizontal rail and at least one lower slot formed in the sidewall for receiving one attachment leg from the second horizontal rail, and d) connecting each vertical member to the first and second horizontal rails by inserting one attachment leg on the first horizontal rail into the at least one upper slot on each vertical member and inserting one attachment leg on the second horizontal rail into the at least one lower slot on each vertical member.

According to some aspects, a method of making a fence system includes extruding a vertical member profile along an extrusion axis, and cutting the profile to length along a cutting axis generally perpendicular to the extrusion axis to form vertical members for a fence. During or after the profile is cut to length, at least one upper and at least one lower attachment slot can be cut into the vertical member, parallel to the cutting axis and adjacent upper and lower ends of each vertical member. The method can include extruding upper and lower rail profiles, each including an attachment leg extending laterally outwardly of the rail profiles for engagement with the slots of the vertical members.

BRIEF DESCRIPTION OF THE DRAWINGS

The drawings included herewith are for illustrating various examples of articles, methods, and apparatuses of the present specification and are not intended to limit the scope of what is taught in any way. In the drawings:

FIG. 13 is a cross-sectional view of a portion of the fence section of FIG. 12 taken along the lines 13-13;

FIG. 14 is an enlarged view of a portion of the fence section of FIG. 13;

FIG. 30A is an end view of a rail having a barb with a resilient member;

FIG. 30B is a detail view of a portion of FIG. 30;

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
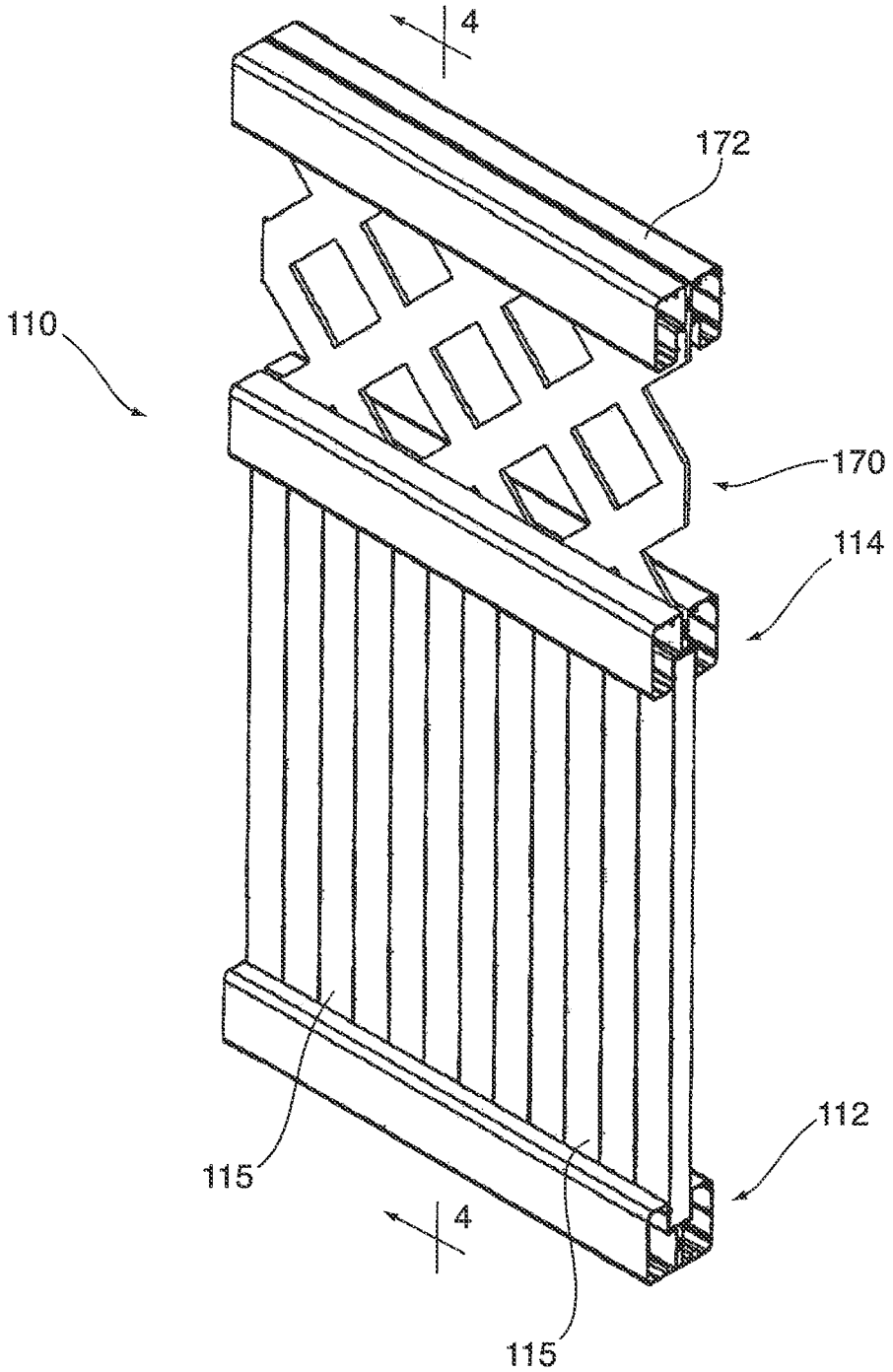
FIG. 1 is a perspective view of a first example of a fence section according to one aspect of the Applicant's teaching.

Referring to FIG. 1, an example of a fence section 110 includes generally horizontal first and second rails 112, 114, (also referred to as lower rail 112 and upper rail 114) and a plurality of fence panels (also called vertical members) 115 extending generally vertically between the first and second rails 112, 114.

Figure 2:
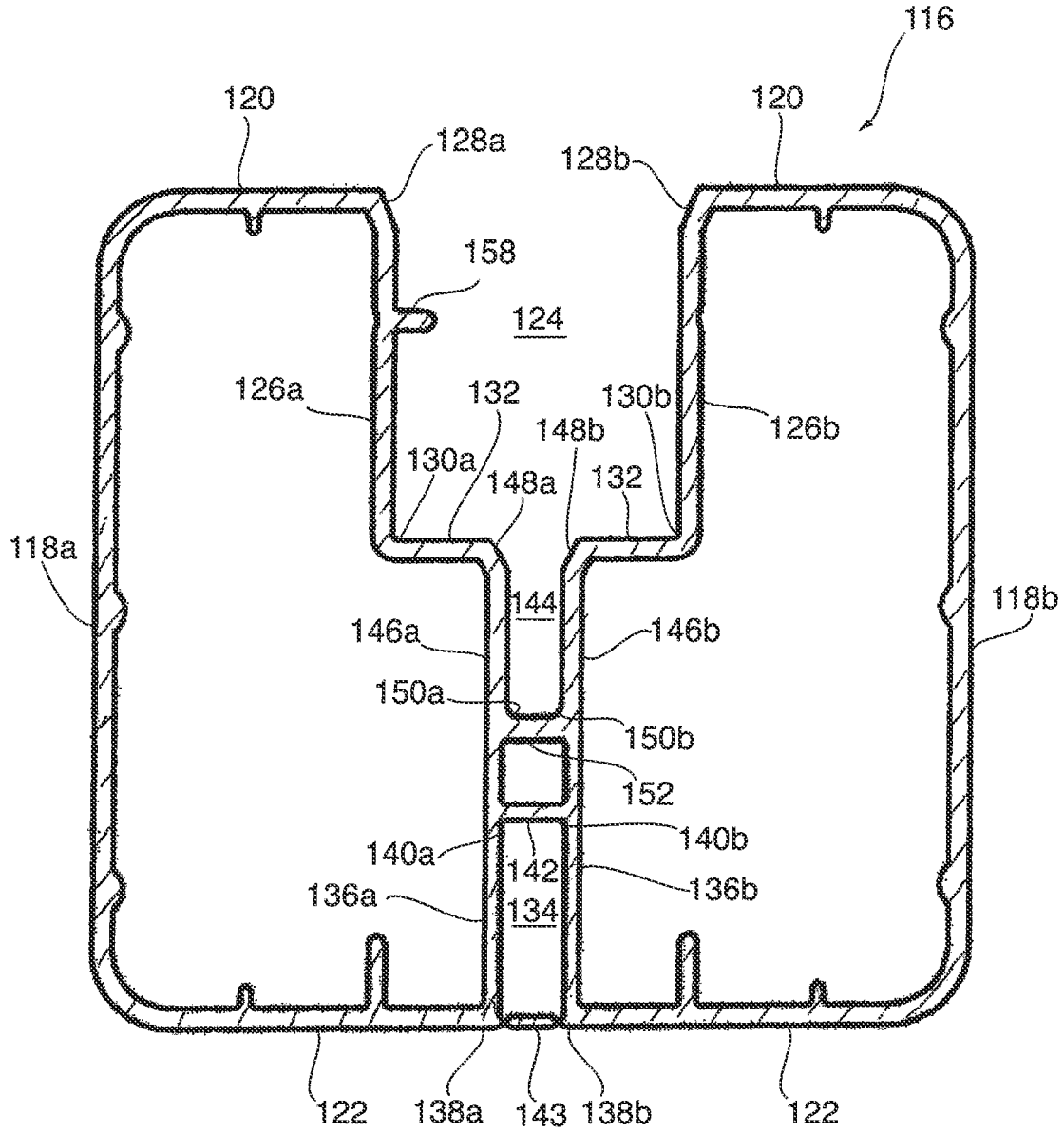
FIG. 2 is a cross-sectional view of a common extruded rail profile of the fence section of FIG. 1.

Referring to FIG. 2, each of the rails 112, 114 is, in the example illustrated, made of a common extruded rail profile 116. The profile 116 includes laterally spaced apart side faces 118*a*, 118*b* extending between a proximal face 120 and a distal face 122 spaced vertically apart from the proximal face 120. A generally U-shaped panel recess 124 is provided in the proximal face 120. The panel recess 124 has laterally spaced apart first and second panel recess sidewalls 126*a*, 126*b*, each having an outer end 128*a*, 128*b* at the proximal face 120, and an inner end 130*a*, 130*b* disposed vertically intermediate the proximal face 120 and the distal face 122. A panel recess base 132 extends generally laterally inwardly from the inner ends 130*a*, 130*b* of the panel recess sidewalls 126*a*, 126*b*.

In the example illustrated, the rail profile 116 includes a distal lattice recess 134 associated with the distal face 122. The distal lattice recess 134 includes opposed distal lattice recess sidewalls 136*a*, 136*b* each having an outer end 138*a*, 138*b* at the distal face 122, and an inner end 140*a*, 140*b* disposed vertically intermediate the distal face 122 and the panel recess base 132. A distal lattice recess base 142 extends generally laterally between the inner ends 140*a*, 140*b* of the distal lattice recess sidewalls 136*a*, 136*b*.

A frangible cover strip 143 can be provided for releasably covering the distal lattice recess 134. The frangible cover strip 143 can extend laterally between the outer ends 140*a*, 140*b* of the distal lattice recess sidewalls 136*a*, 136*b*. In the example illustrated, the distal face 122 is generally planar, and the frangible cover strip 143 is coplanar with the distal face 122.

In the example illustrated, the connection between opposed lateral edges of the cover strip 143 and the adjacent outer ends 138*a*, 138*b* of the distal lattice sidewalls 136*a*, 136*b* comprises a thinned section of extruded material (e.g. having opposed v-grooves), facilitating tearing away the cover strip 143 to provide access to the recess 134 for use.

The rail profile 116 can additionally or alternatively be provided with a proximal lattice recess 144 associated with the proximal face 120. The proximal lattice recess 144 has laterally spaced apart proximal lattice recess sidewalls 146*a*, 146*b* each having an outer end 148*a*, 148*b* at the panel recess base 132, and an inner end 150*a*, 150*b* vertically intermediate the panel recess base 132 and the distal lattice recess base 142. A proximal lattice recess base 152 extends laterally between the inner ends 150*a*, 150*b* of the proximal lattice recess sidewalls 146*a*, 146*b*.

The rail profile 116 further includes at least one tongue 158 extending from one panel recess sidewall inwardly of the recess 124, towards the opposing panel recess sidewall. In the example illustrated, the tongue 158 extends from the panel recess sidewall 126*a* laterally (generally horizontally) towards the other panel recess sidewall 126*b*. The tongue 158 is joined to the panel recess sidewall 126*a* at a vertical position generally intermediate the inner and outer ends 128*a*, 130*a* thereof.

Figure 3:
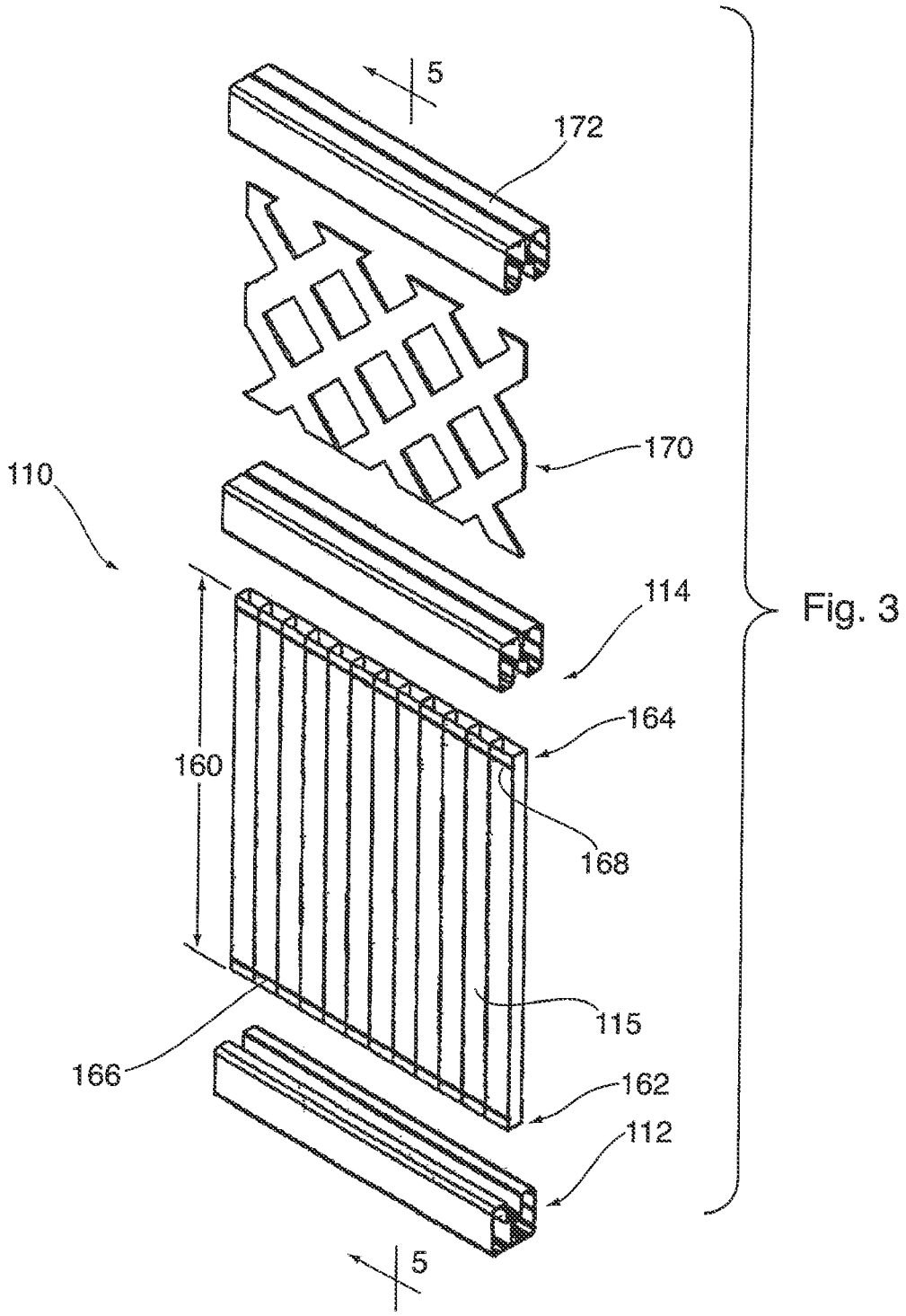
FIG. 3 is a partially exploded perspective view of the fence section of FIG. 1.

Referring to FIG. 3, the fence panel 115 has a height 160 extending between lower and upper ends 162, 164 of the panel 115. Each fence panel 115 has a generally constant lateral thickness along its height 160, and can comprise an extruded lineal having a constant cross-sectional panel profile along its height 160. Each panel 115 has a lower groove (or slot) 166 provided in one face of the panel 115 and extending across the panel 115 in a direction lengthwise of the rails 112, 114, adjacent the lower end 162. Each panel 115 has a similar upper groove (or slot) 168 adjacent the upper end 164.

Figures 4, 5A:
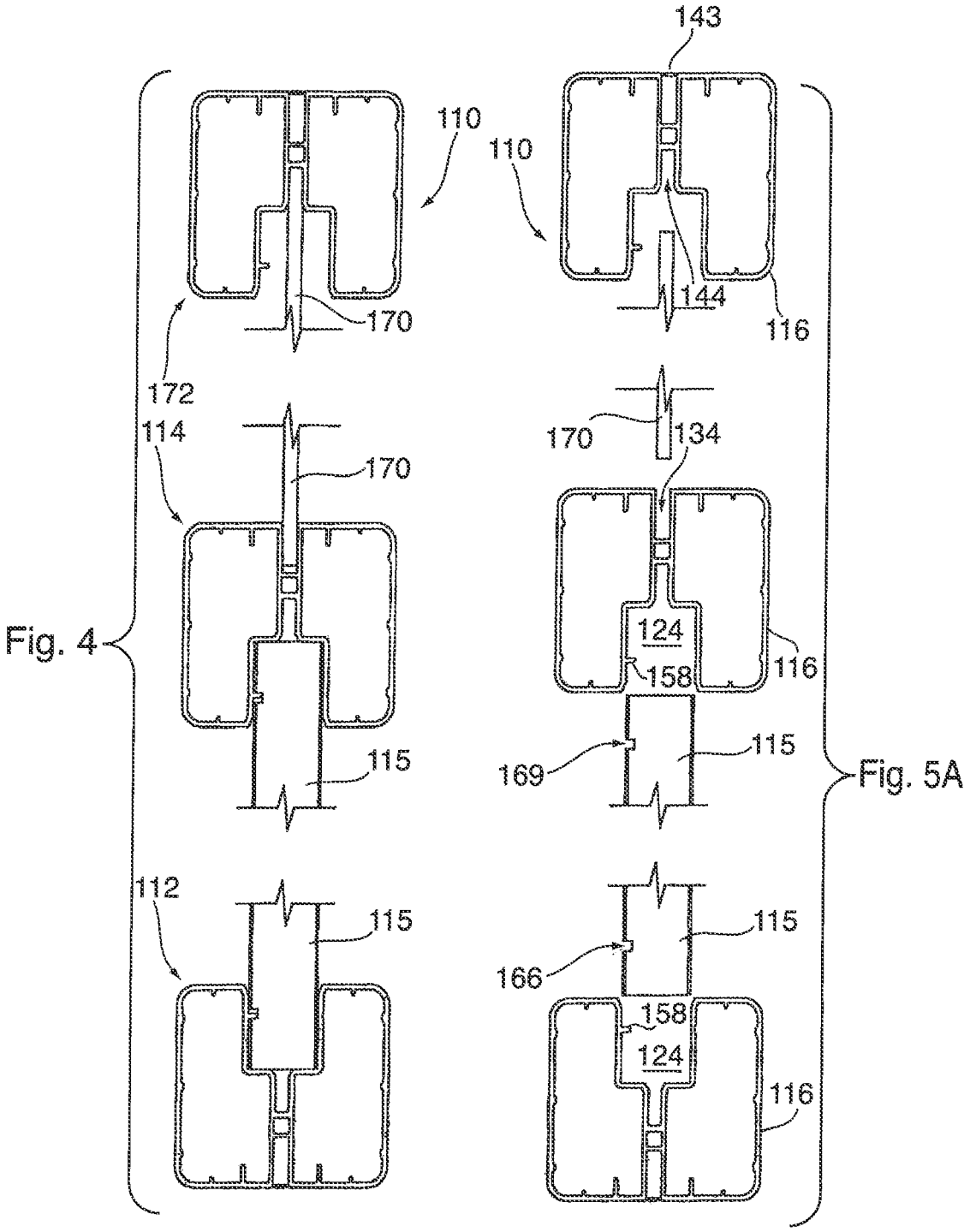
FIG. 4 is a cross-sectional view of the fence section of FIG. 1 taken along the lines 4-4.
FIG. 5A is a cross-sectional view of the fence section of FIG. 3 taken along the lines 5-5.

Referring to FIGS. 3, 4, and 5A, in use, the lower ends 162 of the fence panels 115 are received in the first panel recesses 124 of the first rail 112. The upper ends 164 of the fence panels 115 are received in the first panel recesses 124 of second rail 114. The tongues 158 of the respective rails 112, 114 are received in the respective slots 166, 168. The panels 115 can be inserted by sliding the panels 115 lengthwise along the rails 112, 114 with the tongues 158 aligned with the slots 166, 168. Alternatively, the rails 112, 114 and the panels 115 can be press fit together in a generally vertical direction with the ends 162, 164 of the panels 115 aligned with the recess 124, and at least one of the rail or panel resiliently deforming to accommodate insertion of the end of the panel 115 past the tongue 158. The engagement of the tongue 158 in the grooves 166, 168 provides interlocking of the panels 115 with the rails 112, 114 along substantially the entire width (extending parallel to the length of the rails 112, 114) of the panels 115.

As seen in FIGS. 1 and 3, the fence section 110 can be provided with a lattice panel 170 mounted in the upper face of the second rail 114. The cover strip 143 can be removed from the second rail 114, and a lower marginal portion of the lattice panel 170 can be seated in the distal lattice recess 134.

A third rail 172 can be mounted atop the lattice panel 170. In the example, illustrated, the third rail 172 has the same common rail profile 116 as the first and second rails 112, 114. An upper marginal portion of the lattice panel 170 is received in the proximal lattice recess 144 (see also FIGS. 4 and 5).

Figure 5B:
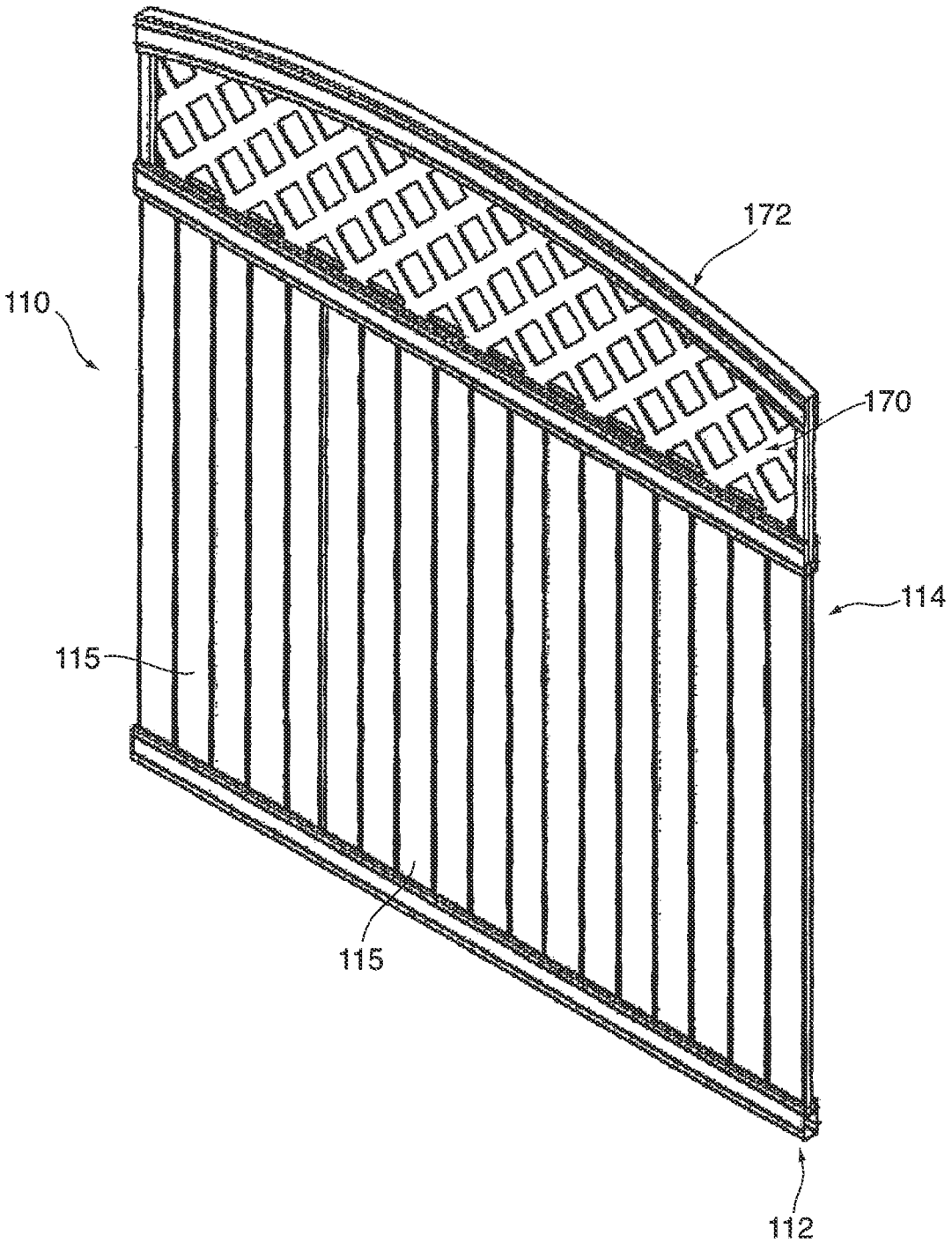
FIG. 5B is a perspective view of an alternate example of a fence section.

In an alternate example shown in FIG. 5B, the lattice panel 170 may have a curved upper end, and the third rail 172 may also be curved between opposed ends thereof.

Figure 6:
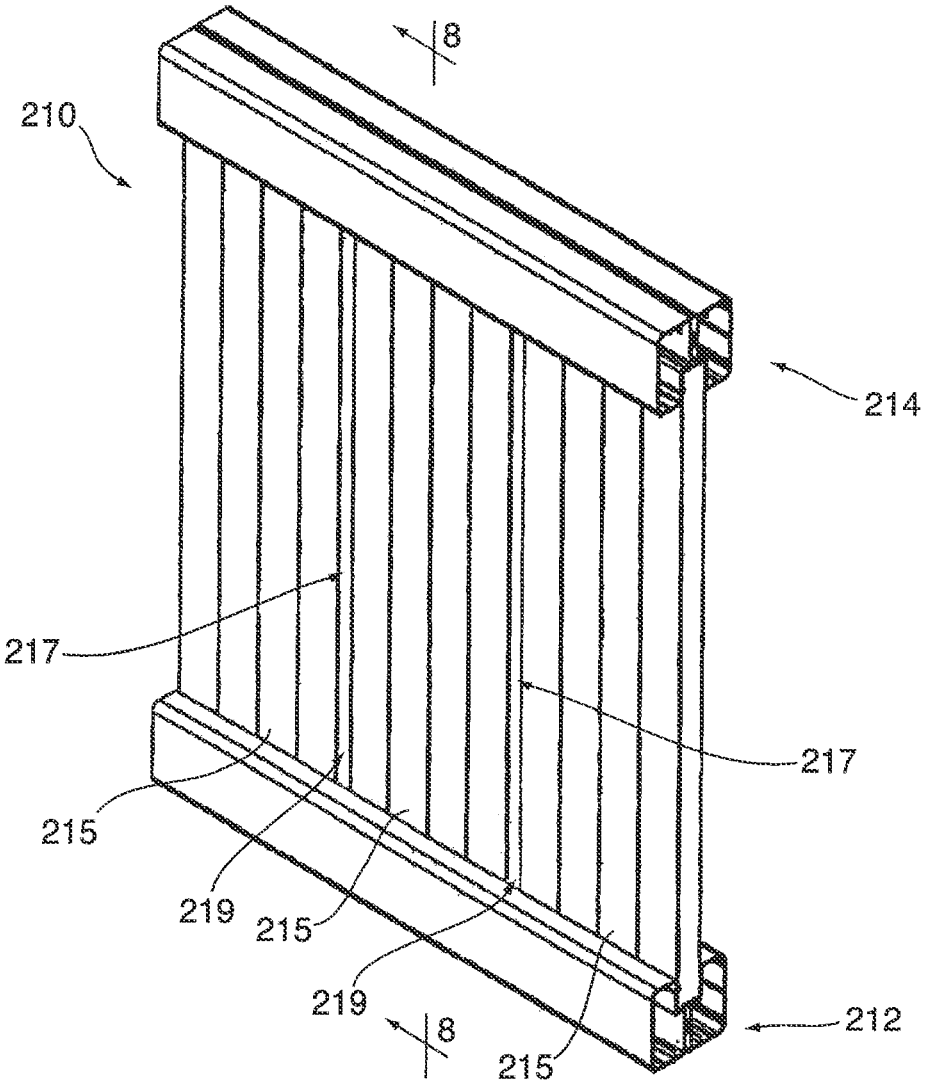
FIG. 6 is a perspective view of another example of a fence section.
Figure 7:
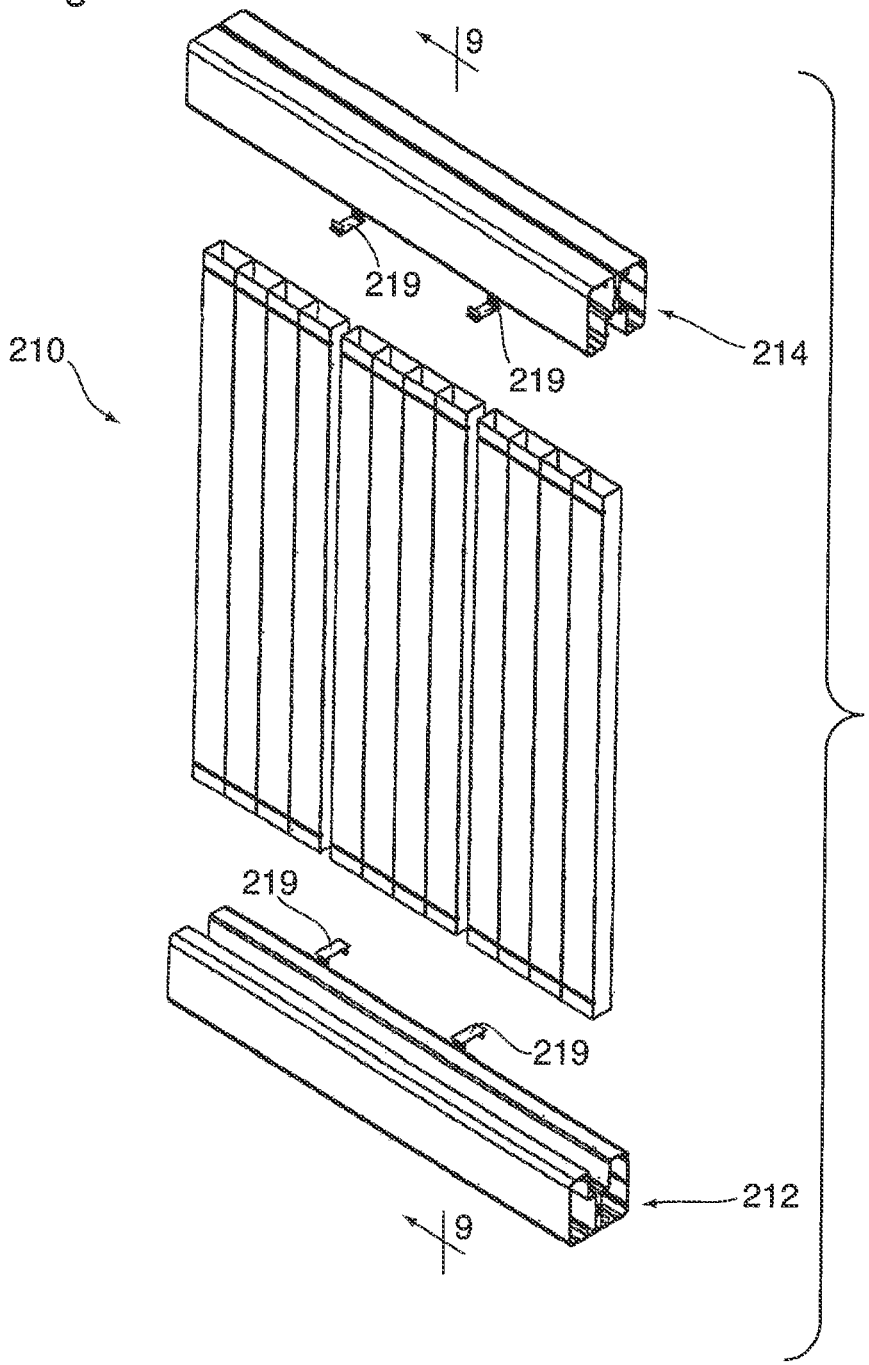
FIG. 7 is an exploded perspective view of the fence section of FIG. 6.

In FIGS. 6 and 7, another example of a rail section 210 is shown. The rail section 210 is similar to the rail section 110, and like features are identified by like reference characters, incremented by 100. The rail section 210 includes first and second rails 212, 214 with fence panels 215 extending vertically therebetween. In the fence section 210, gaps 217 are provided between adjacent ones of the panels 215. The rails 212, 214 have a common rail profile 216 to which spacers 219 can be clipped in registration with the gaps 217 to facilitate providing the gaps 217 between the panels 215.

Figure 8:
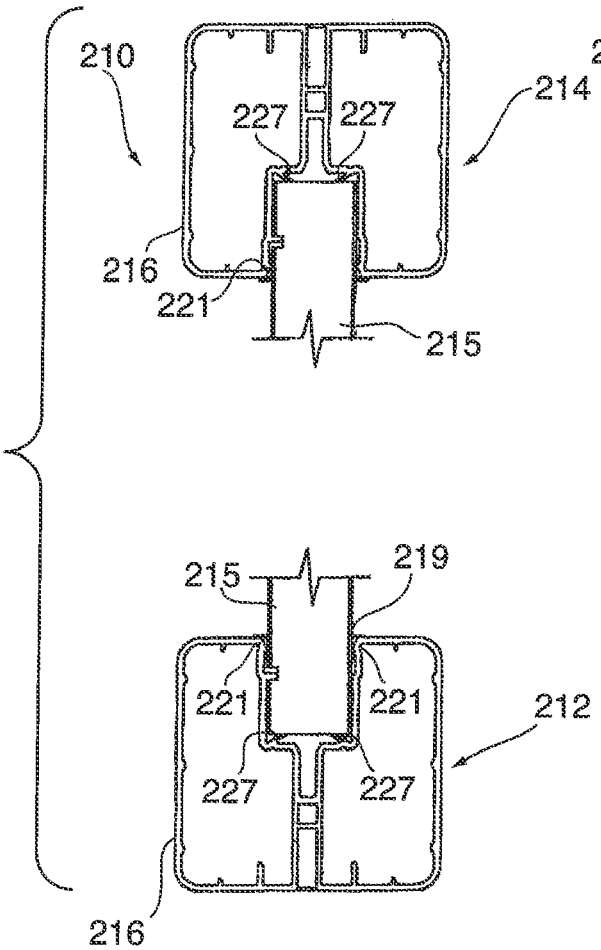
FIG. 8 is a cross-sectional view of the fence section of FIG. 6 taken along the lines 8-8.
Figure 9:
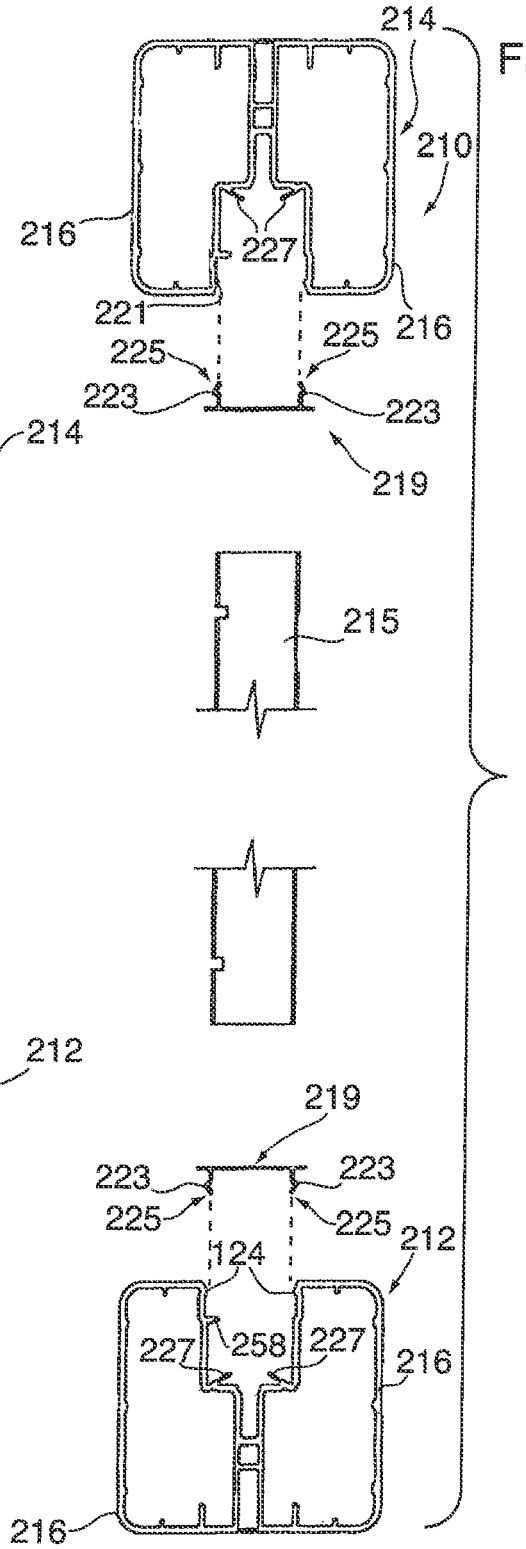
FIG. 9 is a cross-sectional view of the fence section of FIG. 7 taken along the lines 9-9.

Referring to FIGS. 8 and 9, the common rail profile 216 includes inwardly directed lugs 221 extending laterally inwardly from the panel recess sidewalls near the upper ends thereof. The lugs 221 inter-engage with protrusions 223 extending laterally outwardly from mounting legs 225 extending from the back surface of the spacer 219.

The profile 216 can also include pressure tabs 227 extending generally from the panel recess base towards the proximal face of the profile 216. The pressure tabs 227 are configured to bear against the end face of the panel 215. This can facilitate secure mounting of the panels 215 in the panel recesses 224.

Figure 10:
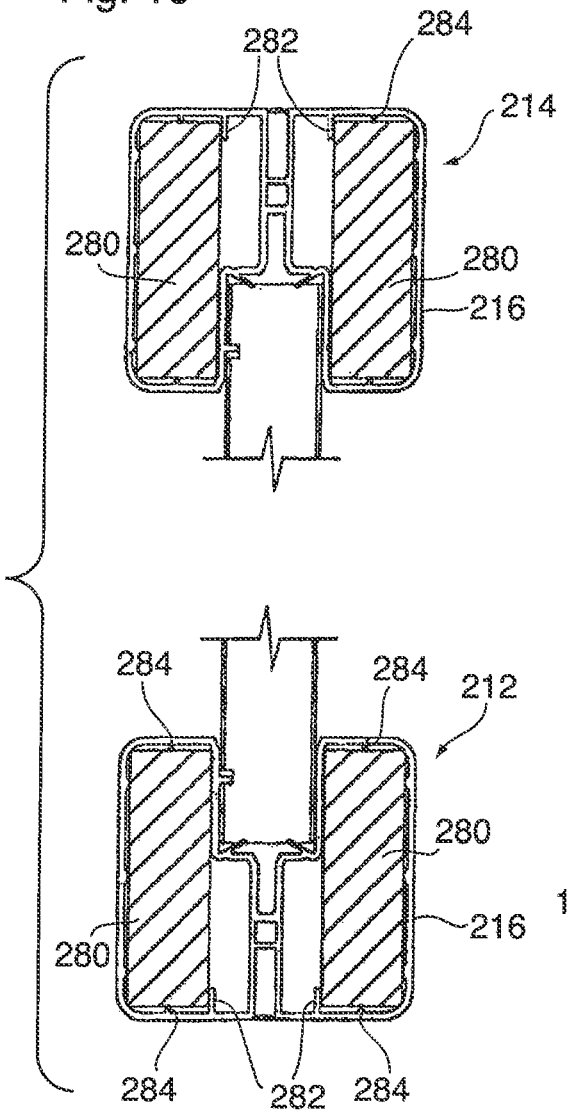
FIGS. 10 and 11 are cross-sectional views of portions of the fence sections of FIGS. 6 and 1, respectively, with optional wooden reinforcement members.
Figure 11:
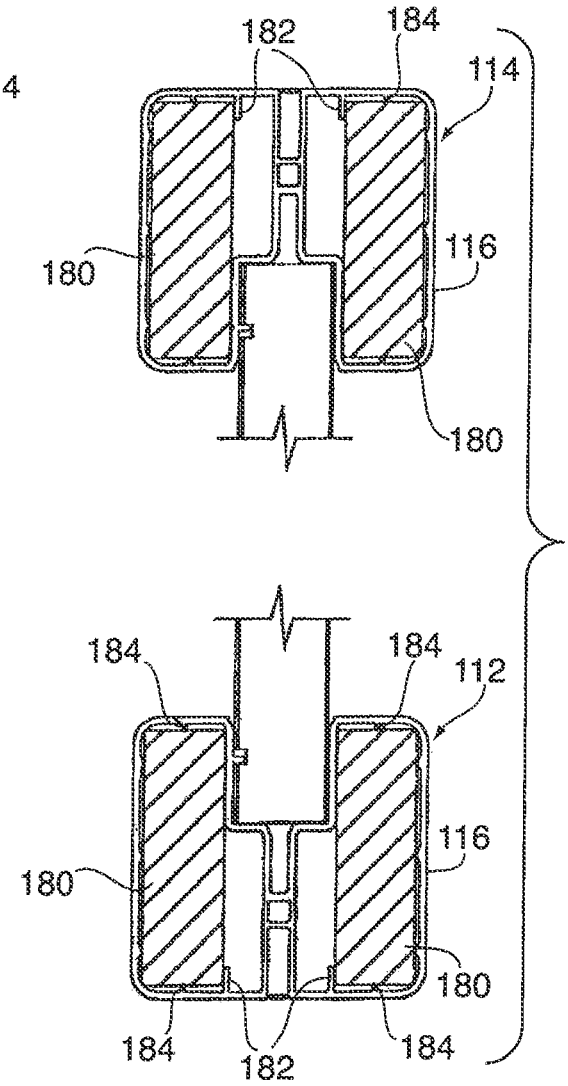

In FIGS. 10 and 11, the profiles 216 and 116 are shown with wooden reinforcement members 280, 180 (respectively) provided within the hollow interior of the respective rails 212, 214, 112, 114. The profiles 116, 216 can be sized to accommodate dimensional lumber (e.g. 1×3). Webs 182, 282 and/or standoffs 184, 284 can be provided in the interior of the profiles 116, 216 to provide a snug fit for the wooden reinforcement 180, 280.

Figure 12:
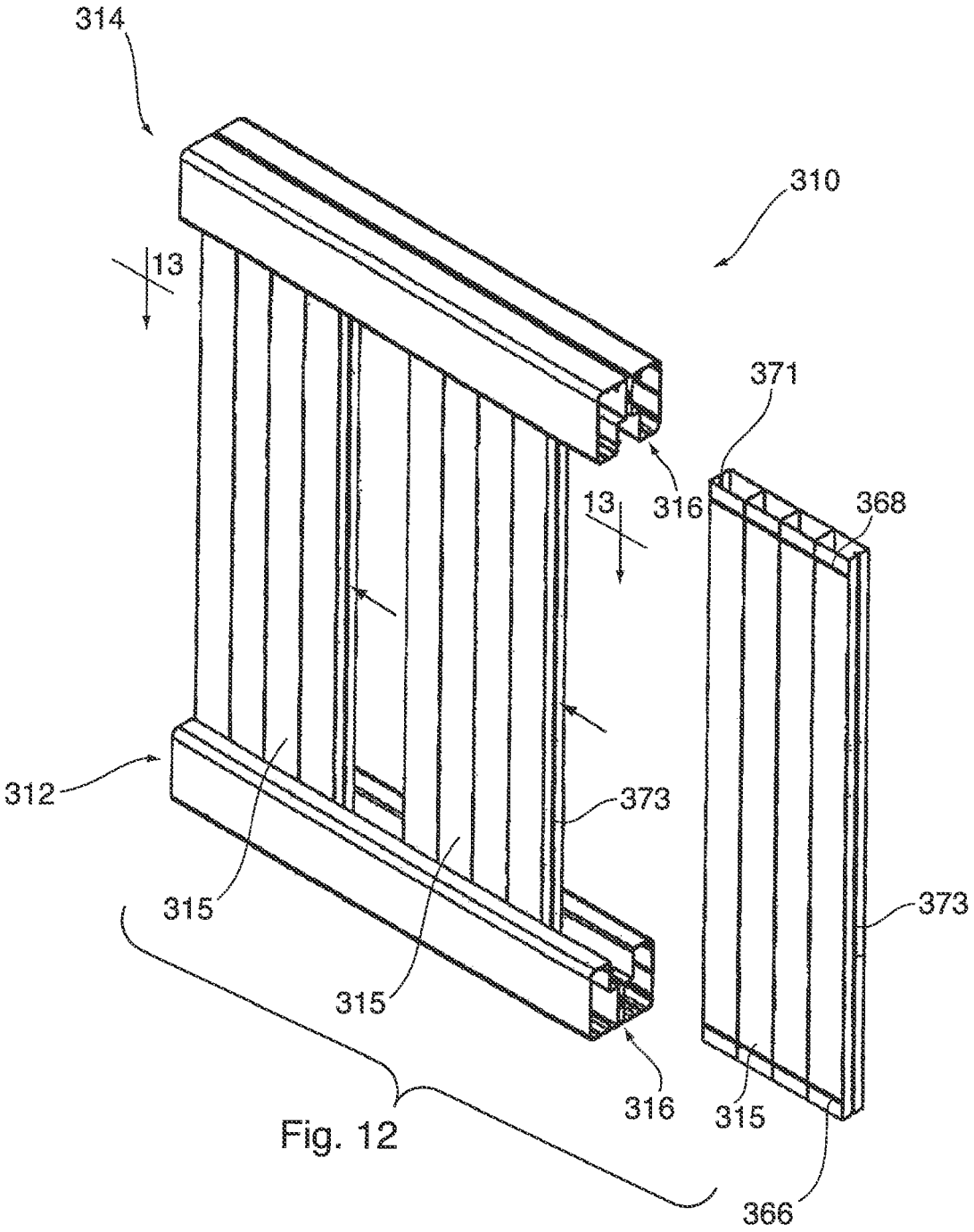
FIG. 12 is a perspective view of another example of a fence section.

FIG. 12 shows another example of a fence section 310 having rails 312, 314 with a common rail profile 316. Fence panels 315 are provided with cooperating male and female engagement elements 371, 373 extending along the height 360 of the panels 315 at opposite vertical side edges thereof. The male engagement elements 371 can be received in the female engagement elements 373 of an adjacent panel 315 (FIGS. 13 and 14) to facilitate securing together the fence section 310.

FIGS. 15-19 show another example of a fence section 410 that is similar to the fence section 110, with like features identified by like reference characters incremented by 300. The fence section 410 includes first and second rails 412, 414 (or lower rail 412 and upper rail 414), with a common rail profile 416 and a plurality of panels 415 extending between the rails 412, 414.

Figure 15:
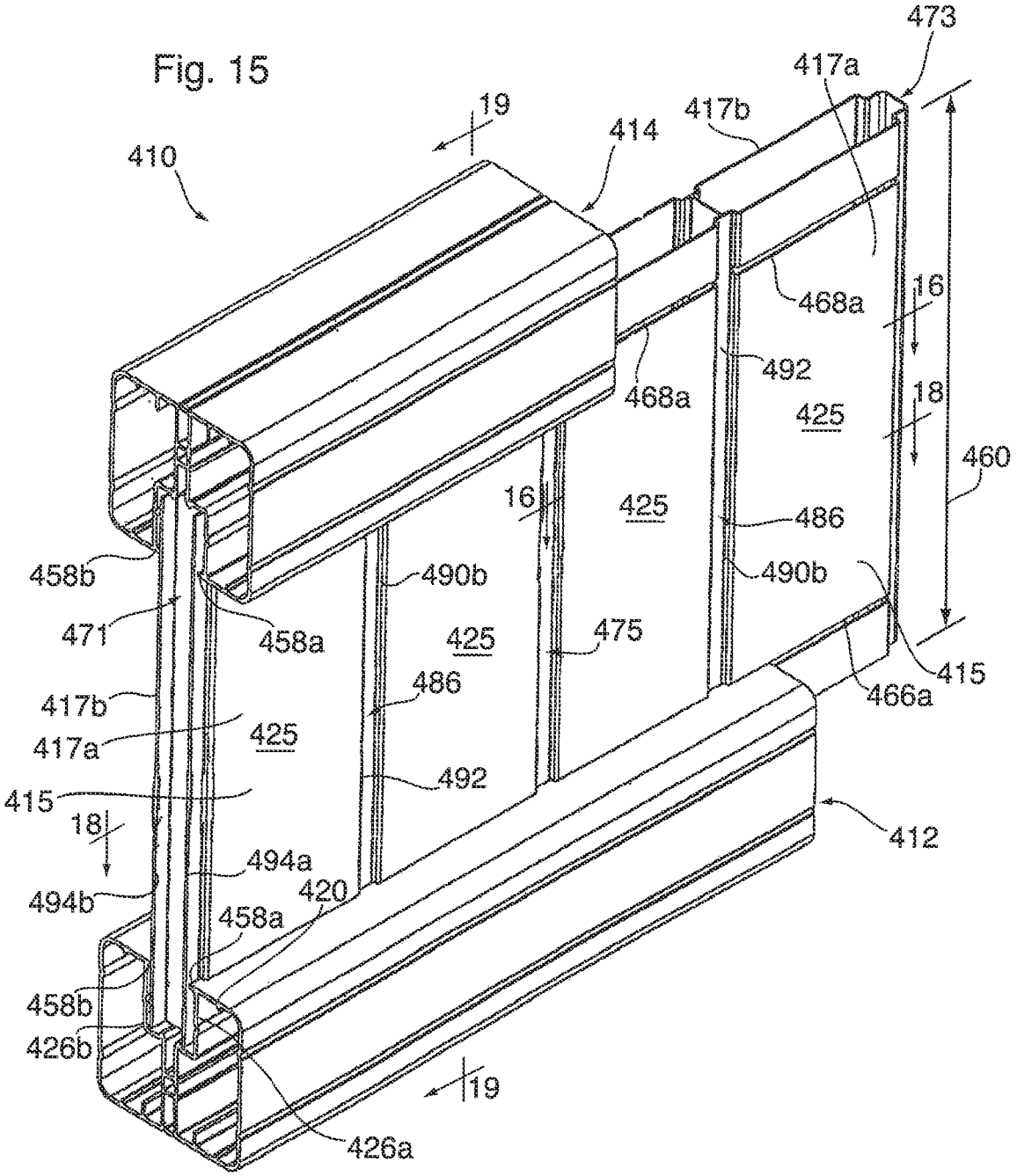
FIG. 15 is a perspective view of another example of a fence section.
Figure 16:
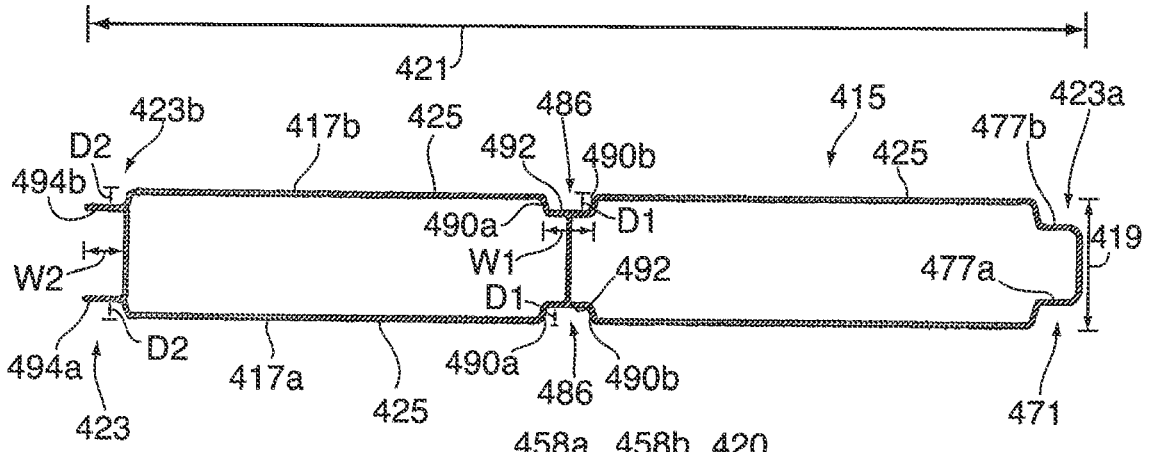
FIG. 16 is a cross sectional view of a fence panel, taken along line 16-16 in FIG. 15.

Referring to FIGS. 15 and 16, the fence panels 415 each have opposed front and back faces 417*a*, 417*b* generally disposed in vertical planes, parallel with each other and the rails 412, 414. Each panel 415 has a panel thickness 419 extending orthogonally between the front and back faces 417*a*, 417*b*, and a panel width 421 extending longitudinally along the rails 412, 414, between opposed first and second vertically extending ends 423*a*, 423*b*.

The front and back faces 417*a*, 417*b* can be provided with one or more recessed channels 486 extending along the height 460 of the panel. Each channel 486 comprises opposed channel side faces 490*a*, 490*b*, extending generally orthogonally from the respective panel face 417*a*, 417*b* and towards the panel interior (i.e. towards the opposing panel face), and a channel base 492 extending between the lateral faces. The channel base 492 is, in the example illustrated, generally planar and parallel to the faces 417*a*, 417*b*. The orthogonal (or lateral) extent of the channel side faces 490*a*, 490*b* generally defines a channel depth D1. The spacing between the channel side faces 490*a*, 490*b* (measured parallel to the rails) generally defines a channel width W1. The channels 486 provide the panels 415 with raised panel portions 425 on either side of the recessed channels 486. The raised panel portions 425 can create the appearance of a plurality of side-by-side slats each extending longitudinally along the height 460 of the panel 415.

In the example shown, each panel 415 comprises one channel 486 spaced approximately mid-way between the vertically extending ends 423*a*, 423*b*. However, in other examples, more than one channel 486 may be provided on each face.

Figure 18:
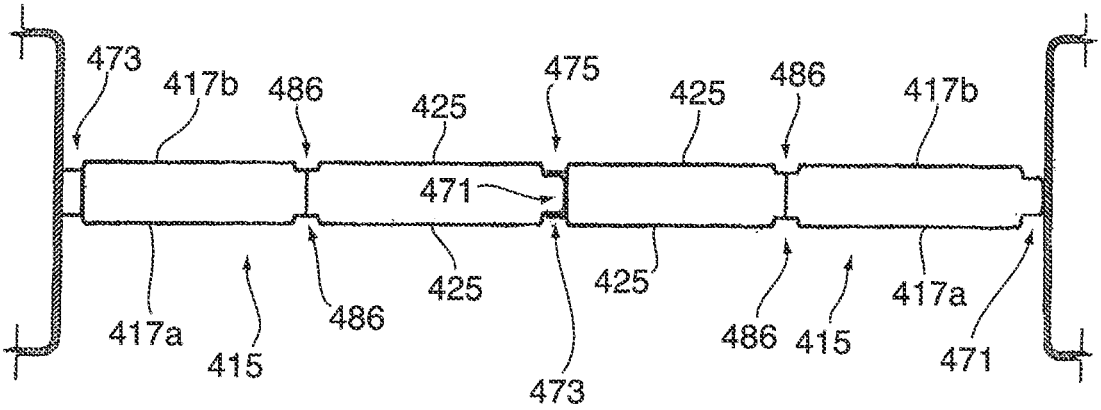
FIG. 18 is a cross sectional view of a fence section, taken along line 18-18 in FIG. 15.

Referring to FIGS. 16 and 18, each fence panel 415 is, in the example illustrated, provided with cooperating male and female engagement elements 471, 473 at respective ones of the vertically extending side edges or ends 423*a*, 423*b*. The male and female engagement elements are configured such that when two panels 415 are assembled in side-by-side relation, the male engagement element 471 can inter-engage with the female engagement element 473. In the example illustrated, the engagement elements 471, 473 are integrally extruded with the panels 415, and extend continuously along the height 460 of the panels 415. When the male engagement element 471 is inserted into the female engagement element 473, the male protruding member fits within laterally spaced apart front and rear walls 494*a*, 494*b* of the female engagement member 473. Each wall 494*a*, 494*b* is generally parallel to, and in the same plane as, the base 492 of the channels 486 in the respective front and rear panel faces 417*a*, 417*b*. The front wall 494*a* is laterally recessed relative to the front panel face 417*a* by a distance D2 that is generally equal to the distance D1. The back wall 494*b* is similarly offset relative to the back panel face 417*b*.

Further, the width W2 (extending parallel to the rails 412, 414) of each wall 494*a*, 494*b* is generally equal to the width W1 of the channel face 492. Accordingly, referring to FIG. 18, when the male engagement element 471 is inserted between the walls 494*a* and 494*b* of FIG. 16, the joint 475 appears similar to channel 486, with walls 494*a* and 494*b* appearing similar to channel face 492. The male member 471 has front and rear sidewalls 477*a*, 477*b* that are also generally parallel to, and the same width as, the channel bases 492. The lateral spacing of the sidewalls 477*a*, 477*b* from the respective faces 417*a*, 417*b*, is slightly greater than D1 so that the male member 471 fits within the female member 473. However, the single male member 471 abutting a newel post at one end of the fence nevertheless has a visual appearance very similar to channels 486 and female end 473 (see FIG. 18).

Figure 17:
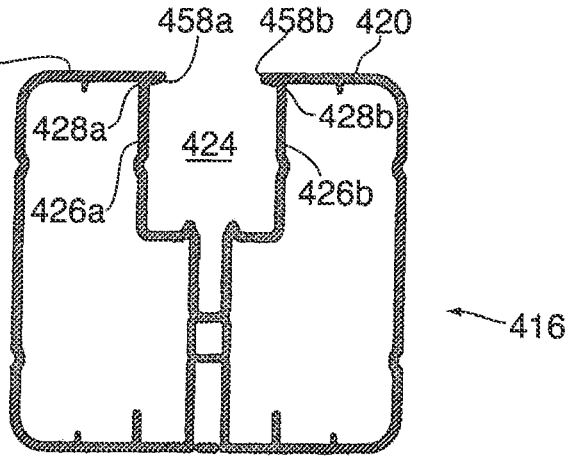
FIG. 17 is a cross-sectional view of a common extruded rail profile of the fence section of FIG. 15.

Referring to FIG. 17, each common rail profile 416 comprises at least one laterally inwardly directed tongue extending inwardly of the recess 424. In the example illustrated, two laterally opposed first and second tongues 458*a*, 458*b* are provided, each extending inwardly of the recess 424. The first tongue 458*a* extends from the first panel recess sidewall 426*a* towards the second panel recess sidewall 426*b*, and the second tongue 458*b* extends from the second panel recess sidewall 426*b* towards the first panel recess sidewall 426*a*. The tongues 458*a* and 458*b* are joined to the panel recess sidewalls 426*a*, 426*b* at a vertical position generally at the outer ends 428*a*, 428*b* thereof, respectively. In other words, the tongues 458*a* and 458*b* extend inwardly from the sidewalls 426*a*, 426*b* generally at the respective outer ends 428*a*, 428*b*, thereof. The tongues 458*a*, 458*b* can be generally coplanar with the proximal face 420.

Figure 19:
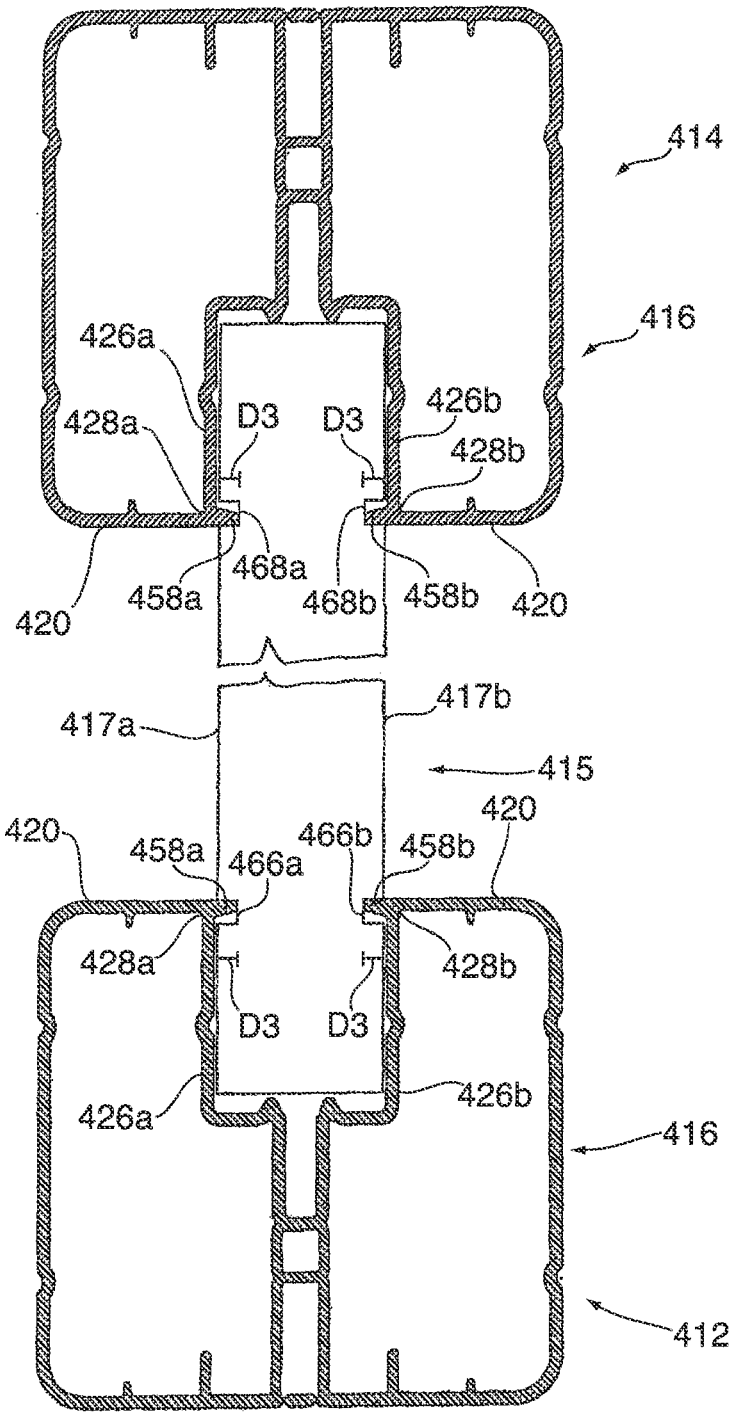
FIG. 19 is a cross sectional view of a fence section, taken along line 19-19 in FIG. 15.

Referring to FIG. 19, the panels 415 are provided with at least one slot or groove to receive the at least one tongue of the rail profile. In the example illustrated, two grooves are provided (front and back lower grooves) 466*a*, 466*b* to receive tongues 458*a* and 458*b*, respectively, of the lower rail 412, and with front and back upper grooves 468*a*, 468*b* to receive the tongues 458*a*, 458*b*, respectively, of the upper rail 414. In the example illustrated, the grooves 466 and 468 extend across the raised panel portions 425 of the panels 415, between the edges 423*a*, 423*b* and the channels 486. The bases 492 of the channels 486 are free of the grooves 466*a*, 466*b*, 468*a*, 468*b* and remain vertically intact across the elevation at which the grooves 466*a*, 466*b*, 468*a*, 468*b* are provided in the raised panel portions 425 on either side of the channels 486.

To provide the grooves 466*a*, 466*b*, 468*a*, 468*b*, a saw cut can be made across the entire width 421 of the panel 415. The depth of cut can be set to generally equal the channel depth D1, so that the thickness of the extruded wall forming the raised panels 425 is cut through, but the wall forming the base 492 is below the depth of cut and so remains uncut.

Upon installation, when the tongues 458*a*, 458*b* are received in the slots 466 and 468, the innermost edges of the tongues 458*a*, 458*b* generally abut the channel bases 492. This can help to close off what would otherwise be an opening between the outer edges 428*a*, 428*b* of the panel slot sidewalls 426*a*, 426*b* and the base panel 492 of the channels 486. If left uncovered, such openings could admit snow, dirt, water or other matter to invade the rails. Further, as grooves 466, 468 are not provided in channels 486 (i.e. grooves 466, 468 are not cut into the channel bases 492), the channel bases 492 may provide additional strength to the panels 415.

Figure 20:
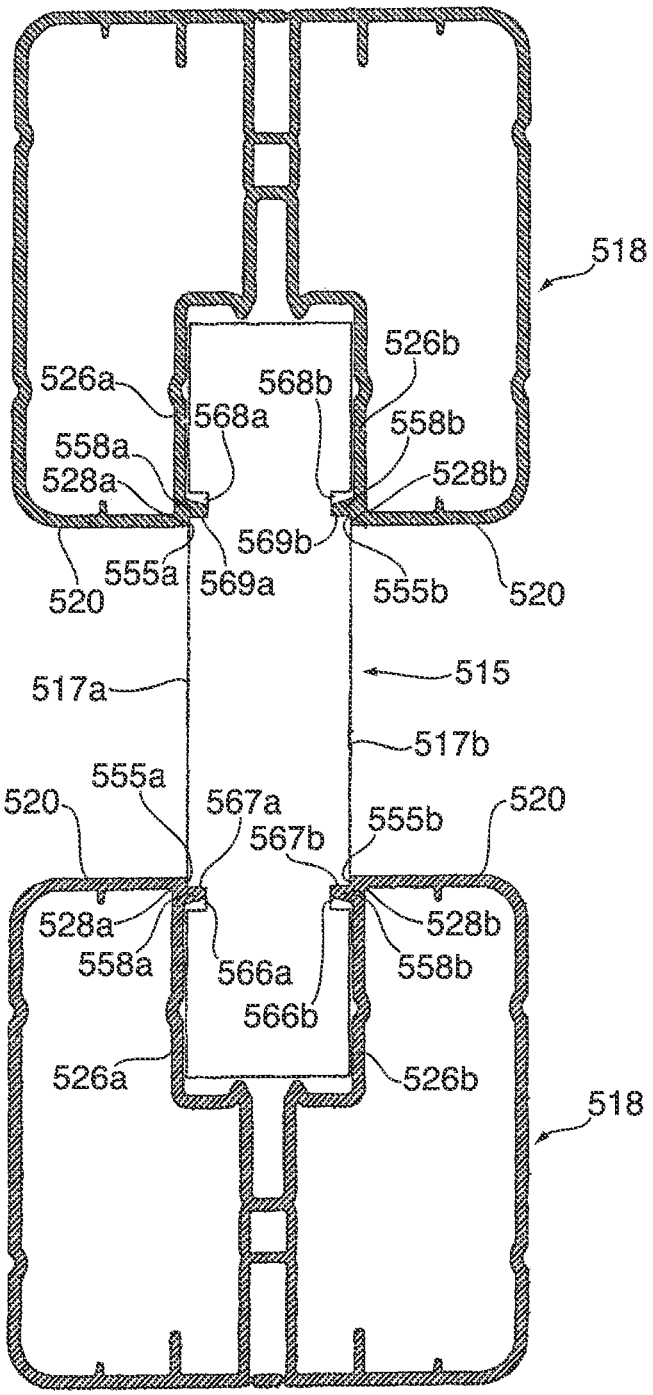
FIG. 20 is a cross sectional view of another example of a fence section.

FIG. 20 shows another example of a common rail profile 518 and a panel 515. In this example, the tongues 558*a* and 558*b* are joined to the panel recess sidewalls 526*a*, 526*b* at a vertical position near but spaced slightly vertically inward of the outer ends 528*a*, 528*b* thereof. The tongues 558*a* and 558*b* are slightly spaced from the junction of the panel recess sidewalls 526*a*, 426*b*, and the proximal face 520, vertically recessed relative to the proximal face 520. This can provide a vertical skirt segment 555*a*, 555*b* of the respective panel slot sidewalls 526*a*, 526*b* extending between the tongues 558*a*, 558*b* and the proximal face 520. The skirt segments 555*a*, 555*b* can conceal proximal edges 567*a*, 567*b* and 569*a*, 569*b* of the upper and lower grooves 566*a*, 566*b*, 568*a*, 568*b* in the front and back faces 417*a*, 417*b* of the panel 415, respectively, and provide additional lateral support to the raised panel portions 425 adjacent such proximal edges 567*a*, 567*b* and 569*a*, 569*b*.

Figure 21:
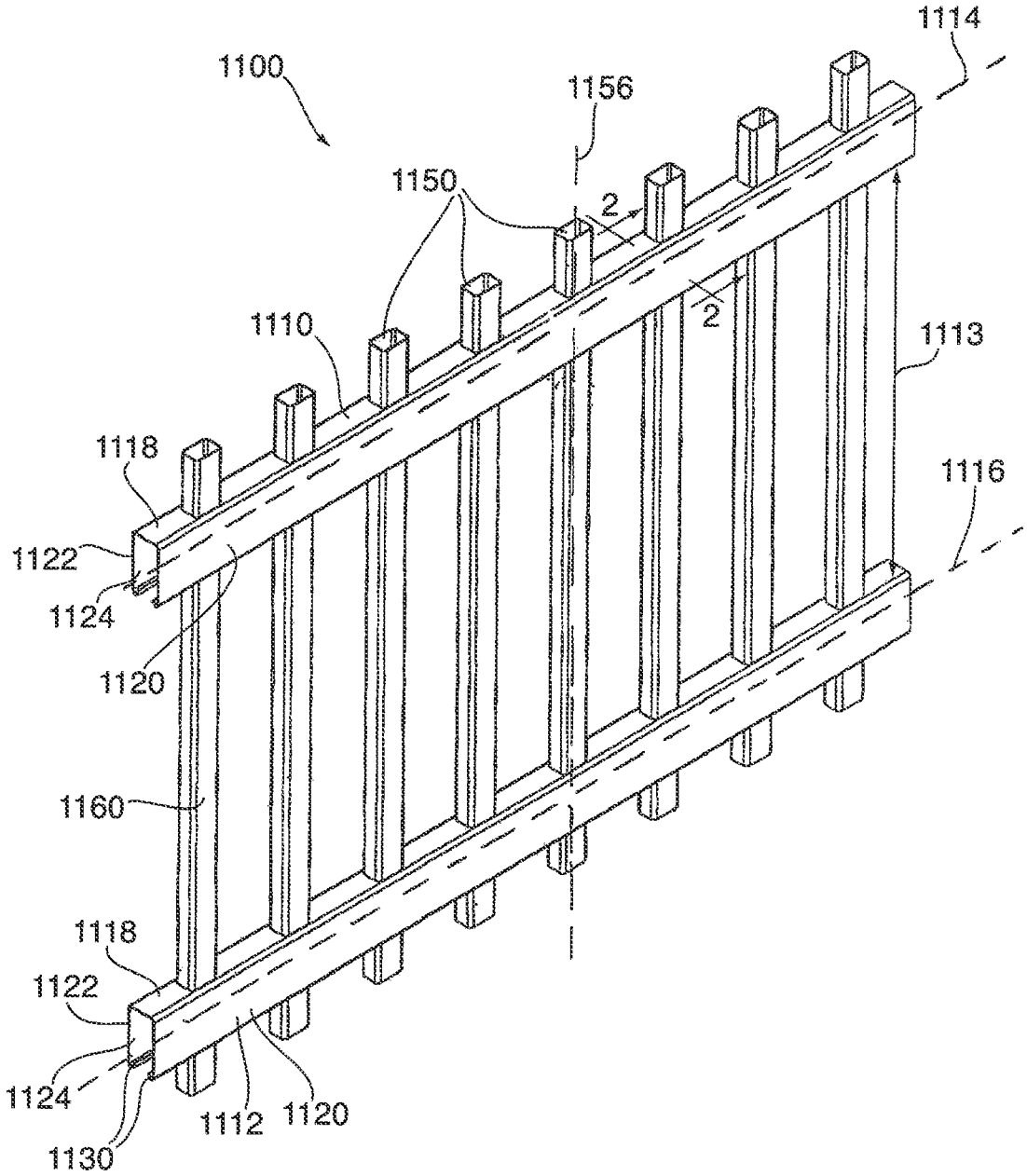
FIG. 21 is a perspective view of another example of a fence section.

Another example of a fence section 1100 is shown in FIGS. 21 to 24. Referring to FIG. 21, fence section 1100 includes generally horizontal upper and lower rails 1110, 1112 that extend along respective upper and lower rail axes 1114, 1116. The lower rail 1112 is generally aligned with and spaced vertically below the upper rail 1110 by a distance 1113. The distance 1113 between the rails 1110, 1112 may be chosen based on the customer requirements or according to industry standards. In some examples the distance 1113 may be between about 0.2 meters and 3.0 meters. In other examples, the distance 1113 may be about 1.5 meters. In the example illustrated each of the rails 1110, 1112 is formed from a respective extruded lineal and includes integrally formed attachment legs 1130.

Figure 22:
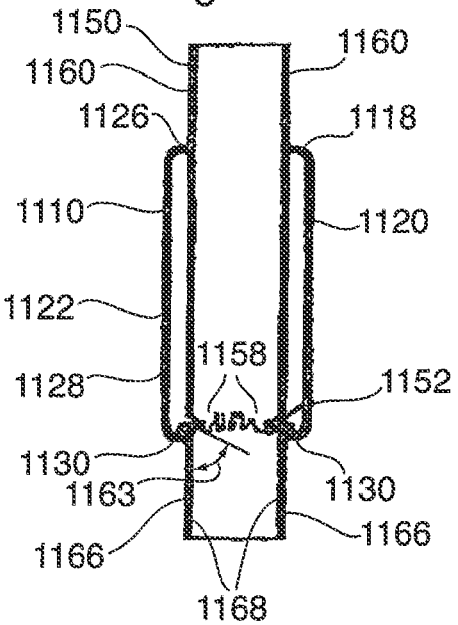
FIG. 22 is a partial section view of the fence section of FIG. 21.

Referring still to FIG. 21, the fence section 1100 includes a plurality of vertical members 1150 extending between the upper and lower horizontal rails 1110, 1112. Referring to FIGS. 22 and 23*b*, each vertical member 1150 includes at least one upper slot 1152 and at least one lower slot (not shown) corresponding to attachment legs 1130 of the upper and lower rails 1110, 1112 respectively. The attachment legs 1130 of the upper and lower rails 1110, 1112 are received within their corresponding upper slot 1152 and lower slot to secure each vertical member 1150 to the upper and lower horizontal rails 1110, 1112.

Each of the vertical members 1150 defines and extends along a respective vertical axis, for example vertical axis 1156. The vertical members 1150 are, in the example illustrated, extruded lineals that each have the same extruded cross section. In some examples each vertical member 1150 may be extruded as a separate member, or may be an injection molded member, or the vertical members 1150 may each be cut to length from a single, longer extruded member. The vertical axis of each vertical member generally coincides with the extrusion direction of the vertical members. The upper 1152 and lower slots of the vertical members 1150 extend generally perpendicular to its vertical axis. The upper 1152 and lower slots may be formed in the vertical members 1150 using a secondary manufacturing process after the vertical members 1150 have been extruded, for example by cutting, routing, machining and milling. In the example illustrated the upper 1152 and lower slots are formed by plunge cutting with a saw blade having a thickness generally equal to the thickness of the slot. The saw blade can have a depth a cut that provides a slot all the way through the sidewall, and having notches in each edge wall orthogonal to the sidewall.

Figure 23A:
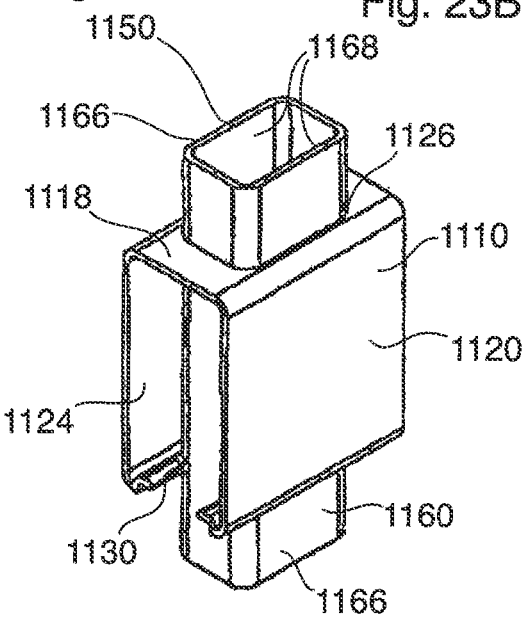
FIG. 23A is a perspective view of a portion of a fence section.
Figure 23B:
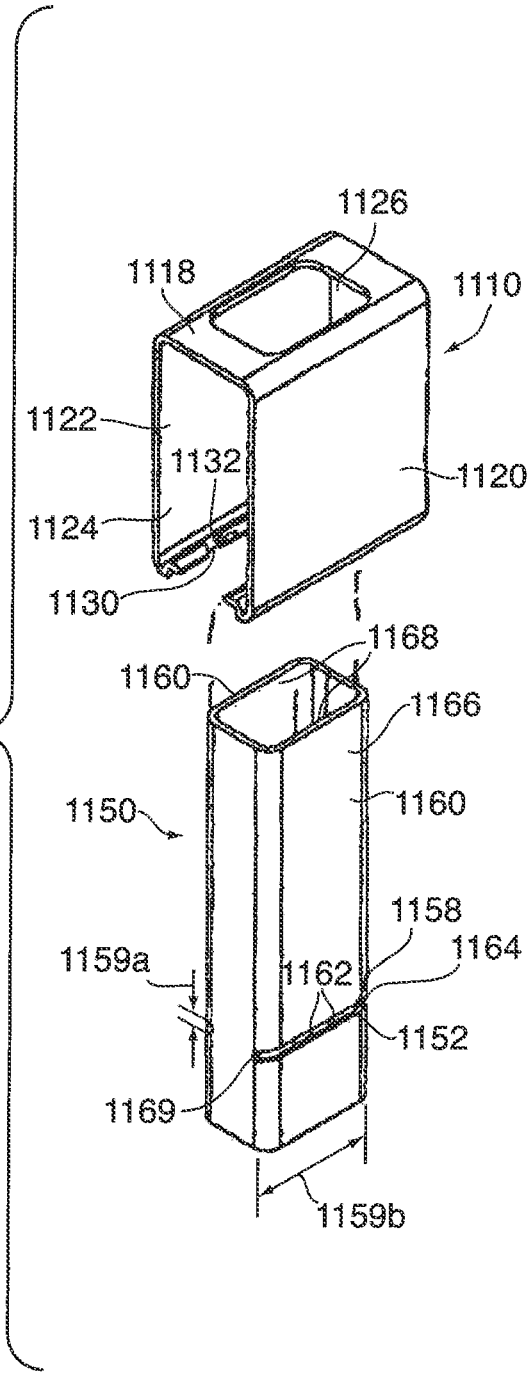
FIG. 23B is an exploded view of the fence section of FIG. 23*a;*

FIGS. 22 to 23B show the lower slot 1152 in detail. The upper slot may be identical to the lower slot, and is not shown separately in detail. As shown in FIGS. 23A and 23B, the lower slot 1152 forms an opening 1158 that extends through their respective sidewalls 1160 on each vertical member 1150. Each opening 1158 includes and is defined by a pair of opposed slot edge faces 1162 and a pair of opposed slot end faces 1164, each slot edge face 1162 and each slot end face 1164 extending laterally from an outer surface 1166 of the sidewall 1160 to an inner surface 1168 of the sidewall 1160. The slot edge faces 1162 are generally parallel to each other.

In some examples the upper 1152 and lower slots are cut into the sidewall 1160 so that the slot faces 1162, 1164 are generally orthogonal to the outer surface 1166 of the sidewall 1160. Such slots may be created by cutting the vertical members 1150 using a saw blade that is generally orthogonal to the sidewalls 1160. In other examples, the slots are cut into the sidewall 1160 so that the slot edge faces 1162 are at an oblique angle 1163 relative to outer surface 1166. This type of angle slot may be formed by cutting the vertical members 1150 with an angled saw blade. Angled slot edge faces 1162 may provide clearance for the attachment legs 1130 to flex and bend as they are snapped or snap-fit into the slots while maintaining the vertical connection to and support of the rail members 1110, 1112 once the attachment legs 1130 have been fully inserted into their respective slots. The slot end faces 1164 are parallel to each other and are spaced apart by a slot length 1159*b* and the slot edge faces 1162 are spaced apart by a slot height 1159*a*.

In the example illustrated, each attachment leg 1130 comprises opposing attachment leg end faces 1132 spaced apart by an attachment leg length. The attachment leg length is generally equal to, but slightly less than the slot length 1159*b* of the corresponding slot so that the attachment leg end faces 1132 can closely fit between the slot end faces 1164 without interfering with the slot end faces 1164 so that the attachment leg 1130 can be inserted into its slot.

Figure 24A:
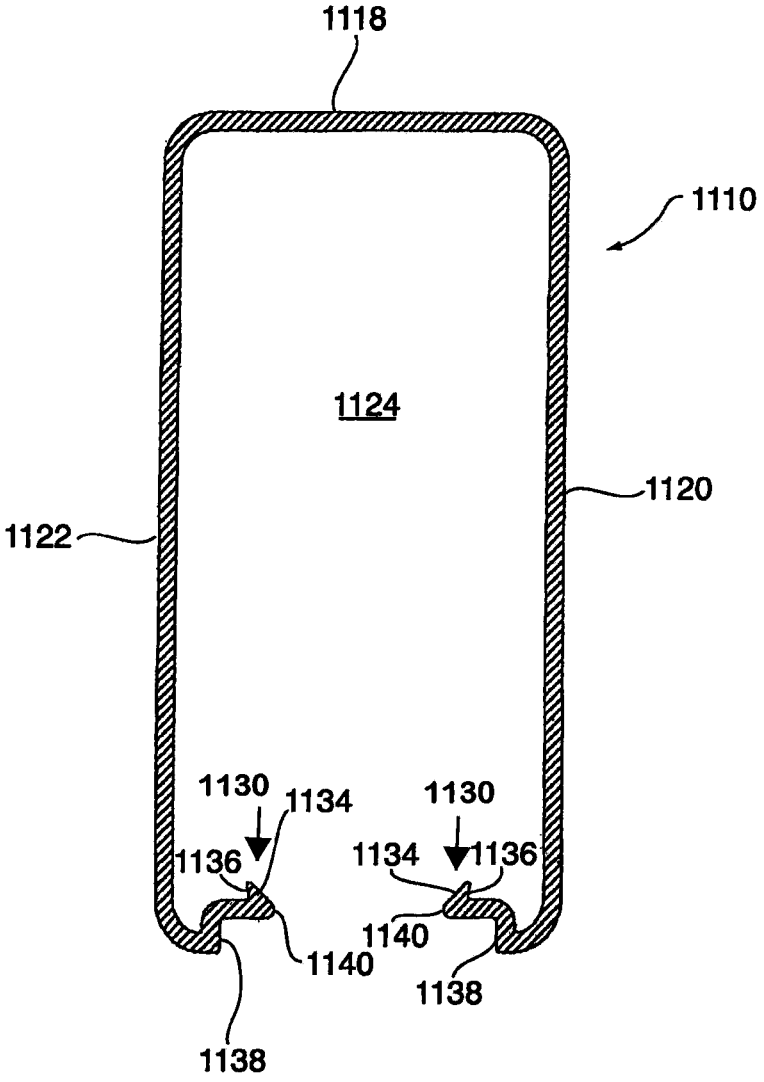
FIG. 24A is a section view of a rail.

Referring to FIG. 24A, each attachment leg 1130 includes a barb 1134. The barb 1134 includes an abutment surface 1136 that engages and bears against a portion of the inner surface of the sidewall 1168 adjacent or proximate the slot into which the attachment leg 1130 is received. When an attachment leg 1130 is fully inserted into its slot the engagement between the abutment surface 1136 of the barb 1134 and the inner surface of the sidewall 1168 tends to retain the attachment leg 1130 within the slot and resist removal therefrom.

Referring still to FIG. 24A, the upper rails 1110 also includes a base surface 1138. Each attachment leg 1130 formed on the rail 1110 extends from a base surface 1138 and each base surface 1138 generally opposes the abutment surfaces 1136 of the attachment legs 1130 extending therefrom. The base surface 1138 is generally spaced apart from the abutment surfaces 1136 by a distance that is greater than the thickness of the sidewalls 1160 of the vertical members 1150. The lower rail 1112 is arranged in substantially the same manner as the upper rail 1110. As illustrated in FIG. 22, when an attachment leg 1130 is fully inserted into its slot, the barb 1134 will be positioned inside the hollow interior of the vertical member 1160 and its abutment surface 1136 will engage the inner surface of the vertical member 1160. As described above, the base surface 1138 of each rail 1110, 1112 is opposed to and offset from the abutment surface 1136 so that the base surface 1138 will simultaneously engage the outer surface 1166 of the sidewall 1160 when the abutment surface 1136 engages the inner surface 1168.

Referring still to FIG. 24A, each barb 1134 has a generally wedge-shaped cross-section comprising a leading edge 1140 spaced apart from its abutment surface 1136 so that the each attachment leg 1130 facilitates insertion into and resists removal from its slot. The relative size and shape of the barb 1134 may be chosen to provide the insertion and removal performance desired by the user. Each attachment leg 1130 may also be resilient, or include some resilient portions, so that it is moveable between a first position for inserting the attachment leg 1130 and barb 1134 through its slot and a second position for retaining (or securing or locking) the attachment leg 1130 within its slot. When the attachment leg 1130 is in its first or insertion position the barb 1134 can be passed through the slot from outside the vertical member 1150 to inside the hollow interior of the vertical member 1150. To facilitate insertion of the attachment leg 1130 and barb 1134, an angled portion of the barb 1134 (extending from the leading edge to the abutment surface 1136 in the example shown) may engage a slot edge face 1162 and act as a cam surface to guide the barb 1134 as it is inserted. The engagement between the barb 1134 and the slot edge face 1162 may also create a force that is sufficient to deflect the resilient portion of the attachment leg 1130 as the leg 1130 is inserted. When the attachment leg 1130 is in the second position the abutment surface 1136 engages the inner surface 1168 of the sidewall 1160. The resilient nature of the attachment leg 1130 biases the attachment leg 1130 is second position. In other examples, the attachment 1130 may be biased toward its second position by an external biasing means (for example a spring).

In the example illustrated in FIGS. 21 to 24A, horizontal rails 1110, 1112 have a common extruded profile generally taking the form a downward opening, generally C-shaped channel. Each rail 1110, 1112 channel has a horizontal upper wall 1118 and first and second vertical, spaced apart, integrally formed rail sidewalls 1120, 1122 that define an internal cavity 1124. The upper wall 1118 of each horizontal rail 1110, 1112 includes a plurality of apertures 1126 spaced apart along the length of the rail 1110, 1112. When the fence section 1100 is assembled the rails 1110, 1112 are positioned so that the apertures 1126 in the upper horizontal rail 1110 are aligned with corresponding apertures 1126 in the lower horizontal rail so that each vertical member 1150 extending between the horizontal rails 1110, 1112 is received within one aperture 1126 in the upper horizontal rail 1110 and its corresponding aperture 1126 in the lower horizontal rail 1112.

Referring to FIG. 21, in the example illustrated, each vertical member 1150 extends beyond the upper wall 1118 of the upper horizontal rail 1110 beyond the bottom edge of the sidewalls 1120, 1122 of the lower horizontal rail 1112 so that the fence section 1100 may visually resemble a traditional picket fence constructed using known techniques. The extent to which the vertical members 1150 extend above and below the horizontal rails 1110, 1112 may be adjusted based on customer preference or any other consideration. As the position of the horizontal rails 1110, 1112 relative to the vertical members 1150 is based on the relative location of the slots 1152, 1154, the position of the slots 1152, 1154 on the vertical members 1150 may be changed to suit the customer requests.

When the rails 1110, 1112 have a generally C-shaped profile, as illustrated in FIGS. 21 to 24, the rails 1110, 1112 are formed with opposing pairs of attachment legs 1130 extending from an inner face 1128 of the first and second rail sidewalls 1120, 1122 of the upper and lower rails 1110, 1112. In this configuration, the attachment legs 1130 are arranged as pairs of opposing attachment legs 1130 along the length of the internal cavity 1124 at a desired interval (based on the desired spacing of the vertical members 1150). Each attachment leg 1130 in a pair of opposing attachment legs 1130 extends toward its opposing attachment leg 1130 and into the internal cavity 1124.

Complementing the arrangement of opposing attachment legs 1130 each vertical member 1150 includes a set of complimentary opposing upper slots 1152 and a set of opposing lower slots 1154 formed in opposing sidewalls 1160 of the vertical member 1150 for receiving the opposing pairs of attachment legs 1130 on the upper and lower rails 1110, 1112 respectively.

In this example, the rail sidewalls 1120, 1122 may also be at least partially resilient to enable them to flex outwardly when the vertical members 1150 are inserted through the internal cavity 1124 when the attachment legs 1130 are not aligned with the slots 1152, 1154, and then to return to their original configuration after the attachment legs 1130 are inserted through the slots 1152, 1154.

The apertures 1126 in the upper walls 1118 of the rails 1110, 1112 are illustrated as being generally rectangular, with rounded corners that are shaped to snugly receive the vertical members 1150. In other examples, both the apertures 1126 and the vertical members 1150 maybe of a different configuration. While the vertical members 1150 are shown as being generally rectangular, it is understood that the cross-sectional shape (and its dimensions and proportions) of the vertical members 1150 may be any suitable shape, including square, rectangular, triangular, circular and polygonal. Similarly, the apertures 1126 may be of any desired size and shape that can receive a corresponding vertical member. The apertures may have the same general shape and size as the vertical members so that the vertical members closely fit within the apertures with little visible gap between the surfaces of the vertical member and the receiving aperture. Alternatively, the apertures may be of a different size and/or shape than the vertical members so that the vertical members are loosely received within the apertures. For example, a round vertical member could be loosely received within a larger, square aperture.

Figure 24B:
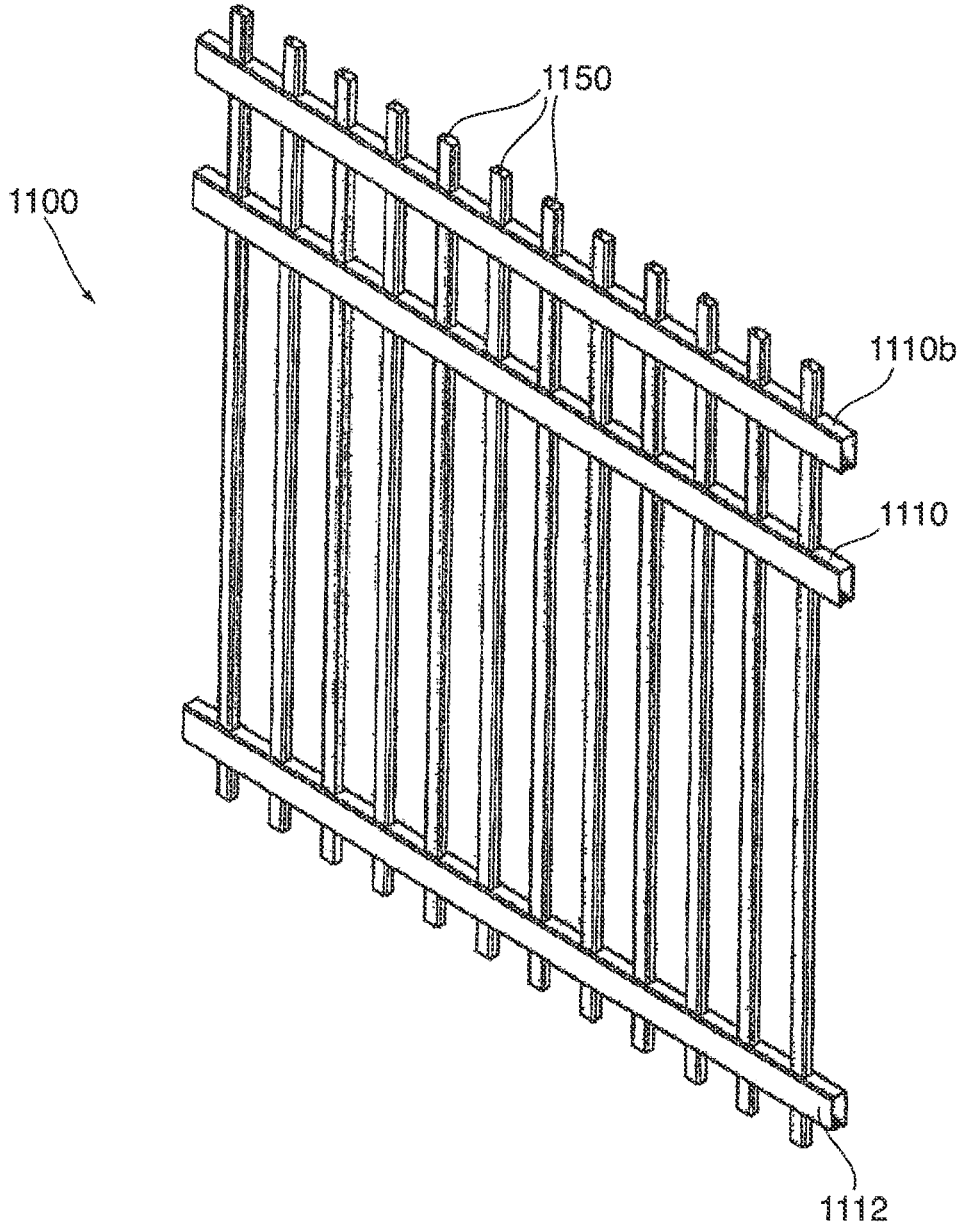
FIG. 24B is a perspective view of another example of a fence section.

In an alternate example shown in FIG. 24B, the fence section 1100 includes a second horizontal upper rail 1110*b*, positioned above the upper rail 1110. The second horizontal upper rail 1110*b* is substantially the same as the upper rail 1110. Further the vertical members 1150 include a second upper slot (not shown), which corresponds to attachment legs (not shown) of the second upper rail 1110*b*. The second upper rail 1110*b* is mounted to the vertical members in the same manner as the upper rail 1110. The second horizontal upper rail 1110*b* may, for example, be included in the fence section 1100 for aesthetic purposes.

Referring now to FIGS. 25 to 29, another example of a fence section 1200 is shown. The connection structure used to attach the members of fence section 1200 is similar to the connection structure of fence section 1100, and like features are identified by like reference characters, incremented by 100. The fence section 1200 includes upper and lower horizontal rails 1210, 1212 that are spaced apart by a vertical distance 1213.

Figures 26A, 26B:
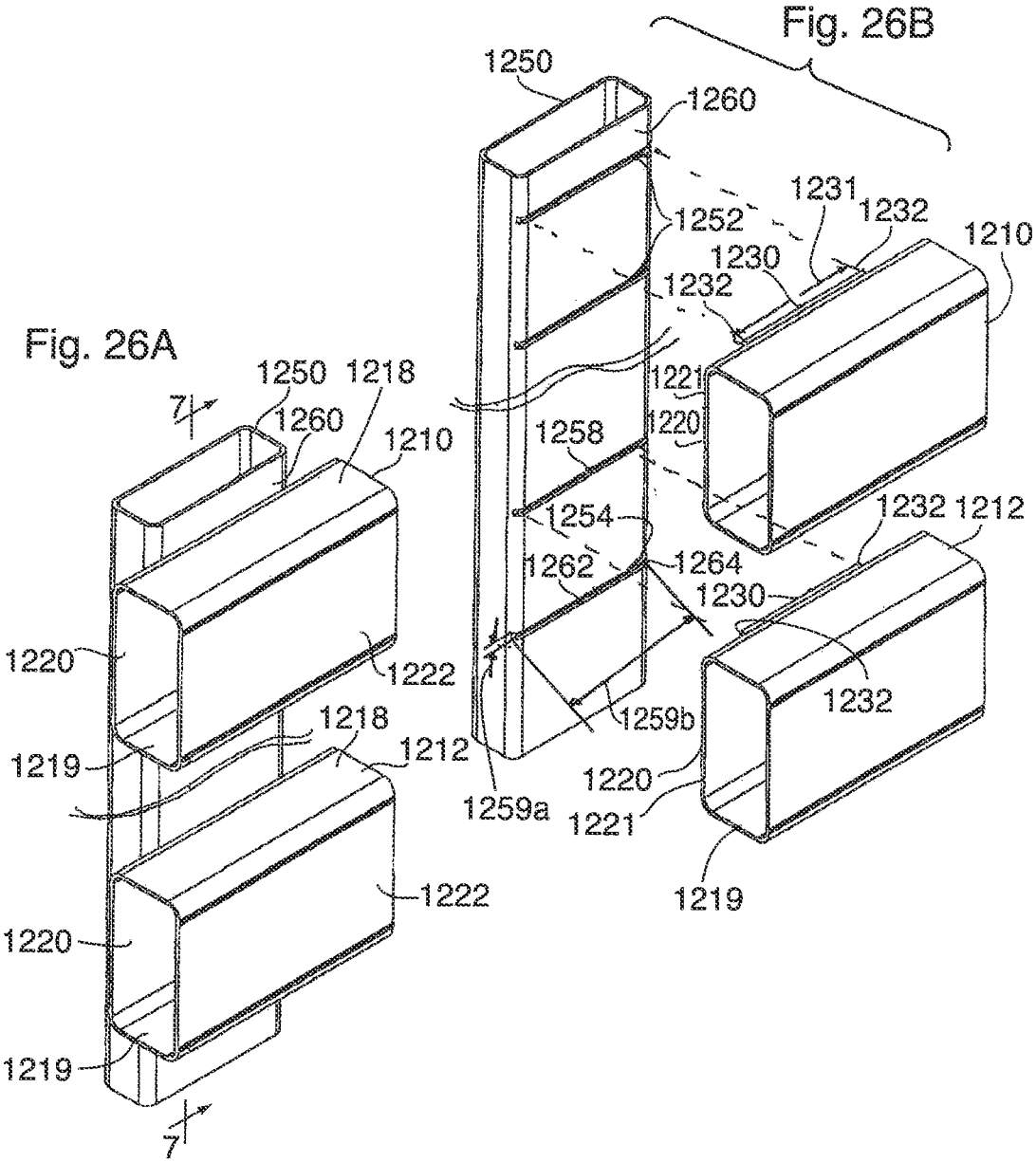
FIG. 26A is a perspective view of a portion of a fence section.
FIG. 26B is an exploded view of the fence section of FIG. 26*a;*

Fence section 1200 also includes a plurality of vertical members 1250 extending between the upper and lower horizontal rails 1210, 1212. Referring to FIG. 26B, each vertical member 1250 includes a pair of upper slots 1252 and a pair lower slots 1254 corresponding to the attachment legs 1230 of the upper and lower rails 1210, 1212 respectively. The attachment legs 1230 of the upper and lower rails 1210, 1212 are received within their corresponding slots 1252, 1254 to secure each vertical member 1250 to the upper and lower horizontal rails 1210, 1212. The connection between the attachment legs 1230 and the slots 1252, 1254 can provide the only attachment between the rails 1210, 1212 and the vertical members 1250. In these examples no additional mechanical or chemical fasteners are used to secure the vertical members 1250 to the rails 1210, 1212. In other examples, the connection between the attachment legs 1230 and the slots 1252, 1254 (or the members of other examples described herein) may be supplemented using known chemical or mechanical fasteners including, for example, but not limited to, glue, screws, nails, bolts, welding or adhesive tape.

Figure 25:
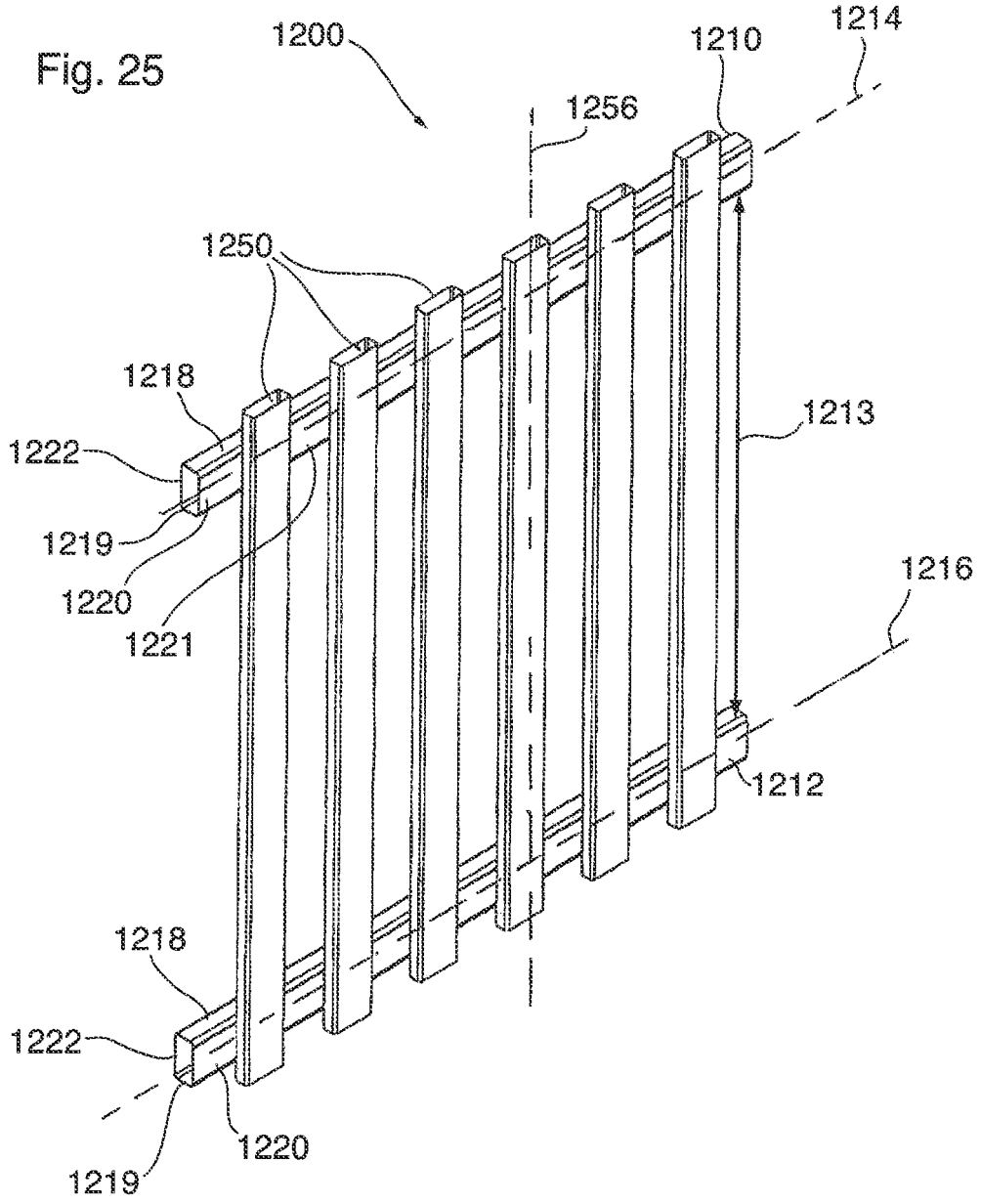
FIG. 25 is a perspective view of another example of a fence section.

Referring to FIG. 25, each of the vertical members 1250 defines and extends along a respective vertical axis, for example vertical axis 1256. The vertical members 1250 are extruded lineals that each have the same extruded cross section. In some examples each vertical member 1250 may be extruded as a separate member; in other examples the vertical members 1250 may each be cut to length from a single, longer extruded member. The vertical axis of each vertical member generally coincides with the extrusion direction of the vertical members. The upper and lower slots 1252, 1254 of the vertical members 1250 extend generally perpendicular to the axis 1256.

With reference to FIG. 26*b*, the upper and lower slots 1252, 1254 in the example illustrated each form an opening 1258 that extends through a sidewall 1260 on each vertical member 1250. Each opening 1258 includes and is defined by a pair of opposed slot edge faces 1262 and a pair of opposed slot end faces 1264, each slot edge face 1262 and each slot end face 1264 extending laterally from an outer surface 1266 of the sidewall 1260 to an inner surface 1268 of the sidewall 1260 (shown in FIG. 27) The slot edge faces 1262 are generally parallel to each other.

In some examples the slots 1252, 1254 can be cut into the sidewall 1260 so that the slot faces 1262, 1264 are generally orthogonal to the outer surface 1266 of the sidewall 1260. Such slots 1252, 1254 may be created by plunge cutting the vertical members 1250 using a saw blade that is generally orthogonal to the sidewalls 1260. In other examples, the slots 1252, 1254 are cut into the sidewall 1260 so that the slot edge faces 1262 are at an oblique angle relative to the outer surface 1266. The slot end faces 1264 are parallel to each other and are spaced apart by a slot length 1259*b* and the slot edge faces 1262 are spaced apart by a slot height 1259*a*.

Referring to FIG. 26B, each attachment leg 1230 comprises opposing attachment leg end faces 1232 spaced apart by an attachment leg length 1231. The attachment leg length 1231 is generally equal to, but slightly less than the slot length 1259*b* of the corresponding slot 1252, 1254 so that the attachment leg end faces 1232 can closely fit between the slot end faces 1264 without interfering with the slot end faces 1264 so that the attachment leg 1230 can be inserted into its slot 1252, 1254.

Figure 27A:
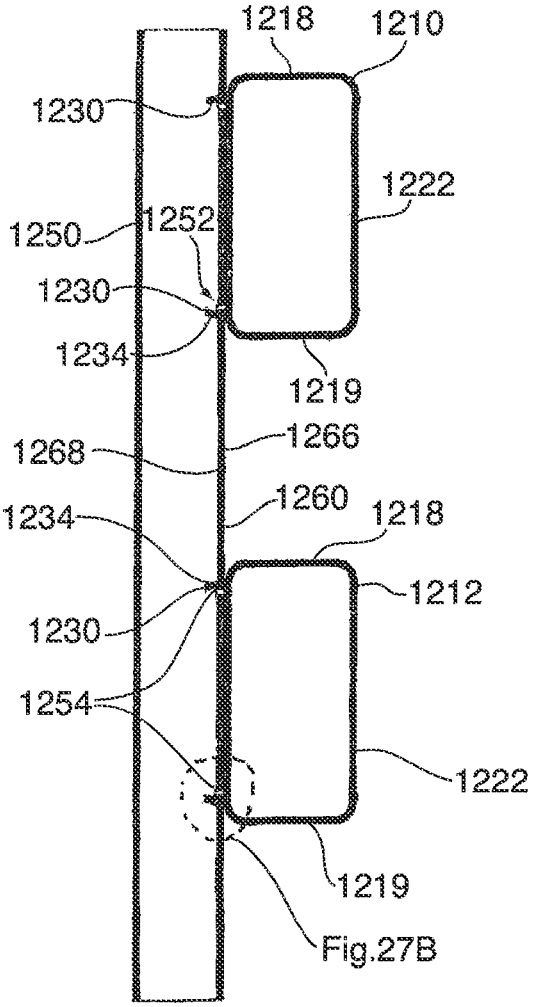
FIG. 27A is a section view of the fence section of FIG. 26*a;*
Figure 27B:
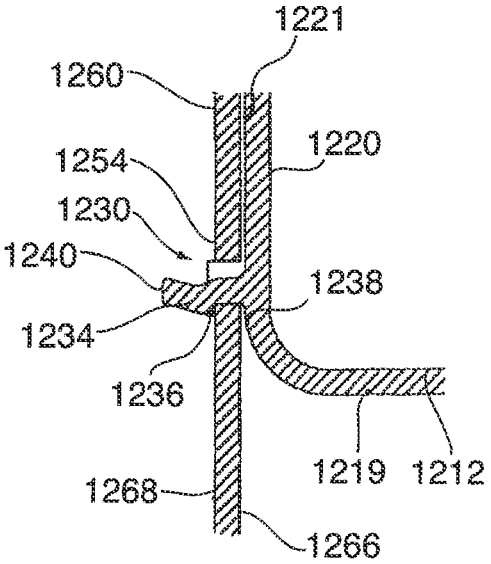
FIG. 27B is a detail view of a portion of FIG. 27.

Referring to FIGS. 27A and 27B, each attachment leg 1230 includes a barb 1234. The barb 1234 includes an abutment surface 1236 that engages and bears against a portion of the inner surface 1267 of the sidewall 1260 adjacent or proximate the slot 1252, 1254 into which the attachment leg 1230 is received. When an attachment leg 1230 is fully inserted into its slot 1252, 1254 the engagement between the abutment surface 1236 of the barb 1234 and the inner surface of the sidewall 1268 tends to retain the attachment leg 1230 within the slot 1252, 1254 and resist removal therefrom.

Referring to FIG. 27B, the upper and lower rails 1210, 1212 also include a base surface 1238. Each attachment leg 1230 formed on the rail 1210, 1212 extends from the base surface 1238 and each base surface 1238 generally opposes the abutment surfaces 1236 of the attachment legs 1230 extending therefrom. The base surface 1238 is generally spaced apart from the abutment surfaces 1236 by a distance that is greater than the thickness of the sidewalls 1260 of the vertical members 1250. As illustrated, when an attachment leg 1230 is fully inserted into its slot 1252, 1254 the barb 1234 will be positioned inside the hollow interior of the vertical member 1260 and its abutment surface 1236 will engage the inner surface of the vertical member 1260. As described above, the base surface 1238 of each rail 1210, 1212 is opposed to and offset from the abutment surface

1236 so that the base surface 1238 will simultaneously engage the outer surface 1266 of the sidewall 1260 when the abutment surface 1236 engages the inner surface 1268. In other examples, the offset between the abutment surface 1236 and the base surface 1268 may be greater than the thickness of the sidewall 1260. The relative size and shape of the barb 1234 may be chosen to provide the insertion and removal performance desired by the user.

Each attachment leg 1230 may also be resilient, or include some resilient portions, so that it is moveable between a first position for inserting the attachment leg 1230 and barb 1234 through its slot 1252, 1254 and a second position for retaining (or securing or locking) the attachment leg 1230 within its slot 1252, 1254. When the attachment leg 1230 is in its first or insertion position the barb 1234 can be passed through the slot 1252, 1254 from outside the vertical member 1250 to inside the hollow interior of the vertical member 1250. To facilitate insertion of the attachment leg 1230 and barb 1234, an angled portion of the barb 1234 (extending from the leading edge 1240 to the abutment surface 1236 in the example shown) may engage a slot edge face 1262 and act as a cam surface to guide the barb 1234 as it is inserted, as described in detail above with respect to fence section 1100. When the attachment leg 1230 is in the second position the abutment surface 1236 engages the inner surface 1268 of the sidewall 1260. The resilient nature of the attachment leg 1230 biases the attachment leg 1230 is second position.

In the example of the fence section 1200 illustrated in FIGS. 25 to 29 (FIG. 29 only shows horizontal rail 1210, however, horizontal rail 1212 is arranged in substantially the same manner), both horizontal rails 1210, 1212 have a common extruded profile (also referred to as a first extruded lineal) that is formed by spaced apart top and bottom walls 1218, 1219 connected by integrally formed first and second rail sidewalls 1220, 1222 forming a generally rectangular channel.

In one example, as illustrated in FIGS. 25 to 27A, the attachment legs 1230 on each rail 1210, 1212 all extend from the outer surface 1221 of the first rail sidewall 1220. In this example, the vertical members 1230 are all attached on the same side of the horizontal rails 1210, 1212 creating a single-sided fence section.

Figure 28A:
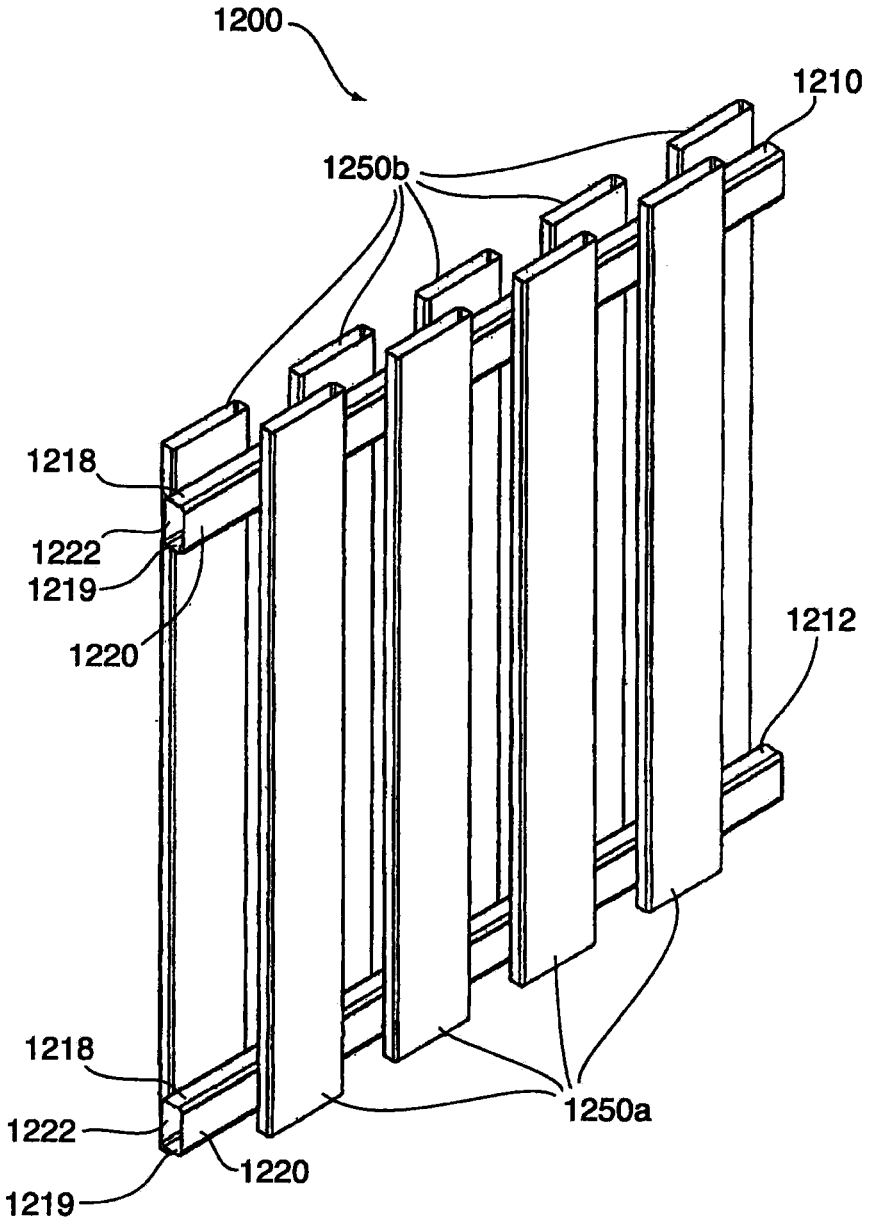
FIG. 28A is a perspective view of another example of a fence section.
Figure 28B:
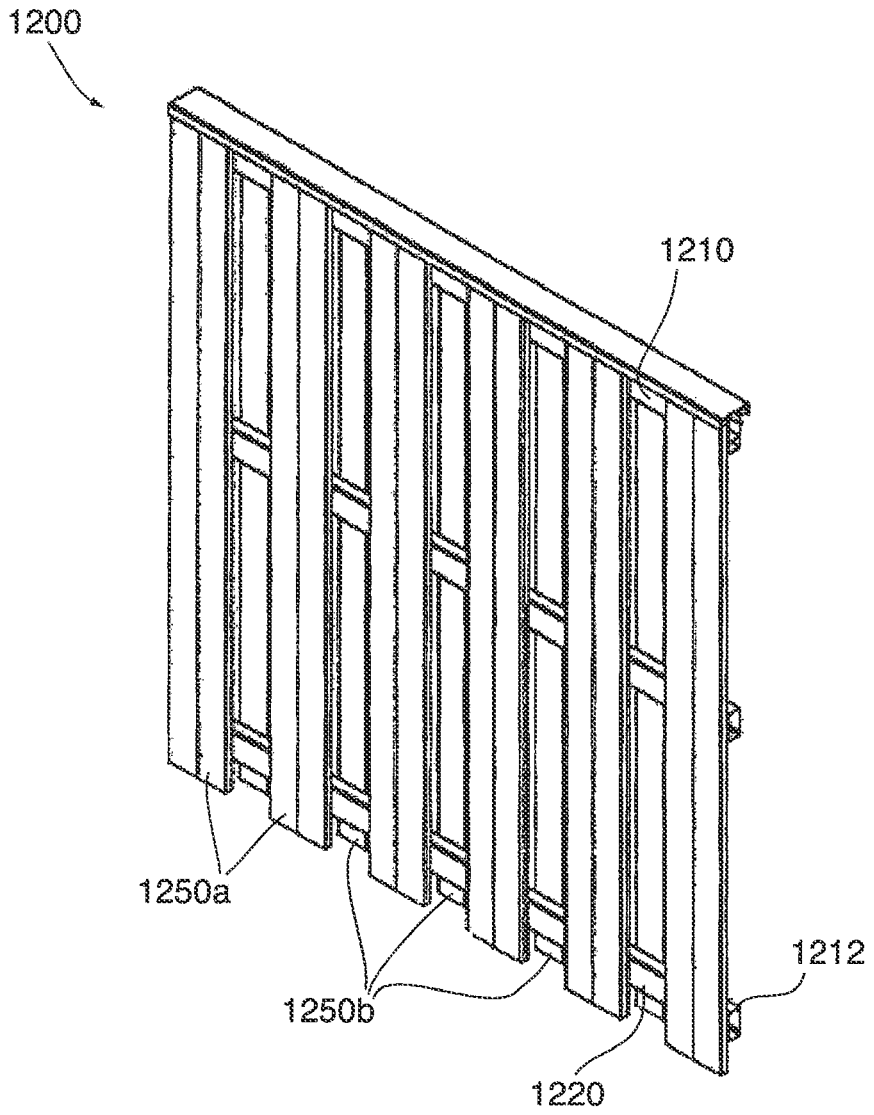
FIG. 28B is a perspective view of another example of a fence section.
Figure 29:
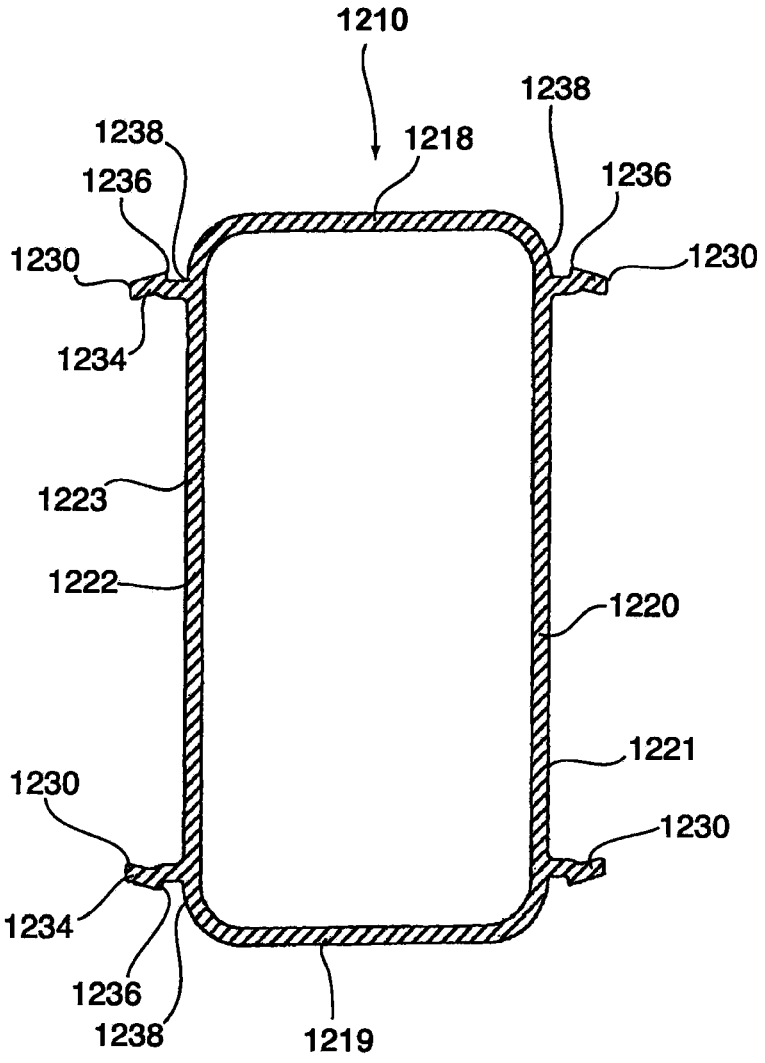
FIG. 29 is an end view of another example of a rail.

In another example, as illustrated in FIGS. 28A, 28B, and 29, the upper and lower rails 1210, 1212 may be configured to include attachment legs 1230 extending from the outer surface 1221 of rail sidewall 1220 as well as including additional attachment legs 1230 extending from an outer surface 1223 of the second rail sidewall 1222. In this example, the plurality of vertical members 1250 can be described as first and second sets or groups of vertical members 1250*a*, 1250*b*. Each set of vertical members 1250*a*, 1250*b* being attached on opposite sides of the rails 1210, 1212.

In this configuration, the attachment legs 1230 extending from the first rail sidewall 1220 of the upper and lower horizontal rails 1210, 1212 are received within and connected to the corresponding upper and lower slots 1252, 1254 of the vertical members 1250 in the first set of vertical members 1250*a* thereby securing each vertical member in the first set of vertical members 1250*a* adjacent the first sidewall of both horizontal side rails. Similarly, the attachment legs 1230 extending from the second sidewall 1222 of the upper and lower horizontal rails 1210, 1212 are received within and connected to the corresponding upper and lower slots 1252, 1254 of the vertical members 1250 in the second set of vertical members 1250*b*, thereby securing each vertical member 1250 in the second set of vertical members 1250*b* on the opposite side of the rails 1210, 1212 from the first set of vertical members 1250*a*, adjacent the second sidewall 1222 of both horizontal side rails 1210, 1212. When assembled in this configuration, the fence section 1200 can be described as a double-sided fence.

In the double-sided configuration, the first and second sets of vertical members 1250*a*, 1250*b* can be arranged to directly oppose each other, or, as illustrated in FIG. 28, the vertical members 1250 from the first and second sets of vertical members 1250*a*, 1250*b* can be arranged in an alternating (or staggered or offset) sequence along the length of the upper and lower horizontal rails 1210, 1212. The first and second sets 1250*a*, 1250*b* can also be arranged in pairs in an alternating sequence, as shown in FIG. 28B.

In either the single-sided or double-sided configurations the attachment legs 1230 have an attachment leg length 1231 (the distance between opposing attachment leg end faces 1232, shown in FIG. 26B) that is generally equal to the slot length 1259*b* so that the translation (or moving or shifting) of each vertical member 1250 relative to the upper and lower horizontal rails 1210, 1212 along the upper and lower rail axes 1214, 1216 is inhibited when the attachment leg 1230 is received its slot 1252, 1254. Having the close or tight fit between the attachment legs 1230 and the slots 1252, 1254 may prevent the fence section 1200 from rattling (for example when exposed to wind) and may help maintain the desired spacing between vertical members 1250 for aesthetic and/or privacy purposes.

In each of the examples of fence sections described above, the attachment of the vertical members 1250 to the upper and lower horizontal rails 1210, 1212 includes only the connection between the attachment legs 1230 and the slots 1252, 1254 and is free from other fastening means. The connection between the attachment legs 1230 and the slots 1252, 1254 is a press-fit or snap-fit connection wherein an attachment leg 1230 is aligned with a corresponding slot 1252, 1254 and an insertion force is applied (by a user or during the manufacturing process) to push the attachment leg 1230 (including barb 1234) completely into its slot 1252, 1254. During insertion process the attachment leg 1230 (or a portion thereof) may deflect or bend as it passes through its slot 1252, 1254 and then "snap back" or return to its original position to positively engage a portion of the vertical member 1230 and retain the attachment leg 1230 within its slot 1252, 1254 once fully inserted. Fully inserted is understood to mean inserted to the extent necessary for the attachment leg 1130, 1230 to operatively or positively engage its slot 1252, 1254 so as to be retained therein to functionally secure the vertical members 1150, 1250 to the rails 1110, 1112, 1210, 1212. In the examples described, the attachment legs 1130, 1230 may be considered fully inserted when the they have been inserted to the point where abutment surface 1136, 1236 of the barb 1134, 1234 engages the inner surface 1168, 1268 of the vertical member sidewall 1160, 1260. When a functional or operational engagement between the vertical members and the rails is achieved an attachment leg 1130, 1230 may be considered fully inserted, even if a portion of the attachment leg 1130, 1230 extends beyond the outer sidewall surface 1168, 1268 such that a portion of the attachment leg is visible to the user after the fence sections have been assembled and the vertical members are slightly spaced from the rails.

Generally, a method for assembling a fence section using the snap-fit connectors described above includes providing a first and second horizontal rails that are parallel to, and spaced apart from each other. Both the first and second rails include at least one integrally formed attachment leg extending therefrom. In addition to the first and second rails the assembly method includes providing a plurality of vertical members. The size and shape of the vertical members may be dictated by user preferences or by the style of fence section being created (for example fence sections 1100, 1200). Each vertical member provided includes at least one upper slot formed in a sidewall for receiving one attachment leg from the first horizontal rail and at least one lower slot formed in the sidewall for receiving one attachment leg from the second horizontal rail. Depending on the fence style selected the upper and lower slots may be formed on the same sidewall or on opposing sidewalls. The fence panel is then assembled by connecting each vertical member to the first and second horizontal rails by inserting each attachment leg on the first horizontal rail into a corresponding upper slot on each of the vertical members and inserting each attachment leg on the second horizontal rail into the corresponding lower slot on each on each vertical member.

Referring to FIGS. 30A to 31*c*, another example of a barb 1334 is shown. The barb 1334 is an alternative to the barbs 1134, 1234 described above and is suitable for use with the members of fence sections 1100 and 1200. For the purpose of describing barb 1334 the like features of the horizontal rails and vertical members of fence sections 1100 and 1200 are identified by like reference characters, incremented by 100 and 200 respectively. In the example illustrated the barb 1334 is formed on the attachment leg 1330 of an upper rail 1310 that most closely resembles upper rail 1110. However, it is understood that the barb 1334 could be used on lower rail 1112 (as the rails 1110, 1112 have a common extruded profile), on the rails 1210, 1212 of fence section 1200 and on the attachment legs of the connection structure 1400 described below.

Referring to FIGS. 30A and 30B, the upper rail 1310 includes an upper wall 1318, first and second rail sidewalls 1320, 1322 and attachment legs 1330. Like rail 1110 described in detail above, the attachment legs 1330 extend from rail sidewalls 1320, 1322 for engaging the upper slots 1352 of vertical members 1350. Each attachment leg 1330 includes a barb 1334 at is free or distal end (the end spaced away from the rail sidewall 1320, 1322). Each barb 1334 includes a resilient retaining member 1335 (or tab or locking member) that is movably connected to the attachment leg 1330 near the leading edge 1340. The resilient retaining member 1335 is moveable between an insertion position, in which the retaining member 1335 is collapsed (or retracted or folded) against (or positioned in close proximity too without actually touching) the attachment leg 1330, and a retention position, in which the retaining member 1335 is upstanding (at an angle 1341 between 0 and 90 degrees) and extends away from the attachment leg 1330.

Figure 31A:
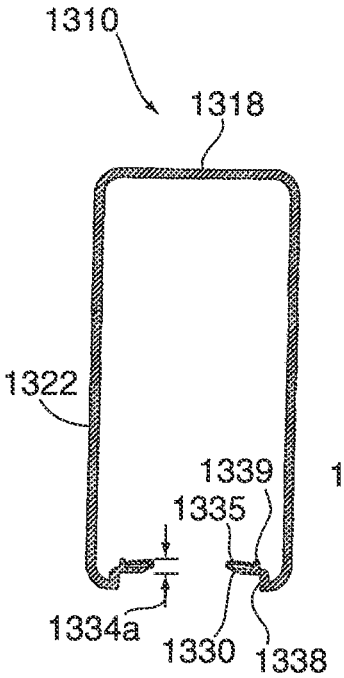
FIG. 31A is an end view of a rail of FIG. 30 with the resilient barb in the insertion position.
Figure 31B:
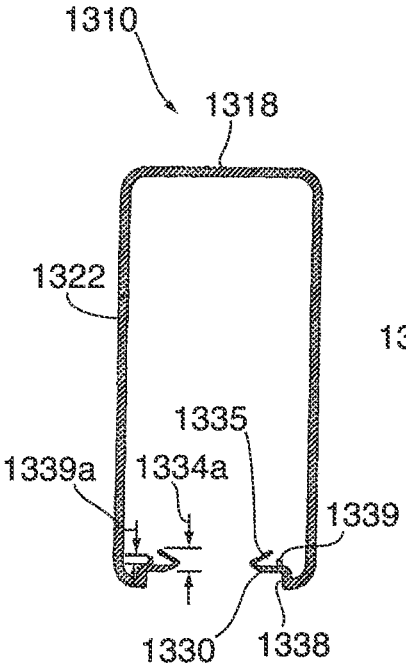
FIG. 31B is an end view of a rail of FIG. 30 with the resilient barb in the retention position.
Figure 31C:
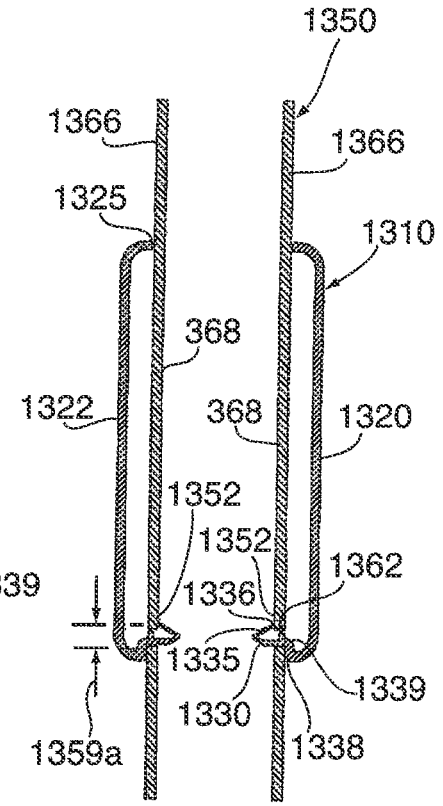
FIG. 31C is an end view of a rail of FIG. 30 connected to a vertical member and having the resilient barb in the retention position.

When the resilient retaining member 1335 is in the insertion position (as best shown in FIG. 31*a*) the barb 1334 has a barb height 1334*a* that is less than the slot height 1359*a* to allow insertion of the barb 1334 through the slot 1352. When the resilient retaining member 1335 is in the retention position (as best shown in FIGS. 31*b* and 31*c*) the barb has a barb height 1334*a* that is greater than the slot height 1359*a* so that the attachment leg 1330 cannot easily pass back through the slot 1352. Each resilient retaining member 1335 is biased toward the retention position so that the retaining members 1335 will automatically move from the insertion position to the retention position when fully inserted into the slots.

The resilient retaining member 1335 of each barb 1334 forms the abutment surface 1336 and when the attachment leg 1330 is fully inserted in its slot (as defined above) the resilient retaining member 1335 moves to the retention position so that the abutment surface 1336 engages the inner surface 1368 of the vertical member sidewall 1360. In the examples illustrated, when the retaining member 1335 is inserted and moved to the retention position the base surface 1338 of the rail 1310 contacts the outer surface 1366 of the vertical member sidewall 1360.

In some examples, the contact between the retaining member 1335 and the base surface 1338 and the inner and outer surfaces 1366, 1368 of the vertical member sidewall 1360 creates a satisfactory connection between the rails and the vertical members. In other examples, as shown in FIGS. 31*a* to 31*c*, the retaining leg 1330 may include a protrusion or projection 1339. The protrusion 1339 extends away from the attachment leg 1330 and is position intermediate the resilient retaining member 1335 and the base surface 1338. Each protrusion 1339 has a protrusion height 1339*a* (shown in FIG. 31B) that is approximately the same as, but slightly less than, the slot height 1359*a* allowing the protrusion 1339 to closely fit within the slot 1352. Each protrusion is registered with one slot edge face 1362 when the attachment leg 1330 is fully received in the slot 1352. This configuration allows the attachment leg 1330 to be inserted into the slot 1352 and inhibits vertical displacement between the vertical members 1350 and upper 1310 and lower rails (as shown in FIG. 31*c*) as the projection 1339 is closely received within the slot 1352 and will contact the slot edge surface 1362 if the rail 1310 is moved vertically with respect to the vertical member 1350, or vice versa.

Figure 31D:
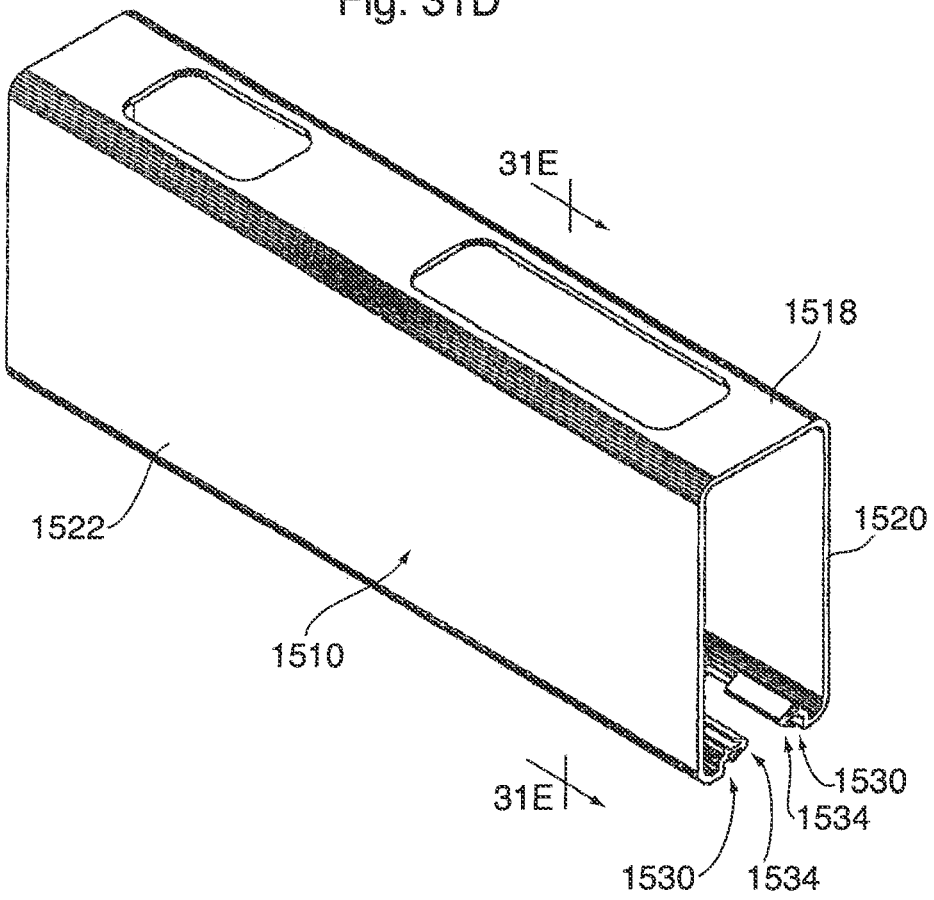
FIG. 31D is a perspective illustration of another example of a rail.
Figure 31E:
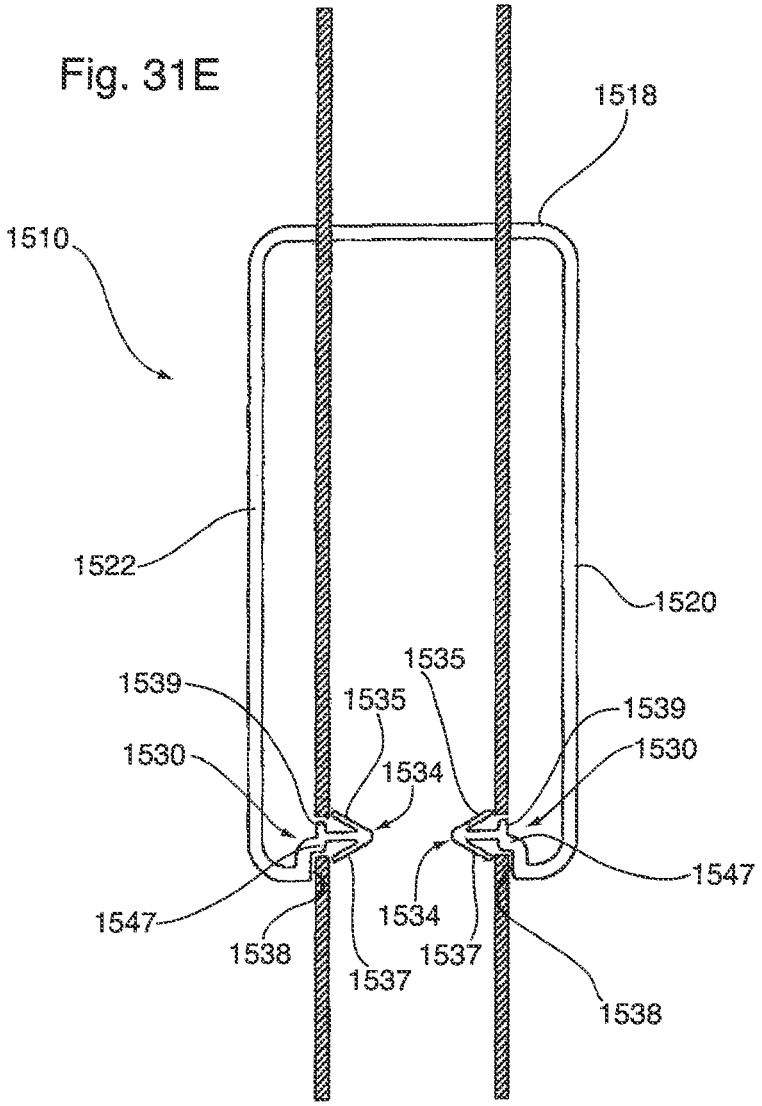
FIG. 31E is a cross section taken along line 31E-31E in FIG. 31D, and further including a vertical member mounted to the rail.

Referring now to FIGS. 31D and 31E, another example of a barb 1534 is shown. The barb 1534 is similar to the barb 1334, described hereinabove, and like features in FIGS. 31D and 31E are identified by like reference numerals as in FIGS. 30 to 31C, incremented by 200. The barb 1534 includes a resilient retaining member 1535 that is movably connected to the attachment leg 1530 near the leading edge 1540, and extends generally upwardly from the leading edge 1540. The barb 1534 further includes a second resilient retaining member 1537, which is configured similarly to the retaining member 1535, but extends downwardly from the leading edge 1540. The second resilient retaining member 1537 functions in a substantially similar manner to the resilient retaining member 1534, as described with respect to FIGS. 30 to 31C.

Similarly to the example of FIGS. 30 to 31C, the retaining leg 1530 of FIGS. 31D and 31E includes a protrusion 1539, which extends away from the attachment leg 1530. The example of FIGS. 31D and 31E further includes a shoulder 1547 opposed to the protrusion 1539. The shoulder 1547 and the protrusion 1539 cooperate to centre the barb 1534 with respect to the slot.

Figure 32:
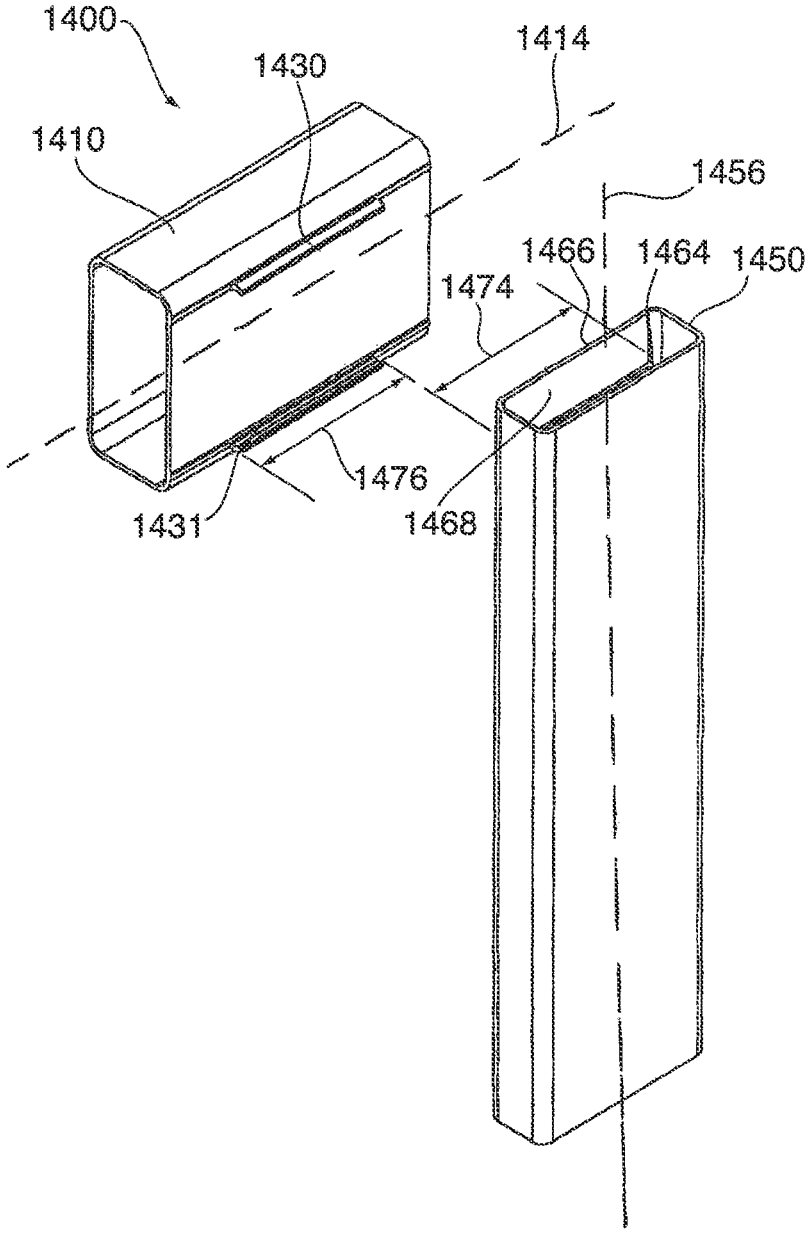
FIG. 32 is a perspective view of a connection structure for use with a fence section.
Figure 33:
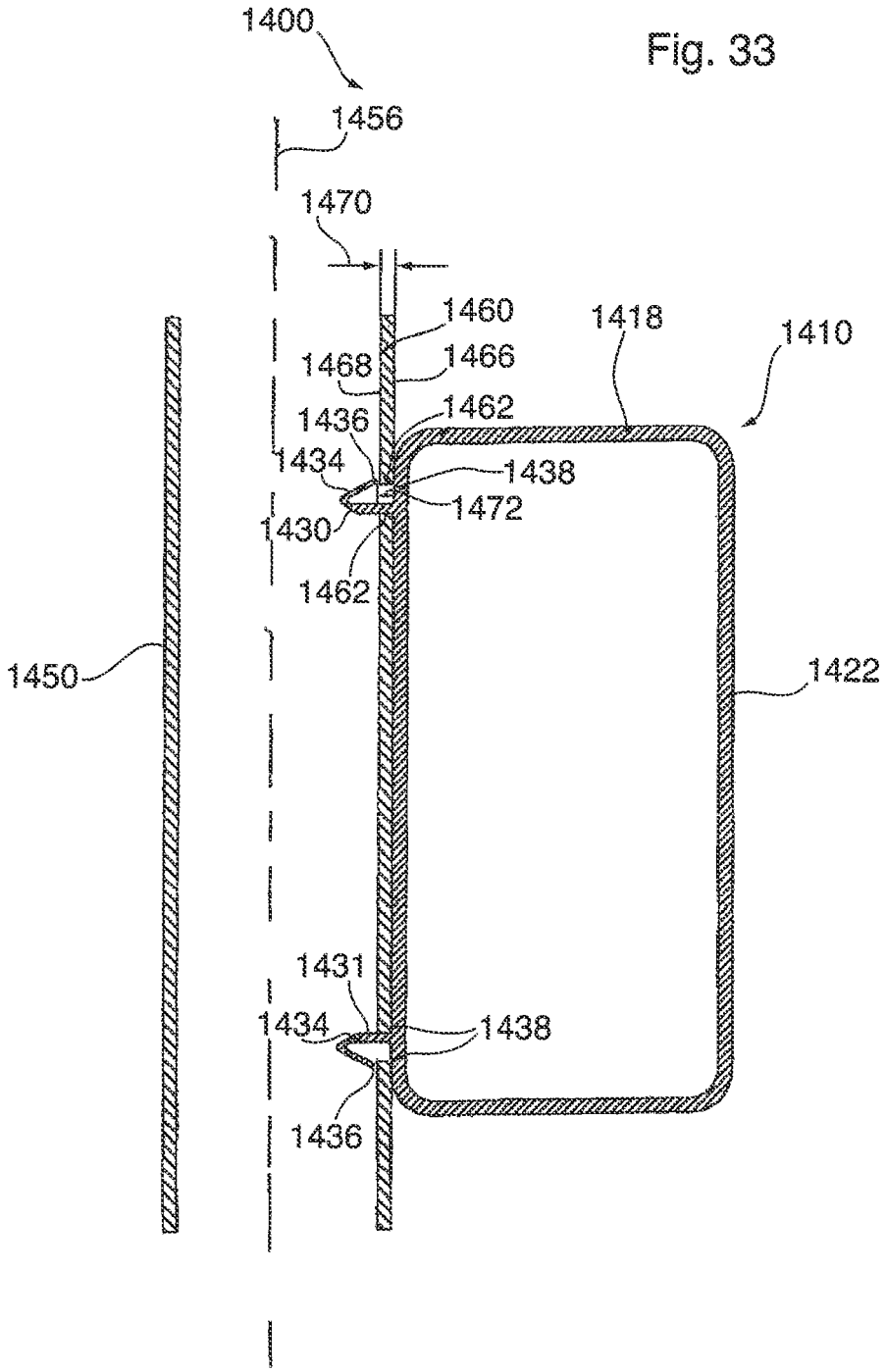
FIG. 33 is a partial section view of the connection structure of FIG. 32.

Referring now to FIGS. 32 and 33, an example of a connection structure 1400 for connecting members of a fence or other structure, for example fence sections 1100 and 1200, is shown comprising a first extruded lineal 1450 and a second extruded lineal 1410. The first extruded lineal 1450 extends lengthwise along a first longitudinal axis 1456 and has a sidewall 1460 with at least one slot 1452 (also referred to as a first slot) formed in the sidewall 1460. In the example illustrated the first slot 1452 extends generally perpendicular to the longitudinal axis 1456. In other examples the slot 1452 may be at an oblique angle relative to the longitudinal axis 1456, for example 30 degrees or 45 degrees.

The second extruded lineal 1410 extends lengthwise along a second longitudinal axis 1414 and includes an attachment leg 1430 (also referred to as a first attachment leg) corresponding to the slot 1452. The attachment leg 1430 extends outward from the second extruded lineal 1410 and is generally parallel to the second longitudinal axis 1414. The first attachment leg 1452 is integrally formed with the second extruded lineal 1410 and is inserted into or received within in the first slot 1452 to secure the first extruded lineal 1450 to the second extruded lineal 1410.

Optionally, as shown in FIGS. 32 and 33, the first extruded lineal 1450 includes a second slot 1453. The second slot 1453 is generally parallel to, and spaced apart from, the first slot 1452. In this example, the second extruded lineal 1410 has a corresponding second attachment leg 1431 that is parallel to the first attachment leg 1430 and is received in the second slot 1453 when the first and second lineals 1450, 1410 are connected.

In the single-slot and double-slot examples, each slot 1452, 1453 forms an opening that extends through the sidewall 1460. Each opening or slot 1452, 1453 has opposed slot edge faces 1462 and opposing slot end faces 1464. The slot edge faces 1462 and slot end faces 1464 extending through the sidewall 1460 from the outer surface 1466 of the sidewall 1460 to the inner surface 1468 of the sidewall 1460.

In the example illustrated, the slot edge faces 1462 are parallel to each other and perpendicular to the outer surface 1466 of the sidewall 1460 and the first longitudinal axis 1456. In another example, the slot edge faces 1462 are at an oblique angle relative to the first longitudinal axis 1456 (for example the slot edge faces 1162 and 1262 described above).

Each attachment leg 1430, 1431 has a distal portion spaced apart from the second extruded lineal 1410 and a barb 1434 that extends from the distal portion. Each barb 1434 includes an abutment surface 1436 that engages and bears against a portion of the inner surface 1468 of the sidewall 1460 that is adjacent the slot 1452, 1453 into which the attachment leg 1430, 1431 is received. This engagement between the abutment surface 1436 and the inner sidewall surface 1468 may help to retain the attachment leg 1430, 1431 within its slot 1452, 1453 when the attachment leg 1430, 1431 is fully inserted into its slot 1452, 1453.

The second extruded lineal 1410 also includes a base surface 1438 that cooperates with the abutment surface 1436 to secure the second extruded lineal 1410 to the first extruded lineal 1450. Each attachment leg 1430, 1431 extends from the base surface 1438 and the base surface 1438 generally opposes the abutment service 1436 (either physically—i.e. the surfaces are facing each other, or operationally/functionally—i.e. the abutment surface and the base surface exert generally opposing forces on the first extruded lineal) and is spaced apart from the abutment surface 1436 by a distance 1472 that is greater than the thickness T of the first extruded lineal sidewall 1460.

The slot end faces 1464 are spaced apart by a first width 1474 (also referred to as a slot width) and the attachment legs 1430, 1431 received within each slot 1452, 1453 second width 1476. The second width 1476 is generally equal to, but at least slightly shorter than, the first width 1474 so the attachment legs 1430, 1431 can fit within the slots 1452, 1453 but translation or sliding of the first extruded lineal 1450 relative to the second extruded lineal 1410 along the second longitudinal axis 1414 is inhibited when the attachment legs 1430, 1431 are received in their slots 1452, 1453.

While the above description provides examples of one or more processes or apparatuses in accordance with the applicant's contribution to the state of the art as disclosed herein, it will be appreciated that other processes or apparatuses may be within the scope of such contribution, and any exclusive right that may be granted to the applicants in respect of such contribution is not necessarily limited to the aforementioned examples as specifically described herein.

We claim:

1. A fence section, comprising:

an upper horizontal rail including a first longitudinally-extending wall extending lengthwise of the upper horizontal rail and laterally between first and second upper rail sidewalls that depend from the first longitudinally-extending wall and are spaced apart from one another to define an upper rail cavity, wherein the first longitudinally-extending wall includes a plurality of upper rail apertures;

a lower horizontal rail, spaced vertically below the upper horizontal rail, including a second longitudinally-extending wall extending lengthwise of the lower horizontal rail and laterally between first and second lower rail sidewalls that depend from the first longitudinally-extending wall and are spaced apart from one another to define a lower rail cavity, wherein the second longitudinally-extending wall includes a plurality of lower rail apertures; and a plurality of vertical members;

wherein:

for at least one of the plurality of vertical members:

the vertical member is connected to the upper horizontal rail by an upper connection system and to the lower horizontal rail by a lower connection system;

wherein:

the upper connection system includes a first upper connecting structure and a second upper connecting structure; and the lower connection system includes a first lower connecting structure and a second lower connecting structure;

wherein:

the first upper rail sidewall includes a first upper counterpart of the first upper connecting structure, and the vertical member includes a second upper counterpart of the first upper connecting structure;

the second upper rail sidewall includes a first upper counterpart of the second upper connecting structure, and the vertical member includes a second upper counterpart of the second upper connecting structure;

the first lower rail sidewall includes a first lower counterpart of the first lower connecting structure, and the vertical member includes a second lower counterpart of the first lower connecting structure;

the second lower rail sidewall includes a first lower counterpart of the second lower connecting structure, and the vertical member includes a second lower counterpart of the second lower connecting structure;

the second upper counterpart of the first upper connecting structure, the second upper counterpart of the second upper connecting structure, the second lower counterpart of the first lower connecting structure, the second lower counterpart of the second lower connecting structure and the vertical member are integrally formed within a unitary one-piece construction;

and for the upper connection system, the connection of the vertical member to the upper horizontal rail is effected by:

(i) a first upper interaction between the first upper counterpart of the first upper connecting structure and the second upper counterpart of the first upper connecting structure, and (ii) a second upper interaction between the first upper counterpart of the second upper connecting structure and the second upper counterpart of the second upper connecting structure;

for the lower connection system, the connection of the vertical member to the lower horizontal rail is effected by:

(i) a first lower interaction between the first lower counterpart of the first lower connecting structure and the second lower counterpart of the first lower connecting structure, and (ii) a second lower interaction between the first lower counterpart of the second lower connecting structure and the second lower counterpart of the second lower connecting structure;

the vertical member extends through the upper horizontal rail via a respective upper rail aperture and the lower horizontal rail via a respective lower rail aperture;

the vertical member and the upper horizontal rail are co-operatively configured such that establishing of the connection by the upper connection system is effected in response to insertion of the vertical member through the upper horizontal rail via the respective rail aperture;

the vertical member and the lower horizontal rail are co-operatively configured such that establishing of the connection by the lower connection system is effected in response to insertion of the vertical member through the lower horizontal rail via the respective rail aperture;

and for the upper connection system, (i) at least one of (a) the first upper counterpart of the first upper connecting structure, and (b) the second upper counterpart of the first upper connecting structure, is resiliently deformable, such that at least one of the first upper counterpart of the first upper connecting structure and the second upper counterpart of the first upper connecting structure is deflected while the inserting is being effected, and (ii) at least one of (a) the first upper counterpart of the second upper connecting structure, and (b) the second upper counterpart of the second upper connecting structure, is resiliently deformable, such that at least one of the first upper counterpart of the second upper connecting structure and the second upper counterpart of the second upper connecting structure is deflected while the inserting is being effected, and for the lower connection system, (i) at least one of (a) the first lower counterpart of the first lower connecting structure, and (b) the second lower counterpart of the first lower connecting structure, is resiliently deformable, such that at least one of the first lower counterpart of the first lower connecting structure and the second lower counterpart of the first lower connecting structure is deflected while the inserting is being effected, and (ii) at least one of (a) the first lower counterpart of the second lower connecting structure, and (b) the second lower counterpart of the second lower connecting structure, is resiliently deformable, such that at least one of the first lower counterpart of the second lower connecting structure and the second lower counterpart of the second lower connecting structure is deflected while the inserting is being effected;

while the connection of the vertical member to the upper horizontal rail is effected by: (i) the first upper interaction between the first upper counterpart of the first upper connecting structure and the second upper counterpart of the first upper connecting structure, and (ii) the second upper interaction between the first upper counterpart of the second upper connecting structure and the second upper counterpart of the second upper connecting structure:

the first upper counterpart of the first upper connecting structure and the second upper counterpart of the first upper connecting structure are co-operatively configured to oppose a deflection, of at least one of the first upper counterpart of the first upper connecting structure and the second upper counterpart of the first upper connecting structure, that is effective for defeating the first upper interaction; and the first upper counterpart of the second upper connecting structure and the second upper counterpart of the second upper connecting structure are co-operatively configured to oppose a deflection, of at least one of the first upper counterpart of the second upper connecting structure and the second upper counterpart of the second upper connecting structure, that is effective for defeating the second upper interaction; and while the connection of the vertical member to the lower horizontal rail is effected by: (i) the first lower interaction between the first lower counterpart of the first lower connecting structure and the second lower counterpart of the first lower connecting structure, and (ii) the second lower interaction between the first lower counterpart of the second lower connecting structure and the second lower counterpart of the second lower connecting structure:

the first lower counterpart of the first lower connecting structure and the second lower counterpart of the first lower connecting structure are co-operatively configured to oppose a deflection, of at least one of the first lower counterpart of the first lower connecting structure and the second lower counterpart of the first lower connecting structure, that is effective for defeating the first lower interaction; and the first lower counterpart of the second lower connecting structure and the second lower counterpart of the second lower connecting structure are co-operatively configured to oppose a deflection, of at least one of the first lower counterpart of the second lower connecting structure and the second lower counterpart of the second lower connecting structure, that is effective for defeating the second lower interaction.

2. The fence section of claim 1, wherein at least one of the first upper counterpart of the first upper connecting structure and the second upper counterpart of the first upper connecting structure is biased into the first upper interaction;

at least one of the first upper counterpart of the second upper connecting structure and the second upper counterpart of the second upper connecting structure is biased into the second upper interaction;

at least one of the first lower counterpart of the first lower connecting structure and the second lower counterpart of the first lower connecting structure is biased into the first lower interaction; and at least one of the first lower counterpart of the second lower connecting structure and the second lower counterpart of the second lower connecting structure is biased into the second lower interaction.

3. The fence section of claim 1, wherein each one of the upper and lower horizontal rails includes an extruded lineal of plastic material.

4. The fence section of claim 1, wherein:

the first upper counterpart of the first upper connecting structure is resiliently deformable between:

a first position for permitting the insertion of the vertical member through the upper horizontal rail via the respective upper rail aperture, and a second position for effecting the first upper interaction with the second upper counterpart of the first upper connecting structure;

and the first upper counterpart of the second upper connecting structure is resiliently deformable between:

a first position for permitting the insertion of the vertical member through the upper horizontal rail via the respective upper rail aperture, and a second position for effecting the second upper interaction with the second upper counterpart of the second supper connecting structure;

and the first lower counterpart of the first lower connecting structure is resiliently deformable between:

a first position for permitting the insertion of the vertical member through the lower horizontal rail via the respective lower rail aperture, and a second position for effecting the first lower interaction with the second lower counterpart of the first lower connecting structure;

and the first lower counterpart of the second lower connecting structure is resiliently deformable between:

a first position for permitting the insertion of the vertical member through the lower horizontal rail via the respective lower rail aperture, and a second position for effecting the second lower interaction with the second lower counterpart of the second lower connecting structure.

5. The fence section of claim 1, wherein for each one of the at least one vertical member: the connection of the vertical member to the upper horizontal rail is exclusively via the upper connection system, and the connection of the vertical member to the lower horizontal rail is exclusively via the lower connection system.

6. The fence section of claim 1, wherein:

the second upper counterpart of the first upper connecting structure includes a first upper slot;

the second upper counterpart of the second upper connecting structure includes a second upper slot;

the second lower counterpart of the first lower connecting structure includes a first lower slot;

the second lower counterpart of the second lower connecting structure includes a second lower slot;

the first upper interaction includes an extension of the first upper counterpart of the first upper connecting structure into the first upper slot;

the second upper interaction includes an extension of the first upper counterpart of the second upper connecting structure into the second upper slot;

the first lower interaction includes an extension of the first lower counterpart of the first lower connecting structure into the first lower slot; and the second lower interaction includes an extension of the first lower counterpart of the second lower connecting structure into the second lower slot.

7. A fence section comprising:

at least two horizontal rails, each one of the at least two horizontal rails including a longitudinally-extending wall extending lengthwise of the horizontal rail and laterally between first and second rail sidewalls that depend from the longitudinally-extending wall and are spaced apart from one another, wherein the longitudinally-extending wall includes at least one rail aperture;

and at least one vertical member;

wherein:

the at least two horizontal rails and the at least one vertical member are co-operatively configured such that, for at least one of the at least one vertical member:

the vertical member is connected to each one of the at least two horizontal rails by a respective connection system such that at least two connection systems are provided;

each one of the at least two connection systems includes a first connecting structure and a second connecting structure;

the first connecting structure includes a first counterpart that is connected to a second counterpart, wherein the first counterpart of the first connecting structure is defined by the first rail sidewall and the second counterpart of the first connecting structure is defined by the vertical member;

the second connecting structure includes a first counterpart that is connected to a second counterpart, wherein the first counterpart of the second connecting structure is defined by the second rail sidewall and the second counterpart of the second connecting structure is defined by the vertical member; and the second counterpart of the first connecting structure, the second counterpart of the second connecting structure and the vertical member are integrally formed within a unitary one-piece construction;

the connection of the first counterpart of the first connecting structure to the second counterpart of the first connecting structure is established by a first interaction between the first counterpart of the first connecting structure and the second counterpart of the first connecting structure, and the connection of the first counterpart of the second connecting structure to the second counterpart of the second connecting structure is established by a second interaction between the first counterpart of the second connecting structure and the second counterpart of the second connecting structure;

for each one of the at least two horizontal rails, the connection with the vertical member is established in response to insertion of the vertical member through the horizontal rail via a respective rail aperture, wherein:

at least one of: (a) the first counterpart of the first connecting structure and (b) the second counterpart of the first connecting structure is resiliently deformable, such that at least one of the first counterpart of the first connecting and the second counterpart of the first connecting structure is deflected while the inserting is being effected; and at least one of: (a) the first counterpart of the second connecting structure and (b) the second counterpart of the second connecting structure is resiliently deformable, such that at least one of the first counterpart of the second connecting structure and the second counterpart of the second connecting structure is deflected while the inserting is being effected;

while the connection of the first counterpart of the first connecting structure and the second counterpart of the first connecting structure is established by the first interaction, the first counterpart of the first connecting structure and the second counterpart of the first connecting structure are co-operatively configured to oppose a deflection, of at least one of the first counterpart of the first connecting structure and the second counterpart of the first connecting structure, that is effective for defeating the first interaction; and while the connection of the first counterpart of the second connecting structure and the second counterpart of the second connecting structure is established by the second interaction, the first counterpart of the second connecting structure and the second counterpart of the second connecting structure are co-operatively configured to oppose a deflection, of at least one of the first counterpart of the second connecting structure and the second counterpart of the second connecting structure, that is effective for defeating the second interaction.

8. The fence section of claim 7, wherein for each one of the at least two connection systems:

at least one of the first counterpart of the first connecting structure and the second counterpart of the first connecting structure is biased into the first interaction, and at least one of the first counterpart of the second connecting structure and the second counterpart of the second connecting structure is biased into the second interaction.

9. The fence section of claim 7, wherein for each one of the at least two connection systems:

the first counterpart of the first connecting structure is resiliently deformable between:

a first position for permitting the insertion of the vertical member, through the horizontal rail via the respective rail aperture, and a second position for effecting the first interaction with the second counterpart of the first connecting structure;

and the first counterpart of the second connecting structure is resiliently deformable between:

a first position for permitting the insertion of the vertical member, through the horizontal rail via the respective rail aperture, and a second position for effecting the second interaction with the second counterpart of the second connecting structure.

10. The fence section of claim 7, wherein for each one of the at least one vertical member: the connection of the vertical member to the at least two horizontal rails is exclusively via the at least two connection systems.

11. The fence section of claim 7, wherein the at least two horizontal rails are of plastic material and the at least one vertical member is of plastic material.

12. The fence section of claim 7, wherein:

the first counterpart of the first connecting structure and the first rail sidewall are integrally formed within a unitary one-piece construction; and the first counterpart of the second connecting structure and the second rail sidewall are integrally formed within a unitary one-piece construction.

13. The fence section of claim 7 wherein:

the second counterpart of the first connecting structure includes a first slot;

the second counterpart of the second connecting structure includes a second slot;

the first interaction includes an extension of the first counterpart of the first connecting structure into the first slot; and the second interaction includes an extension of the first counterpart of the second connecting structure into the second slot.

14. A kit for assembling a fence, comprising:

at least two horizontal rails, each one of the at least two horizontal rails including a longitudinally-extending wall extending lengthwise of the horizontal rail and laterally between first and second rail sidewalls that depend from the longitudinally-extending wall and are spaced apart from one another, wherein the longitudinally-extending wall includes at least one rail aperture; and at least one vertical member;

wherein:

the at least two horizontal rails and the at least one vertical member are co-operatively configured such that, for at least one of the at least one vertical member:

the vertical member is connectible to the at least two horizontal rails for obtaining an assembly wherein each one of the at least two horizontal rails is connected to the vertical member by a respective connection system such that at least two connection systems are provided;

each one the at least two connection systems includes a first connecting structure and a second connecting structure;

the first connecting structure includes a first counterpart that is connectible to a second counterpart, wherein the first counterpart of the first connecting structure is defined by the first rail sidewall and the second counterpart of the first connecting structure is defined by the vertical member;

the second connecting structure includes a first counterpart that is connectible to a second counterpart, wherein the first counterpart of the second connecting structure is defined by the second rail sidewall and the second counterpart of the second connecting structure is defined by the vertical member;

the second counterpart of the first connecting structure, the second counterpart of the second connecting structure, and the vertical member are integrally formed within a unitary one-piece construction;

the connection of the first counterpart of the first connecting structure to the second counterpart of the first connecting structure is establishable by a first interaction between the first counterpart of the first connecting structure and the second counterpart of the first connecting structure, and the connection of the first counterpart of the second connecting structure to the second counterpart of the second connecting structure is establishable by a second interaction between the first counterpart of the second connecting structure and the second counterpart of the second connecting structure;

for each one of the at least two horizontal rails, the connection with the vertical member is establishable in response to insertion of the vertical member through the horizontal rail via a respective rail aperture, wherein:

at least one of: (a) the first counterpart of the first connecting structure, and (b) the second counterpart of the first connecting structure, is resiliently deformable, such that at least one of the first counterpart of the first connecting structure and the second counterpart of the first connecting structure is deflected while the inserting is being effected, and at least one of: (a) the first counterpart of the second connecting structure, and (b) the second counterpart of the second connecting structure is resiliently deformable, such that at least one of the first counterpart of the second connecting structure and the second counterpart of the second connecting structure is deflected while the inserting is being effected;

while the connection of the first counterpart of the first connecting structure and the second counterpart of the first connecting structure is established by the first interaction, the first counterpart of the first connecting structure and the second counterpart of the first connecting structure are co-operatively configured to oppose a deflection, of at least one of the first counterpart of the first connecting structure and the second counterpart of the first connecting structure, that is effective for defeating the first interaction; and while the connection of the first counterpart of the second connecting structure and the second counterpart of the second connecting structure is established by the second interaction, the first counterpart of the second connecting structure and the second counterpart of the second connecting structure are co-operatively configured to oppose a deflection, of at least one of the first counterpart of the second connecting structure and the second counterpart of the second connecting structure, that is effective for defeating the second interaction.

15. The kit of claim 14, wherein:

at least one of the first counterpart of the first connecting structure and the second counterpart of the first connecting structure is biased into the first interaction in response to alignment of the first counterpart of the first connecting structure with the second counterpart of the first connecting structure, and at least one of the first counterpart of the second connecting structure and the second counterpart of the second connecting structure is biased into the second interaction in response to alignment of the first counterpart of the second connecting structure with the second counterpart of the second connecting structure.

16. The kit of claim 15, wherein:

the at least one of the first counterpart of the first connecting structure and the second counterpart of the first connecting structure, that is biased into the first interaction, includes the first counterpart of the first connecting structure, such that the first counterpart of the first connecting structure is resiliently deformable between:

a first position for permitting the insertion of the vertical member through the horizontal rail via the respective rail aperture, and a second position for effecting the first interaction with the second counterpart of the first connecting structure;

and the at least one of the first counterpart of the second connecting structure and the second counterpart of the second connecting structure, that is biased into the second interaction, includes the first counterpart of the second connective structure, such that the first counterpart of the second connecting structure is resiliently deformable between:

a first position for permitting the insertion of the vertical member through the horizontal rail via the respective rail aperture, and a second position for effecting the second interaction with the second counterpart of the second connecting structure.

17. The kit of claim 14, wherein for at least one of the at least one vertical member, connection to the at least two horizontal rails is exclusively via the at least two connection systems.

18. The kit of claim 14, wherein:

the at least two horizontal rails are of plastic material; and the at least one vertical member is of plastic material.

19. The kit of claim 14, wherein:

the first counterpart of the first connecting structure, and the first rail sidewall, are integrally formed within a unitary one-piece construction; and the first counterpart of the second connecting structure, and the second rail sidewall, are integrally formed within a unitary one-piece construction.

20. The kit of claim 14, wherein:

the second counterpart of the first connecting structure includes a first slot and the first interaction includes an extension of the first counterpart of the first connecting structure into the first slot; and the second counterpart of the second connecting structure includes a second slot and the second interaction includes an extension of the first counterpart of the second connecting structure into the second slot.

* * * * *